US011540057B2

(12) United States Patent
Qi et al.

(10) Patent No.: US 11,540,057 B2
(45) Date of Patent: Dec. 27, 2022

(54) BONE CONDUCTION SPEAKER AND COMPOUND VIBRATION DEVICE THEREOF

(71) Applicant: SHENZHEN SHOKZ CO., LTD., Guangdong (CN)

(72) Inventors: Xin Qi, Shenzhen (CN); Fengyun Liao, Shenzhen (CN); Jinbo Zheng, Shenzhen (CN); Qian Chen, Shenzhen (CN); Hao Chen, Shenzhen (CN); Lei Zhang, Shenzhen (CN)

(73) Assignee: SHENZHEN SHOKZ CO., LTD., Shenzhen (CN)

( * ) Notice: Subject to any disclaimer, the term of this patent is extended or adjusted under 35 U.S.C. 154(b) by 73 days.

(21) Appl. No.: 17/218,549

(22) Filed: Mar. 31, 2021

(65) Prior Publication Data

US 2021/0281954 A1 Sep. 9, 2021

Related U.S. Application Data

(63) Continuation-in-part of application No. 17/170,817, filed on Feb. 8, 2021, now Pat. No. 11,395,072, which (Continued)

(30) Foreign Application Priority Data

Dec. 23, 2011 (CN) ..... 201110438083.9

(51) Int. Cl.
*H04R 9/06* (2006.01)
*H04R 1/00* (2006.01)

(Continued)

(52) U.S. Cl.
CPC ..... *H04R 9/063* (2013.01); *H04R 1/00* (2013.01); *H04R 1/10* (2013.01); *H04R 9/02* (2013.01);

(Continued)

(58) Field of Classification Search
CPC . H04R 9/063; H04R 1/00; H04R 1/10; H04R 1/1075; H04R 9/02; H04R 9/06;

(Continued)

(56) References Cited

U.S. PATENT DOCUMENTS 2,075,196 A 3/1937 Hand
4,418,248 A 11/1983 Mathis (Continued)

FOREIGN PATENT DOCUMENTS

CN 1842019 A 10/2006
CN 1976541 A 6/2007

(Continued)

OTHER PUBLICATIONS

The Office Action in Russian Application No. 2020137933 dated Jun. 10, 2021, 18 pages.

(Continued)

*Primary Examiner* — Norman Yu
(74) *Attorney, Agent, or Firm* — Metis IP LLC

(57) ABSTRACT

The present disclosure relates to a bone conduction speaker and its compound vibration device. The compound vibration device comprises a vibration conductive plate and a vibration board, the vibration conductive plate is set to be the first torus, where at least two first rods inside it converge to its center; the vibration board is set as the second torus, where at least two second rods inside it converge to its center. The vibration conductive plate is fixed with the vibration board; the first torus is fixed on a magnetic system, and the second torus comprises a fixed voice coil, which is driven by the magnetic system. The bone conduction speaker in the present disclosure and its compound vibration device adopt the fixed vibration conductive plate and vibration board, making the technique simpler with a lower cost; because the two adjustable parts in the compound vibration device can adjust (Continued)

both low frequency and high frequency area, the frequency response obtained is flatter and the sound is broader.

20 Claims, 31 Drawing Sheets

Related U.S. Application Data is a continuation of application No. 17/161,717, filed on Jan. 29, 2021, now Pat. No. 11,399,234, which is a continuation-in-part of application No. 16/159,070, filed on Oct. 12, 2018, now Pat. No. 10,911,876, which is a continuation of application No. 15/197,050, filed on Jun. 29, 2016, now Pat. No. 10,117,026, which is a continuation of application No. 14/513,371, filed on Oct. 14, 2014, now Pat. No. 9,402,116, which is a continuation of application No. 13/719,754, filed on Dec. 19, 2012, now Pat. No. 8,891,792, said application No. 17/161,717 is a continuation-in-part of application No. 16/833,839, filed on Mar. 30, 2020, now Pat. No. 11,399,245, which is a continuation of application No. 15/752,452, filed as application No. PCT/CN2015/086907 on Aug. 13, 2015, now Pat. No. 10,609,496, application No. 17/218,549, which is a continuation-in-part of application No. 17/169,816, filed on Feb. 8, 2021, now Pat. No. 11,350,205, which is a continuation of application No. 17/079,438, filed on Oct. 24, 2020, now Pat. No. 11,356,765, which is a continuation of application No. PCT/CN2018/084588, filed on Apr. 26, 2018.

(51) Int. Cl.
*H04R 9/02* (2006.01)
*H04R 31/00* (2006.01)
*H04R 1/10* (2006.01)
*H04R 25/00* (2006.01)

(52) U.S. Cl.
CPC ..... *H04R 9/025* (2013.01); *H04R 9/066* (2013.01); *H04R 31/00* (2013.01); *H04R 25/606* (2013.01); *H04R 2460/13* (2013.01)

(58) Field of Classification Search
CPC ..... H04R 9/025; H04R 9/066; H04R 11/02; H04R 31/00; H04R 25/606; H04R 2225/021; H04R 2225/023; H04R 2225/67; H04R 2400/03; H04R 2420/07; H04R 2460/13; H04R 2499/11; H04R 25/48
USPC ..... 381/151, 380, 162, 182, 326; 340/7.6; 600/25
See application file for complete search history.

(56) References Cited

U.S. PATENT DOCUMENTS

| | | | | |
|---|---|---|---|---|
| 4,442,323 | A | 4/1984 | Yoshida et al. | |
| 5,127,060 | A | 6/1992 | Paddock | |
| 5,363,452 | A | 11/1994 | Anderson | |
| 5,673,328 | A | 9/1997 | Wandl et al. | |
| 5,734,132 | A | 3/1998 | Proni | |
| 5,790,684 | A | 8/1998 | Niino et al. | |
| 6,389,148 | B1 | 5/2002 | Yoo et al. | |
| 6,850,138 | B1 | 2/2005 | Sakai | |
| 7,146,014 | B2 | 12/2006 | Hannah | |
| 8,891,792 | B2 | 11/2014 | Qi et al. | |
| 9,226,075 | B2 | 12/2015 | Lee | |
| 9,253,563 | B2 | 2/2016 | Fukuda | |
| 9,742,887 | B2 | 8/2017 | Hosoi et al. | |
| 2003/0012395 | A1* | 1/2003 | Fukuda | H04R 9/066 381/151 |
| 2003/0053651 | A1 | 3/2003 | Koura et al. | |
| 2003/0085070 | A1 | 5/2003 | Wickstrom | |
| 2004/0105566 | A1 | 6/2004 | Matsunaga et al. | |
| 2004/0131218 | A1 | 7/2004 | Dedieu et al. | |
| 2005/0063553 | A1 | 3/2005 | Ozawa | |
| 2005/0234715 | A1 | 10/2005 | Ozawa | |
| 2006/0165246 | A1 | 7/2006 | Lee et al. | |
| 2006/0262954 | A1 | 11/2006 | Lee et al. | |
| 2007/0041588 | A1 | 2/2007 | Lin | |
| 2007/0047744 | A1 | 3/2007 | Harney et al. | |
| 2007/0053536 | A1 | 3/2007 | Westerkull | |
| 2008/0166007 | A1 | 7/2008 | Hankey et al. | |
| 2009/0097681 | A1 | 4/2009 | Puria et al. | |
| 2009/0112051 | A1 | 4/2009 | Miller, III | |
| 2009/0175477 | A1 | 7/2009 | Suzuki et al. | |
| 2009/0209806 | A1 | 8/2009 | Hakansson | |
| 2009/0245553 | A1 | 10/2009 | Parker | |
| 2009/0285417 | A1 | 11/2009 | Shin et al. | |
| 2010/0046783 | A1 | 2/2010 | Huang | |
| 2010/0329485 | A1 | 12/2010 | Fukuda | |
| 2011/0022119 | A1 | 1/2011 | Parker | |
| 2011/0179876 | A1 | 7/2011 | Kasai et al. | |
| 2012/0020501 | A1 | 1/2012 | Lee | |
| 2012/0076322 | A1 | 3/2012 | Kimura et al. | |
| 2012/0224723 | A1 | 9/2012 | Akino | |
| 2012/0281861 | A1 | 11/2012 | Lin | |
| 2012/0286765 | A1* | 11/2012 | Heuvel | H04R 25/606 600/25 |
| 2012/0302822 | A1 | 11/2012 | Van Himbeeck et al. | |
| 2013/0018218 | A1 | 1/2013 | Haller et al. | |
| 2013/0121513 | A1 | 5/2013 | Adachi | |
| 2013/0156241 | A1 | 6/2013 | Jinton | |
| 2013/0208923 | A1 | 8/2013 | Suvanto | |
| 2013/0308798 | A1 | 11/2013 | Lee | |
| 2014/0064533 | A1 | 3/2014 | Kasic, II | |
| 2014/0270293 | A1 | 9/2014 | Ruppersberg et al. | |
| 2015/0130945 | A1 | 5/2015 | Yu et al. | |
| 2015/0208183 | A1 | 7/2015 | Bern | |
| 2015/0264473 | A1 | 9/2015 | Fukuda | |
| 2016/0037243 | A1 | 2/2016 | Lippert et al. | |
| 2016/0050499 | A1 | 2/2016 | Bolognia et al. | |
| 2016/0127841 | A1 | 5/2016 | Horii | |
| 2016/0150337 | A1 | 5/2016 | Nandy | |
| 2016/0165357 | A1 | 6/2016 | Morishita et al. | |
| 2016/0295328 | A1 | 10/2016 | Park | |
| 2017/0061953 | A1 | 3/2017 | An et al. | |
| 2017/0111734 | A1 | 4/2017 | Macours | |
| 2017/0374479 | A1 | 12/2017 | Qi et al. | |
| 2018/0077507 | A1 | 3/2018 | Bernal Castillo et al. | |
| 2019/0014425 | A1 | 1/2019 | Liao et al. | |
| 2020/0286462 | A1 | 9/2020 | Nielsen | |

FOREIGN PATENT DOCUMENTS

| | | | |
|---|---|---|---|
| CN | 102314871 | A | 1/2012 |
| CN | 102497612 | A | 6/2012 |
| CN | 202435598 | U | 9/2012 |
| CN | 105007551 | A | 10/2015 |
| CN | 105101019 | A | 11/2015 |
| CN | 105101020 | A | 11/2015 |
| CN | 105142077 | A | 12/2015 |
| CN | 204836575 | U | 12/2015 |
| CN | 204887455 | U | 12/2015 |
| CN | 205142506 | U | 4/2016 |
| DE | 3921784 | A1 | 1/1991 |
| EP | 1404146 | A1 | 3/2004 |
| EP | 1603362 | A1 | 12/2005 |
| EP | 2234413 | B1 | 11/2020 |
| JP | S5574290 | A | 6/1980 |
| JP | 07007797 | A | 1/1995 |
| JP | 3045202 | U | 1/1998 |
| JP | 2003254882 | A | 9/2003 |
| JP | 2004064457 | A | 2/2004 |
| JP | 2004158961 | A | 6/2004 |
| JP | 2005151183 | A | 6/2005 |
| JP | 2006025333 | A | 1/2006 |

(56) References Cited

FOREIGN PATENT DOCUMENTS

| | | | |
|---|---|---|---|
| JP | 2007129384 | A | 5/2007 |
| JP | 2007174165 | A | 7/2007 |
| JP | 2008017398 | A | 1/2008 |
| JP | 2008054063 | A | 3/2008 |
| JP | 2010114878 | A | 5/2010 |
| JP | 2011160175 | A | 8/2011 |
| JP | 2011176533 | A | 9/2011 |
| JP | 2013243564 | A | 12/2013 |
| KR | 20010111653 | A | 12/2001 |
| KR | 200476572 | Y1 | 9/2004 |
| KR | 20050030183 | A | 3/2005 |
| KR | 20070122104 | A | 12/2007 |
| KR | 20080101166 | A | 11/2008 |
| KR | 20090082999 | A | 8/2009 |
| KR | 20090091378 | A | 8/2009 |
| KR | 20110037483 | A | 4/2011 |
| WO | 9522678 | A2 | 8/1995 |
| WO | 0219759 | A1 | 3/2002 |
| WO | 2006088410 | A1 | 8/2006 |
| WO | 2010110713 | A1 | 9/2010 |
| WO | 2010114195 | A1 | 10/2010 |
| WO | 2012025794 | A1 | 3/2012 |
| WO | 2015142893 | A1 | 9/2015 |

OTHER PUBLICATIONS

Notice of Reasons for Rejection in Japanese Application No. 2020088413 dated Aug. 3, 2021, 7 pages.
Notice of Reasons for Rejection in Japanese Application No. 2020560320 dated Dec. 20, 2021, 25 pages.
First Office Action in Chinese Application No. 201110438083.9 dated Sep. 27, 2012, 10 pages.
The Extended European Search Report in European Application No. 12860348.7 dated Apr. 28, 2015, 7 pages.
International Search Report in PCT/CN2012/086513 dated Mar. 14, 2013, 5 pages.
Written Opinion in PCT/CN2012/086513 dated Mar. 14, 2013, 10 pages.
International Search Report in PCT/CN2015/086907 dated May 6, 2016, 10 pages.
Notice of Reasons for Rejection in Japanese Application No. 2018-506985 dated Sep. 3, 2019, 8 pages.
Notice of Reasons for Rejection in Japanese Application No. 2018-146019 dated Jul. 23, 2019, 8 pages.
Decision of Final Rejection in Japanese Application No. 2018-146019 dated Jan. 21, 2020, 9 pages.
Notice of Reasons for Rejection in Japanese Application No. 2018-146020 dated Jul. 23, 2019, 8 pages.
Notice of Reasons for Rejection in Japanese Application No. 2018146021 dated Jul. 30, 2019, 8 pages.
Decision to Grant a Patent in Japanese Application No. 2018146021 dated Jul. 21, 2020, 5 pages.
The Extended European Search Report in European Application No. 18916724.0 dated Feb. 23, 2021, 13 pages.
First Examination Report in Indian Application No. 202017046619 dated Jun. 23, 2021, 5 pages.
International Search Report in PCT/CN2018/084588 dated Oct. 12, 2016, 6 pages.
Written Opinion in PCT/CN2018/084588 dated Oct. 12, 2018, 10 pages.
Notice of Preliminary Rejection in Korean Application No. 10-2022-7003237 dated Apr. 13, 2022, 14 pages.
M. Gripper et al., Using the Callsign Acquisition Test (CAT) to Compare the Speech Intelligibility of Air Versus Bone Conduction, International Journal of Industrial Ergonomics, 37(7): 631-641, 2007.
Martin L. Lenhardt et al., Measurement of Bone Conduction Levels for High Frequencies, International Tinnitus Journal, 8(1): 9-12, 2002.
The Extended European Search Report in European Application No. 21186537.3 dated Nov. 9, 2021, 9 pages.
Notice of Reasons for Refusal in Japanese Application No. 2020-088413 dated Sep. 6, 2022, 11 pages.
Decision on Grant in Russian Application No. 2021134604 dated Sep. 23, 2022, 16 pages.
The Second Notice of Preliminary Rejection in Korean Application No. 10-2022-700323 dated Oct. 11, 2022, 14 pages.
Notice of Reasons for Refusal in Japanese Application No. 2021-179711 dated Oct. 18, 2022, 8 pages.

* cited by examiner

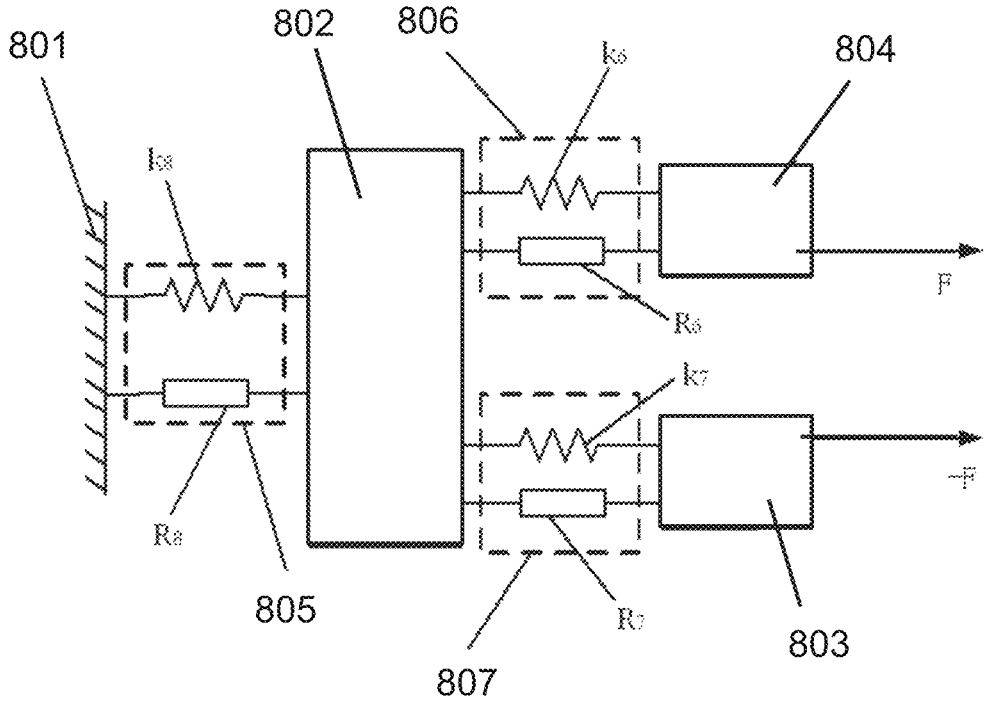
FIG. 8-A

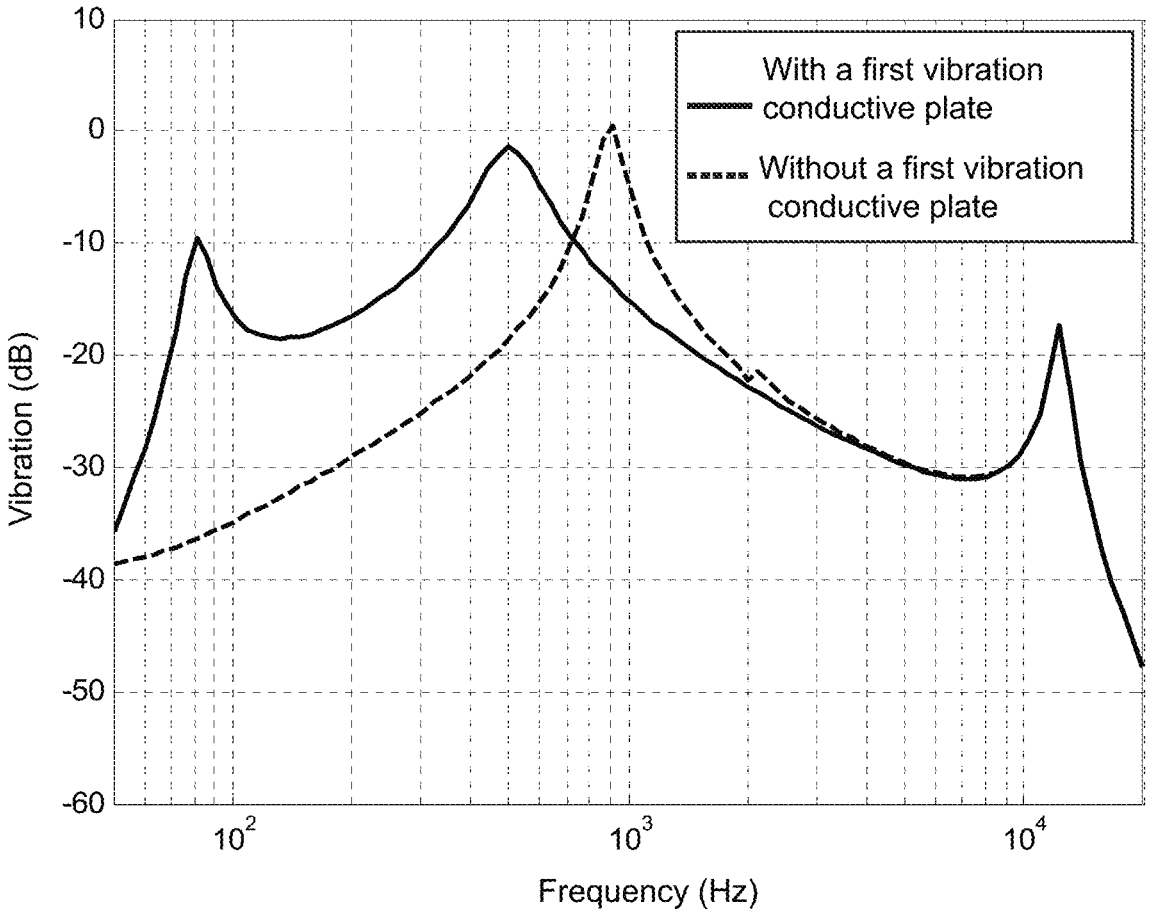
FIG. 8-B

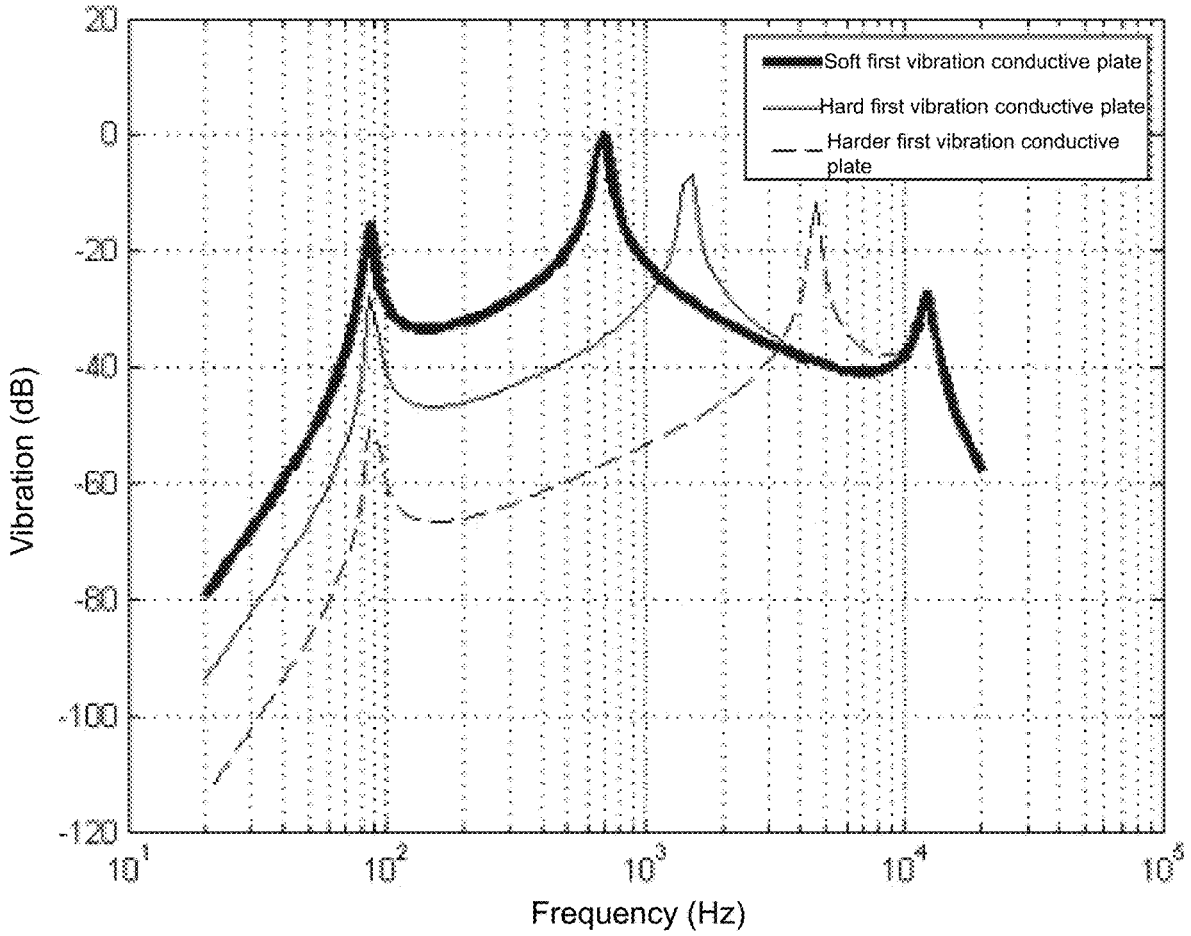
FIG. 8-C

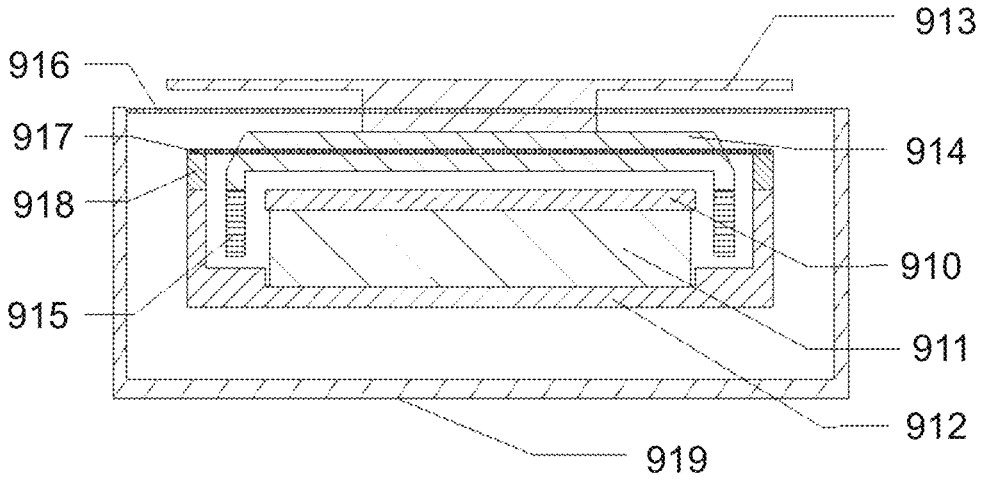
FIG. 9-A

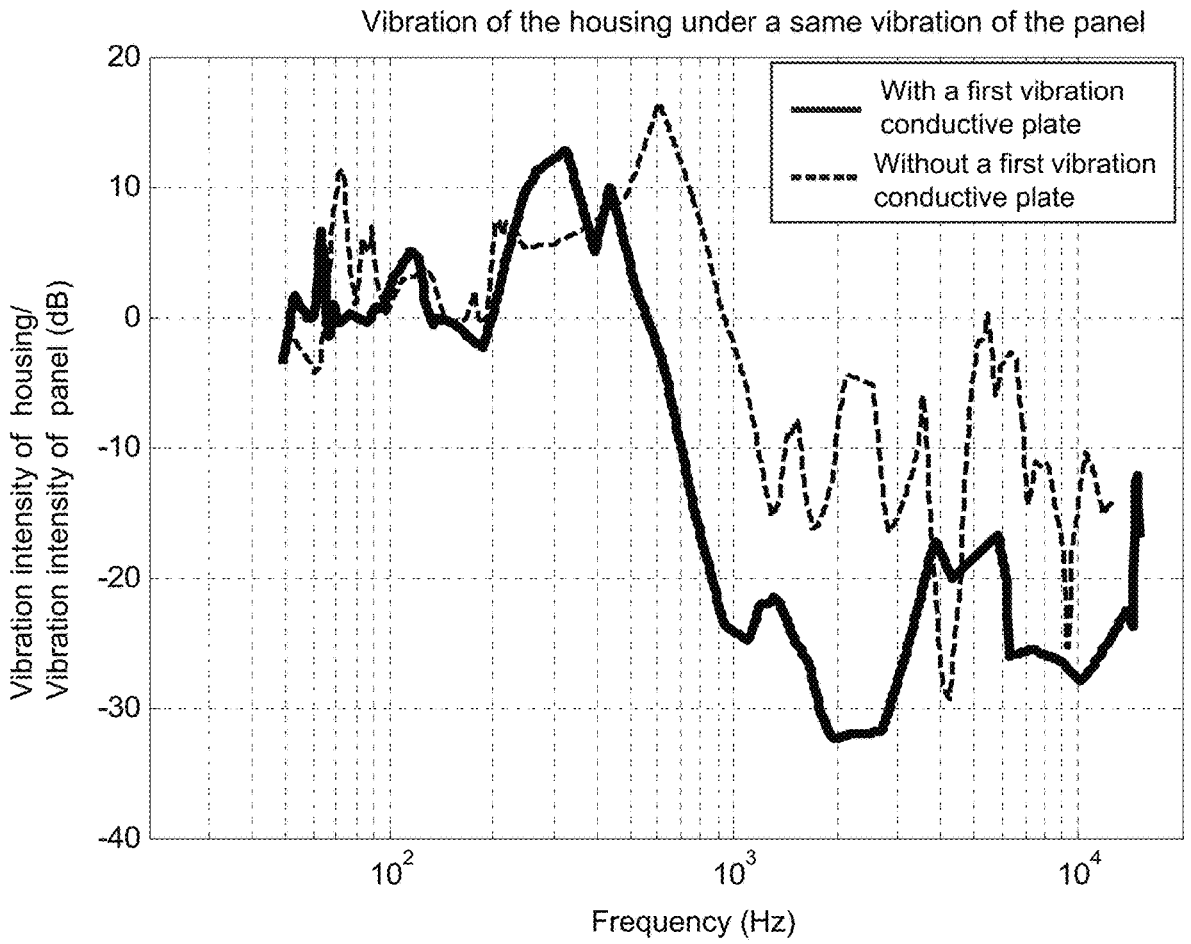
FIG. 9-B

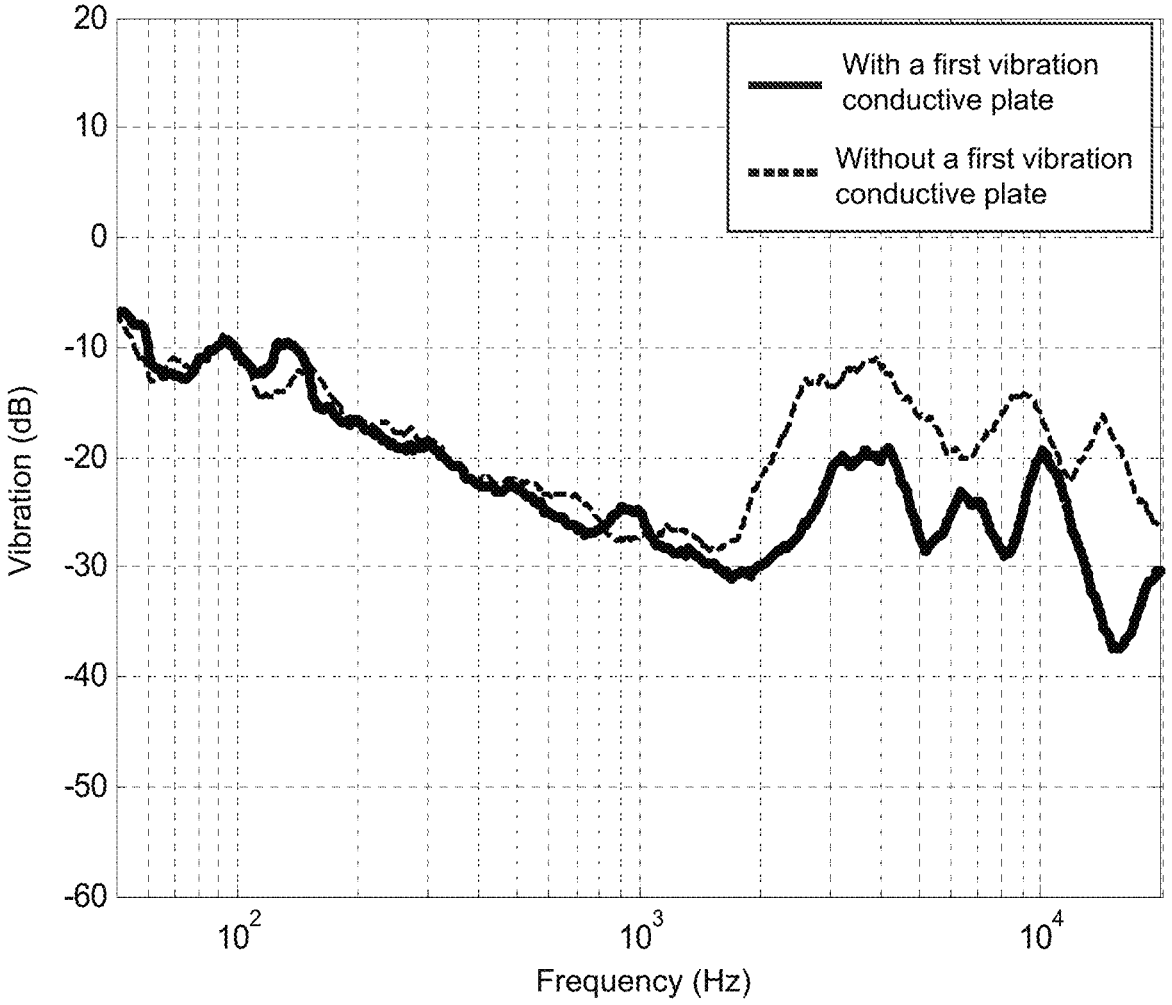
FIG. 9-C

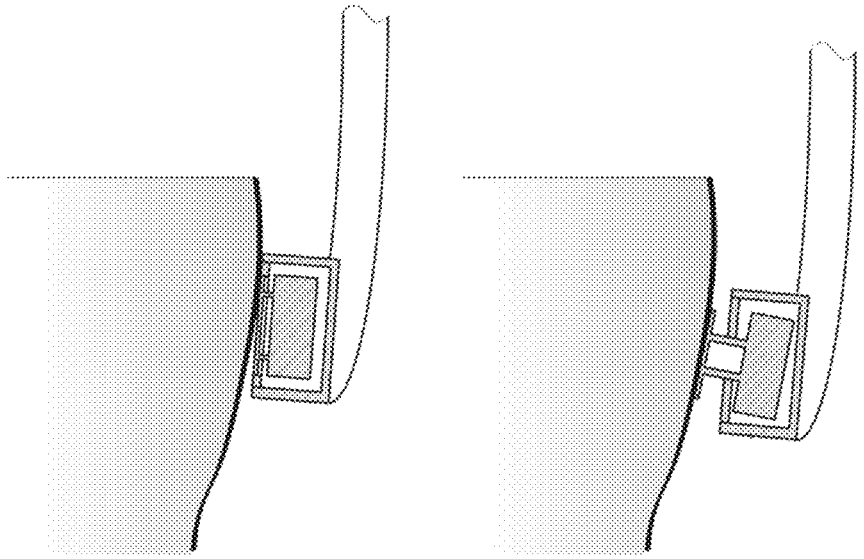
FIG. 11-A

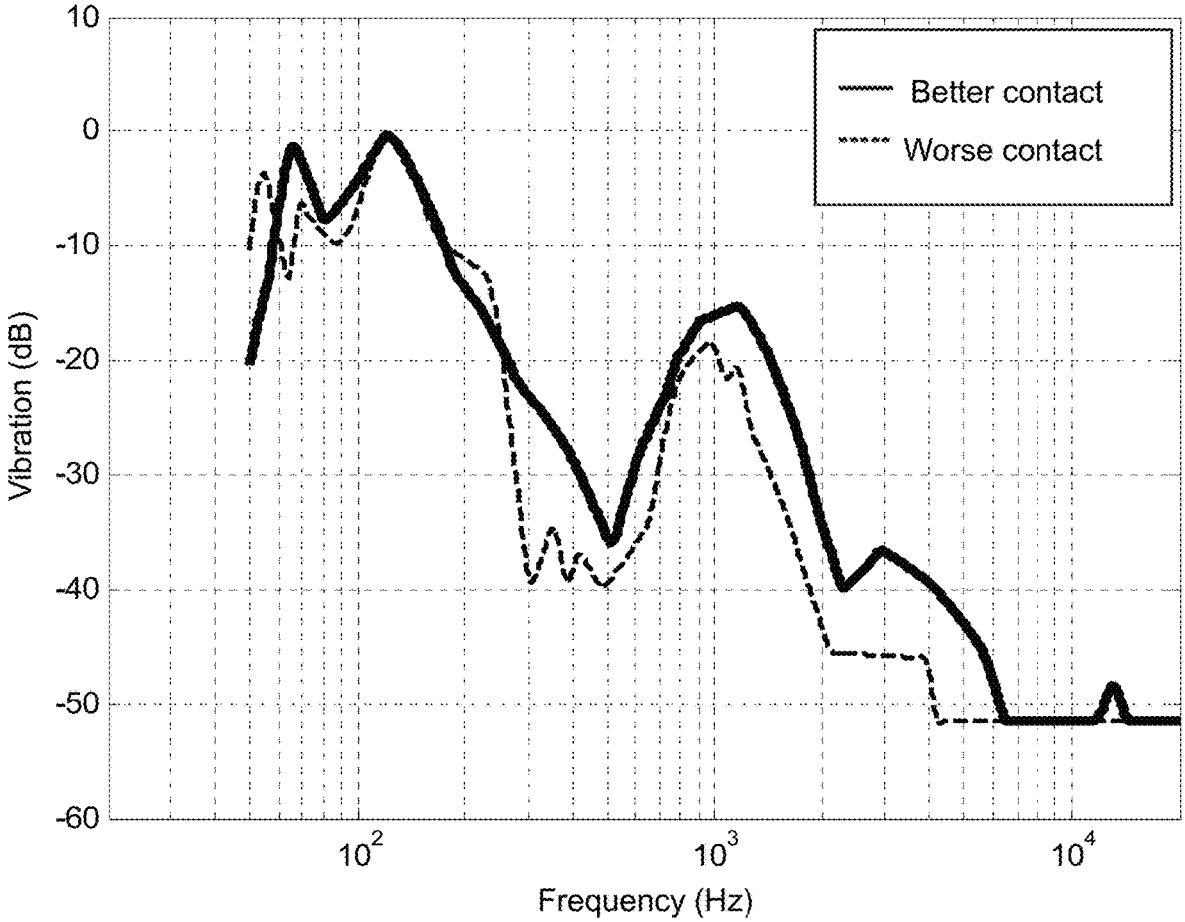
FIG. 11-B

1510
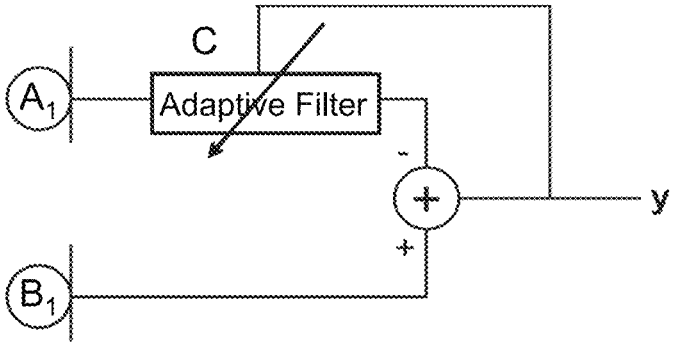
FIG. 15-A
1520
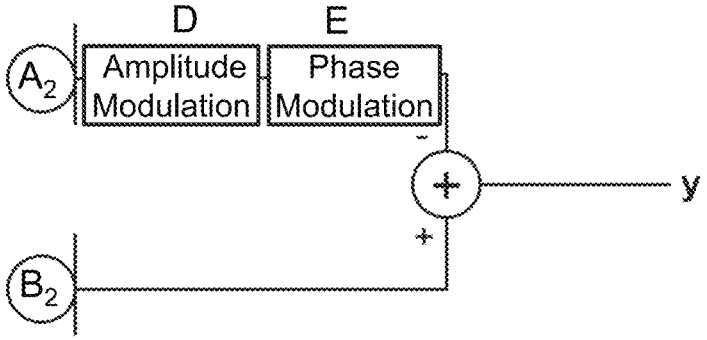
FIG. 15-B
1530
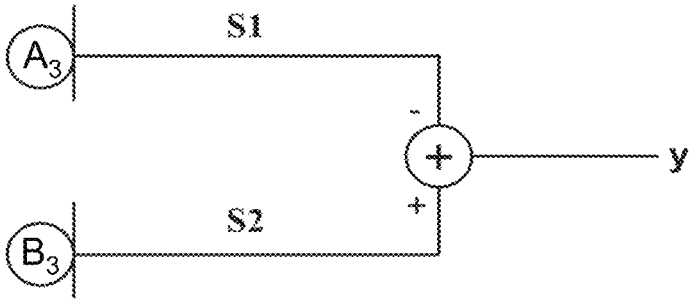
FIG. 15-C

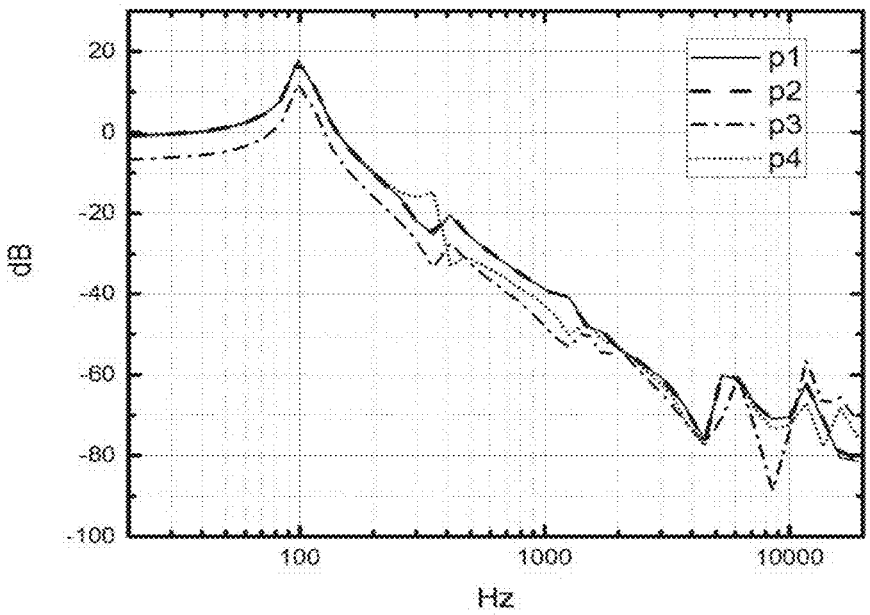
FIG. 17-A
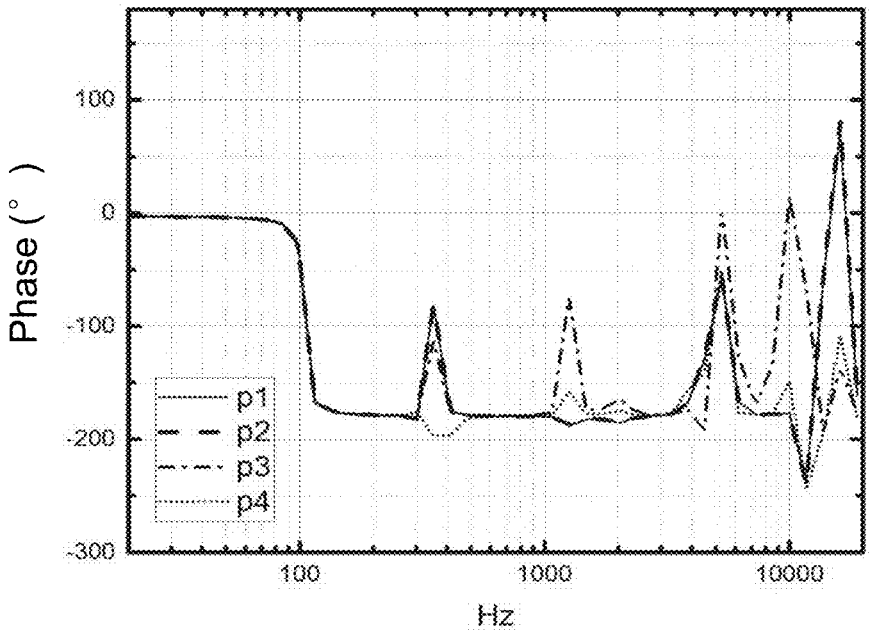
FIG. 17-B

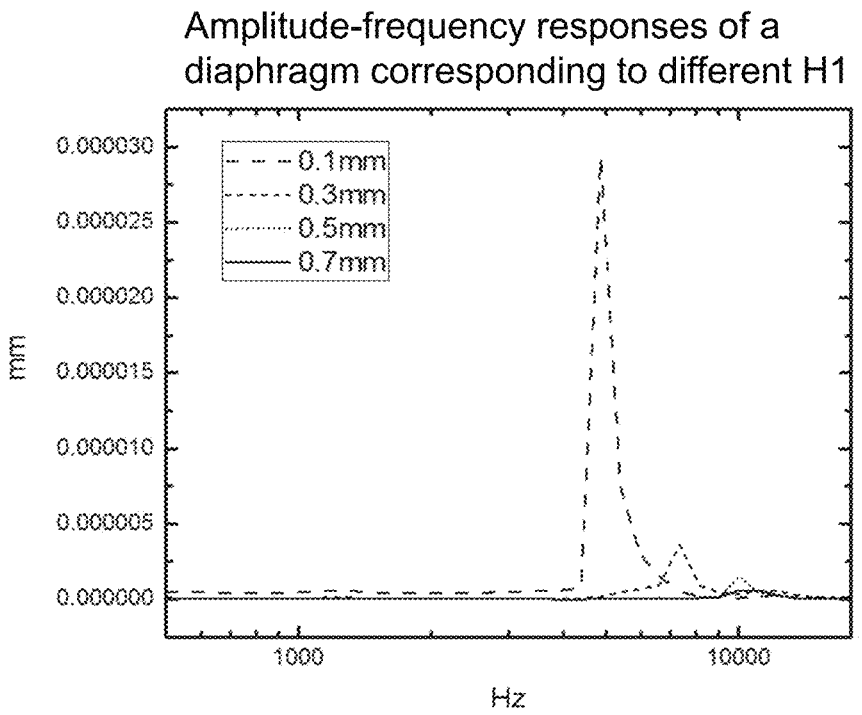
FIG. 19-A
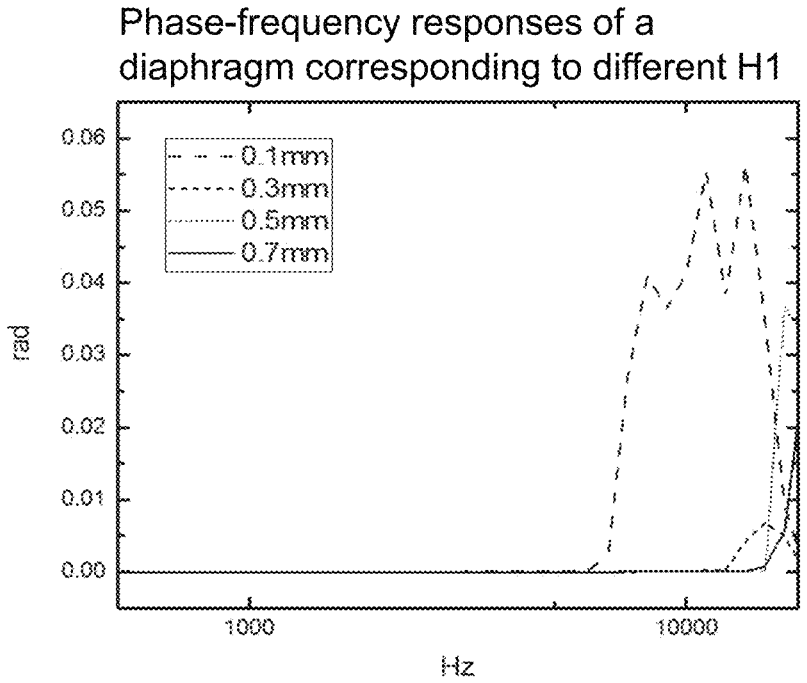
FIG. 19-B

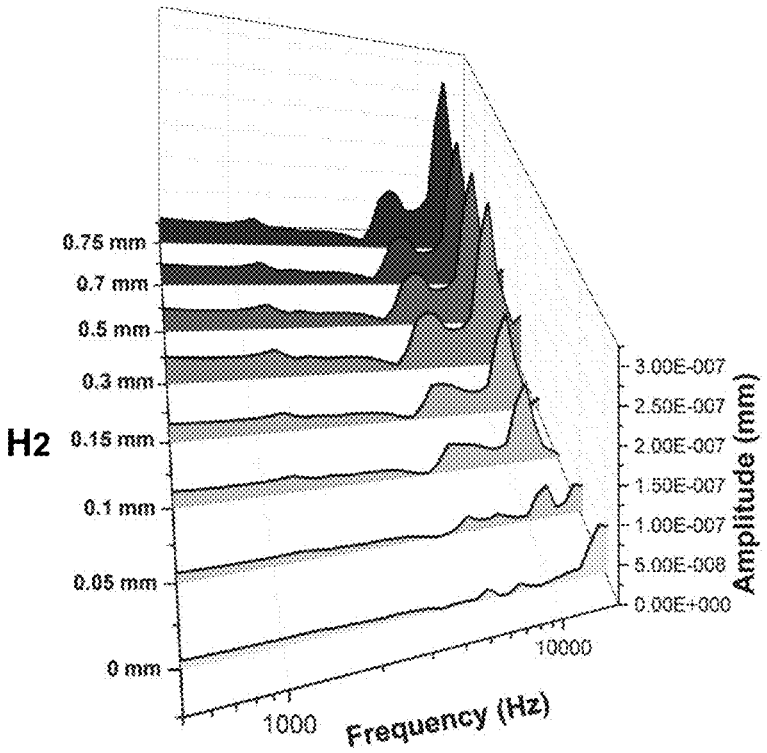
FIG. 21-A
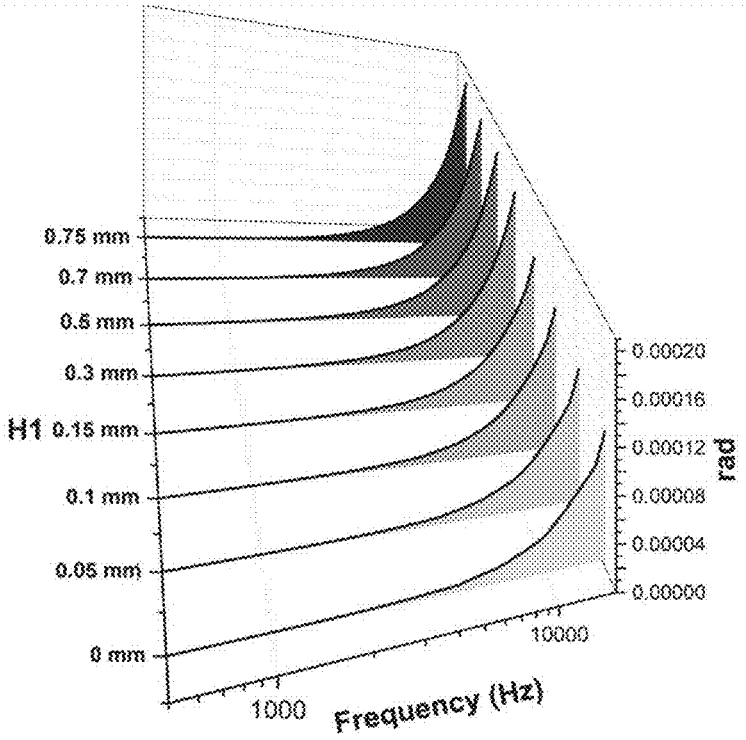
FIG. 21-B

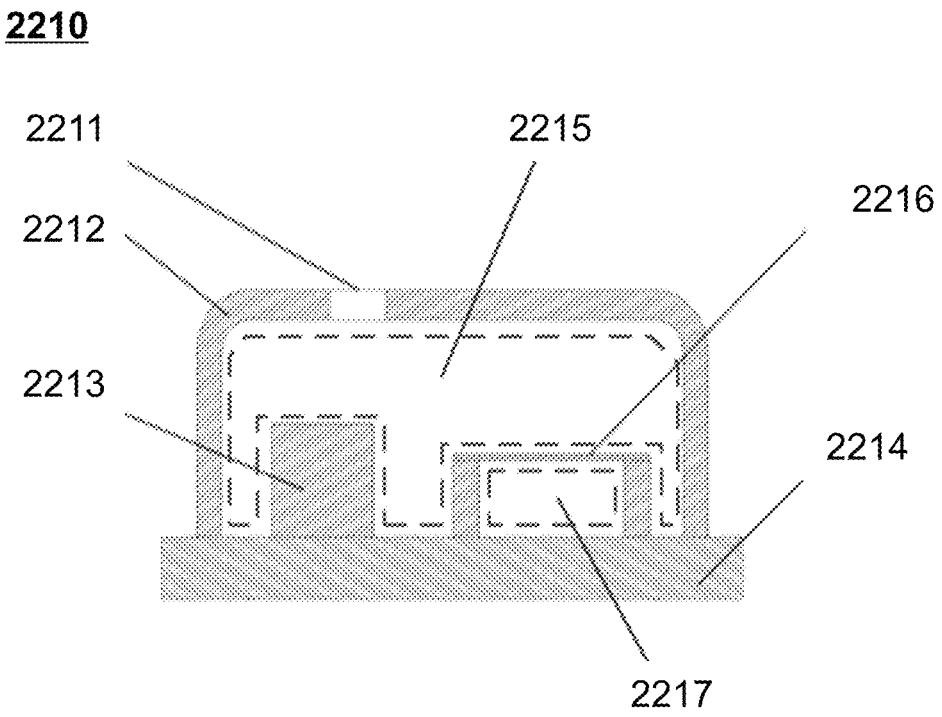
FIG. 22-A
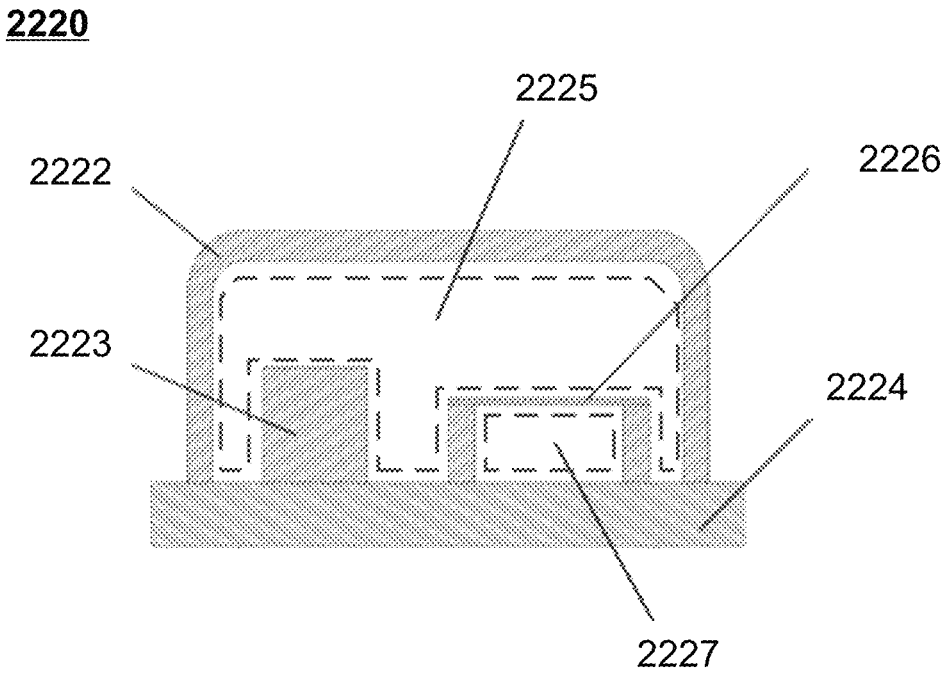
FIG. 22-B

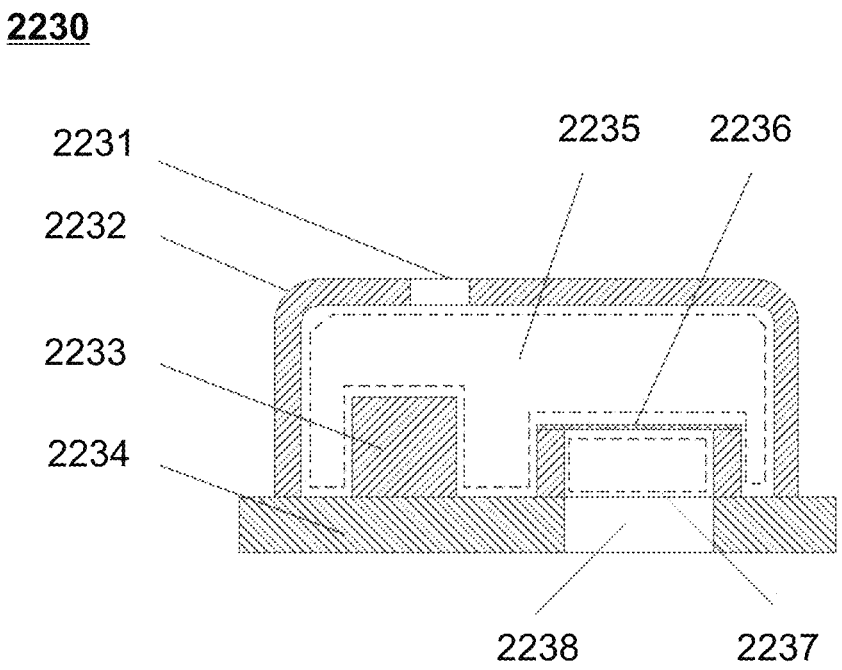
FIG. 22-C

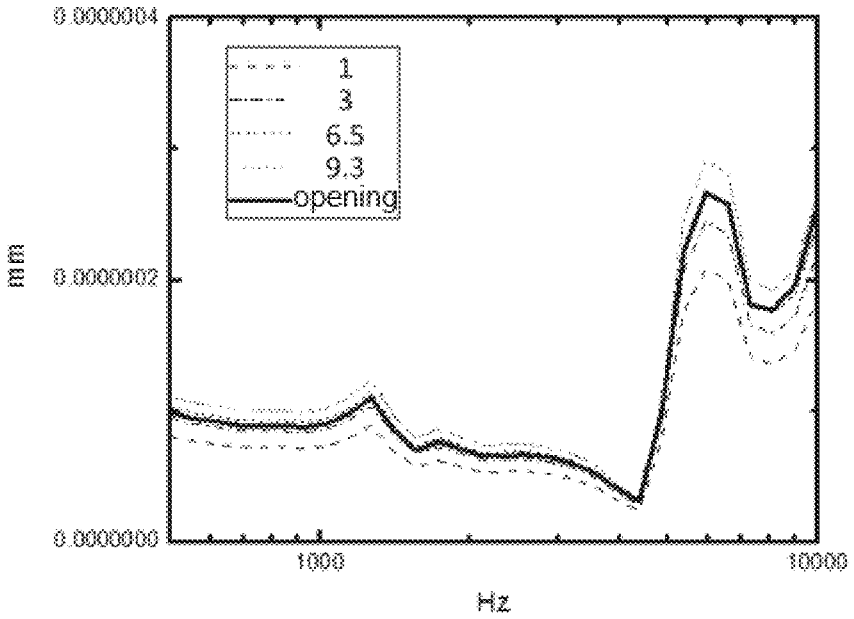
FIG. 23-A
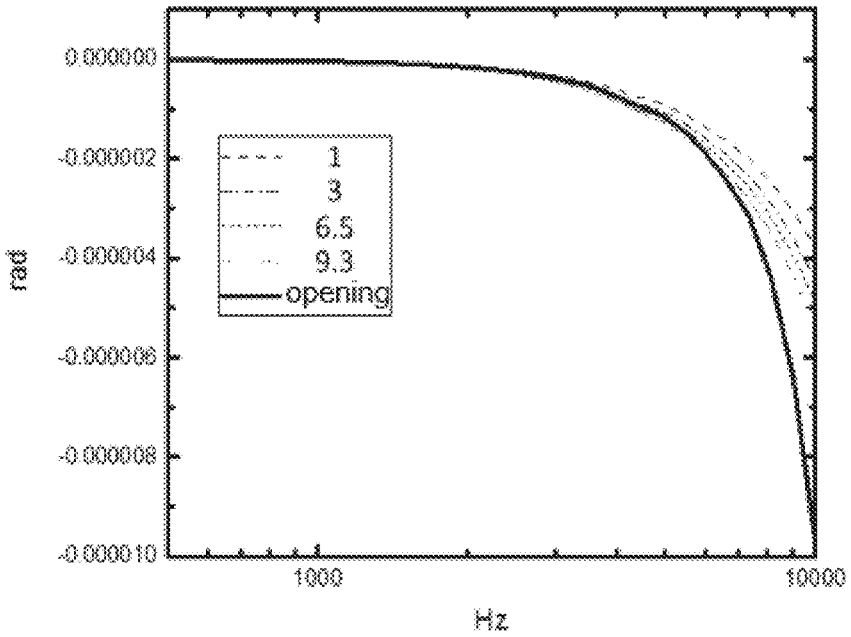
FIG. 23-B

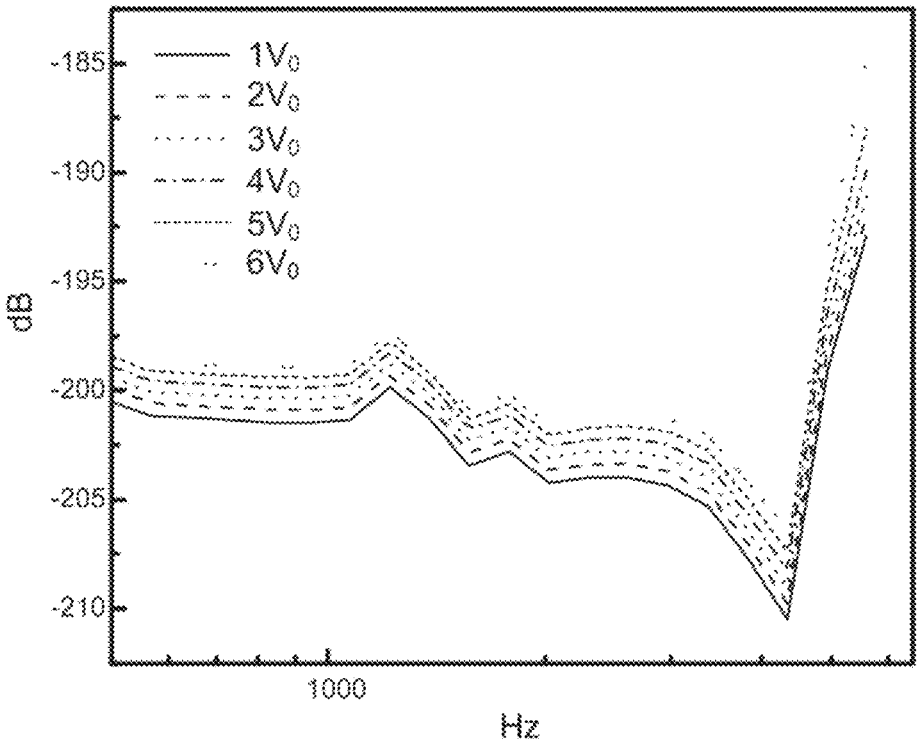
FIG. 24-A
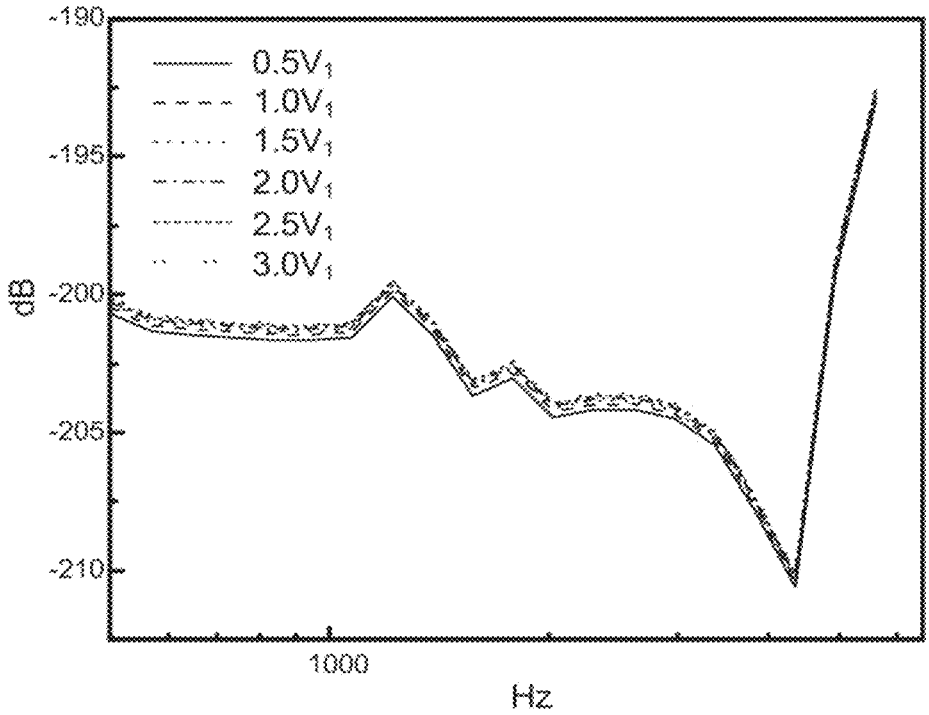
FIG. 24-B

BONE CONDUCTION SPEAKER AND COMPOUND VIBRATION DEVICE THEREOF

CROSS-REFERENCE TO RELATED APPLICATIONS

This application is a continuation-in-part application of U.S. patent application Ser. No. 17/170,817, filed on Feb. 8, 2021, which is a continuation of U.S. patent application Ser. No. 17/161,717, filed on Jan. 29, 2021, which is a continuation-in-part application of U.S. patent application Ser. No. 16/159,070 (issued as U.S. Pat. No. 10,911,876), filed on Oct. 12, 2018, which is a continuation of U.S. patent application Ser. No. 15/197,050 (issued as U.S. Pat. No. 10,117,026), filed on Jun. 29, 2016, which is a continuation of U.S. patent application Ser. No. 14/513,371 (issued as U.S. Pat. No. 9,402,116), filed on Oct. 14, 2014, which is a continuation of U.S. patent application Ser. No. 13/719,754 (issued as U.S. Pat. No. 8,891,792), filed on Dec. 19, 2012, which claims priority to Chinese Patent Application No. 201110438083.9, filed on Dec. 23, 2011; U.S. patent application Ser. No. 17/161,717, filed on Jan. 29, 2021 is also a continuation-in-part application of U.S. patent application Ser. No. 16/833,839, filed on Mar. 30, 2020, which is a continuation of U.S. application Ser. No. 15/752,452 (issued as U.S. Pat. No. 10,609,496), filed on Feb. 13, 2018, which is a national stage entry under 35 U.S.C. § 371 of International Application No. PCT/CN2015/086907, filed on Aug. 13, 2015; this application is also a continuation-in-part of U.S. patent application Ser. No. 17/169,816, filed on Feb. 8, 2021, which is a continuation of U.S. patent application Ser. No. 17/079,438, filed on Oct. 24, 2020, which is a continuation of International Application No. PCT/CN2018/084588, filed on Apr. 26, 2018. Each of the above-referenced applications is hereby incorporated by reference.

TECHNICAL FIELD

The present disclosure relates to improvements on a bone conduction speaker and its components, in detail, relates to a bone conduction speaker and its compound vibration device, while the frequency response of the bone conduction speaker has been improved by the compound vibration device, which is composed of vibration boards and vibration conductive plates.

BACKGROUND

Based on the current technology, the principle that we can hear sounds is that the vibration transferred through the air in our external acoustic meatus, reaches to the ear drum, and the vibration in the ear drum drives our auditory nerves, makes us feel the acoustic vibrations. The current bone conduction speakers are transferring vibrations through our skin, subcutaneous tissues and bones to our auditory nerves, making us hear the sounds.

When the current bone conduction speakers are working, with the vibration of the vibration board, the shell body, fixing the vibration board with some fixers, will also vibrate together with it, thus, when the shell body is touching our post auricles, cheeks, forehead or other parts, the vibrations will be transferred through bones, making us hear the sounds clearly.

However, the frequency response curves generated by the bone conduction speakers with current vibration devices are shown as the two solid lines in FIG. 4. In ideal conditions, the frequency response curve of a speaker is expected to be a straight line, and the top plain area of the curve is expected to be wider, thus the quality of the tone will be better, and easier to be perceived by our ears. However, the current bone conduction speakers, with their frequency response curves shown as FIG. 4, have overtopped resonance peaks either in low frequency area or high frequency area, which has limited its tone quality a lot. Thus, it is very hard to improve the tone quality of current bone conduction speakers containing current vibration devices. The current technology needs to be improved and developed.

SUMMARY

The purpose of the present disclosure is providing a bone conduction speaker and its compound vibration device, to improve the vibration parts in current bone conduction speakers, using a compound vibration device composed of a vibration board and a vibration conductive plate to improve the frequency response of the bone conduction speaker, making it flatter, thus providing a wider range of acoustic sound.

The technical proposal of present disclosure is listed as below:

A compound vibration device in bone conduction speaker contains a vibration conductive plate and a vibration board, the vibration conductive plate is set as the first torus, where at least two first rods in it converge to its center. The vibration board is set as the second torus, where at least two second rods in it converge to its center. The vibration conductive plate is fixed with the vibration board. The first torus is fixed on a magnetic system, and the second torus contains a fixed voice coil, which is driven by the magnetic system.

In the compound vibration device, the magnetic system contains a baseboard, and an annular magnet is set on the board, together with another inner magnet, which is concentrically disposed inside this annular magnet, as well as an inner magnetic conductive plate set on the inner magnet, and the annular magnetic conductive plate set on the annular magnet. A grommet is set on the annular magnetic conductive plate to fix the first torus. The voice coil is set between the inner magnetic conductive plate and the annular magnetic plate.

In the compound vibration device, the number of the first rods and the second rods are both set to be three.

In the compound vibration device, the first rods and the second rods are both straight rods.

In the compound vibration device, there is an indentation at the center of the vibration board, which adapts to the vibration conductive plate.

In the compound vibration device, the vibration conductive plate rods are staggered with the vibration board rods.

In the compound vibration device, the staggered angles between rods are set to be 60 degrees.

In the compound vibration device, the vibration conductive plate is made of stainless steel, with a thickness of 0.1-0.2 mm, and, the width of the first rods in the vibration conductive plate is 0.5-1.0 mm; the width of the second rods in the vibration board is 1.6-2.6 mm, with a thickness of 0.8-1.2 mm.

In the compound vibration device, the number of the vibration conductive plate and the vibration board is set to be more than one. They are fixed together through their centers and/or torus.

A bone conduction speaker comprises a compound vibration device which adopts any methods stated above.

The bone conduction speaker and its compound vibration device as mentioned in the present disclosure, adopting the fixed vibration boards and vibration conductive plates, make the technique simpler with a lower cost. Also, because the two parts in the compound vibration device can adjust low frequency and high frequency areas, the achieved frequency response is flatter and wider, the possible problems like abrupt frequency responses or feeble sound caused by single vibration device will be avoided.

BRIEF DESCRIPTION OF THE DRAWINGS

FIG. 8-A illustrates an equivalent vibration model of the vibration portion of the bone conduction speaker according to some embodiments of the present disclosure;

FIG. 8-B illustrates a vibration response curve of the bone conduction speaker according to one specific embodiment of the present disclosure;

FIG. 8-C illustrates a vibration response curve of the bone conduction speaker according to one specific embodiment of the present disclosure;

FIG. 9-A illustrates a structure of the vibration generation portion of the bone conduction speaker according to one specific embodiment of the present disclosure;

FIG. 9-B illustrates a vibration response curve of the bone conduction speaker according to one specific embodiment of the present disclosure;

FIG. 9-C illustrates a sound leakage curve of the bone conduction speaker according to one specific embodiment of the present disclosure;

FIG. 11-A illustrates an application scenario of the bone conduction speaker according to one specific embodiment of the present disclosure;

FIG. 11-B illustrates a vibration response curve of the bone conduction speaker according to one specific embodiment of the present disclosure;

FIGS. 15-A to 15-C are schematic diagrams illustrating signal processing methods for removing vibration noises according to some embodiments of the present disclosure;

FIG. 17-A is a schematic diagram illustrating amplitude-frequency response curves of a microphone disposed at different positions of a housing of a speaker according to some embodiments of the present disclosure;

FIG. 17-B is a schematic diagram illustrating phase-frequency response curves of a microphone disposed at different positions of a housing of a speaker according to some embodiments of the present disclosure;

FIG. 19-A is a schematic diagram illustrating amplitude-frequency response curves of a microphone or a vibration sensor connected to different positions on a housing according to some embodiments of the present disclosure;

FIG. 19-B is a schematic diagram illustrating phase-frequency response curves of a microphone or a vibration sensor connected to different positions on a housing according to some embodiments of the present disclosure;

FIG. 21-A is a schematic diagram illustrating amplitude-frequency response curves of a microphone or a vibration sensor connected to different positions on a housing according to some embodiments of the present disclosure;

FIG. 21-B is a schematic diagram illustrating phase-frequency response curves of a microphone or a vibration sensor connected to different positions on a housing according to some embodiments of the present disclosure;

FIGS. 22-A to 22-C are schematic diagrams illustrating a structure of a microphone and a vibration sensor according to some embodiments of the present disclosure;

FIG. 23-A is a schematic diagram illustrating amplitude-frequency response curves of a vibration sensor with different cavity heights according to some embodiments of the present disclosure;

FIG. 23-B is a schematic diagram illustrating phase-frequency response curves of a vibration sensor with different cavity heights according to some embodiments of the present disclosure;

FIG. 24-A is a schematic diagram illustrating amplitude-frequency response curves of an air conduction microphone when a front cavity volume changes according to some embodiments of the present disclosure;

FIG. 24-B is a schematic diagram illustrating amplitude-frequency response curves of an air conduction microphone when a back cavity volume changes according to some embodiments of the present disclosure;

DETAILED DESCRIPTION

A detailed description of the implements of the present disclosure is stated here, together with attached figures.

Figure 1:
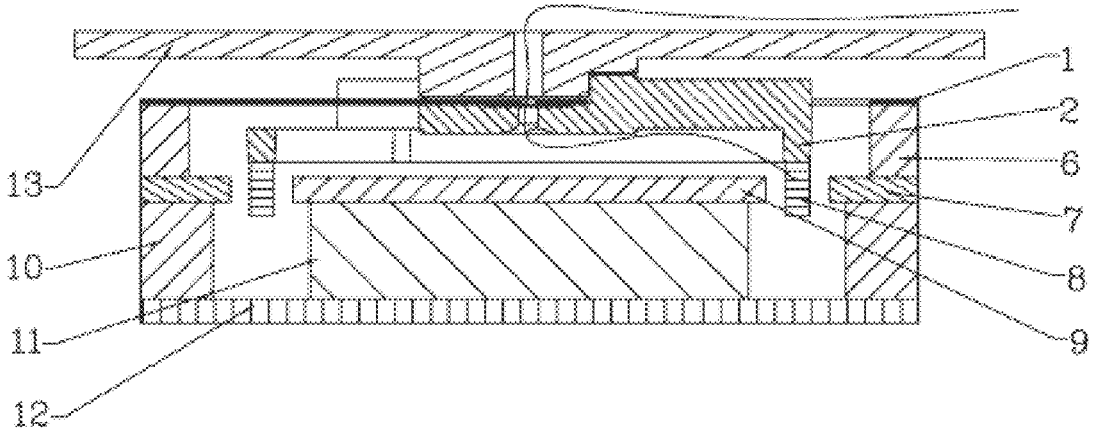
FIG. 1 illustrates a longitudinal section view of the bone conduction speaker in the present disclosure.
Figure 2:
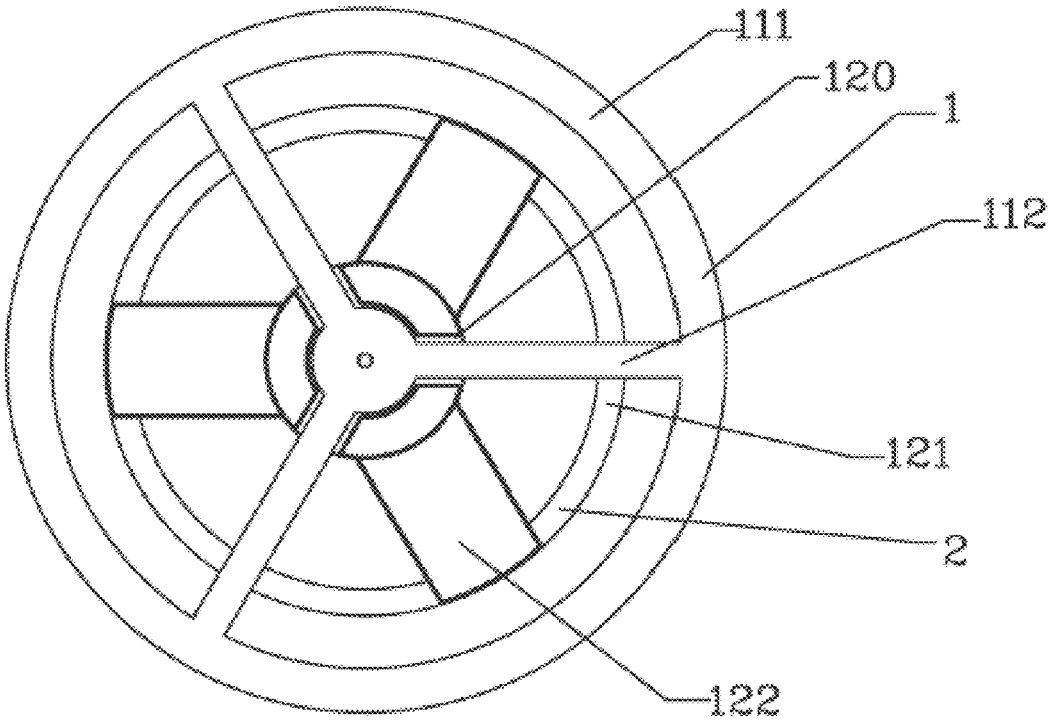
FIG. 2 illustrates a perspective view of the vibration parts in the bone conduction speaker in the present disclosure.
Figure 3:
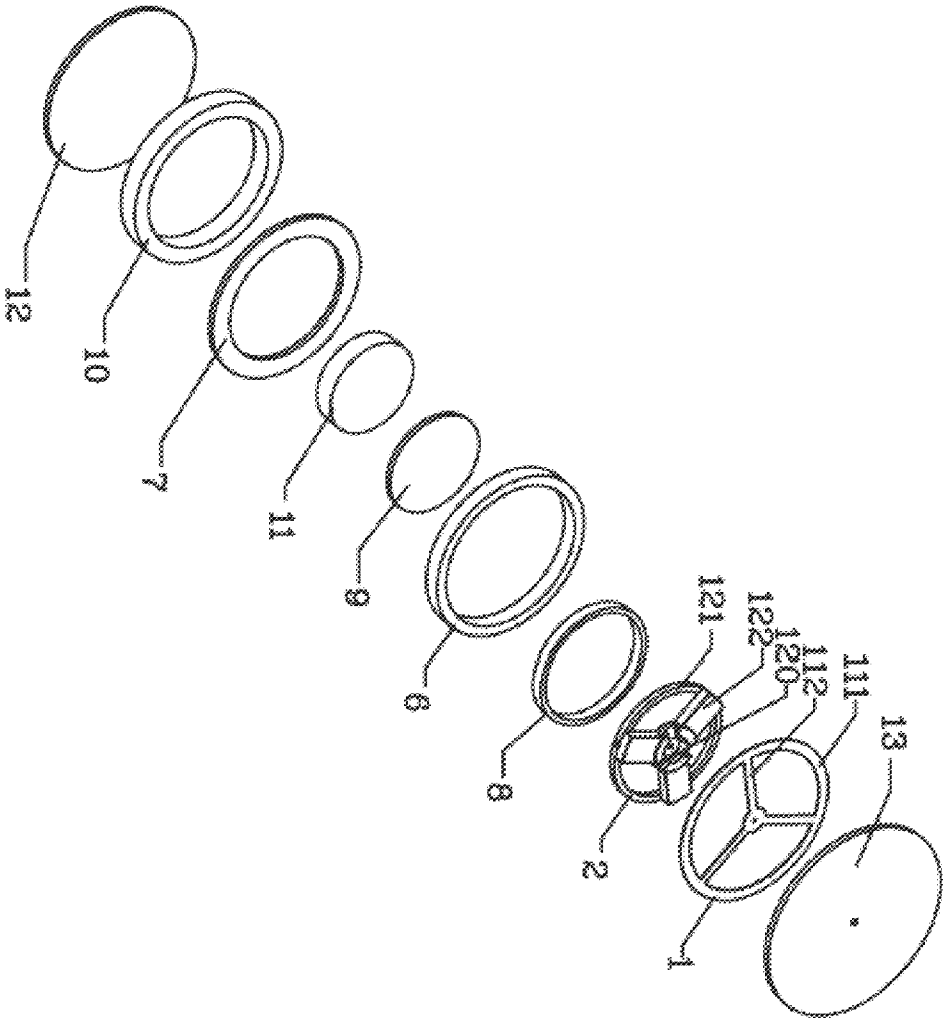
FIG. 3 illustrates an exploded perspective view of the bone conduction speaker in the present disclosure.

As shown in FIG. 1 and FIG. 3, the compound vibration device in the present disclosure of bone conduction speaker, comprises: the compound vibration parts composed of vibration conductive plate 1 and vibration board 2, the vibration conductive plate 1 is set as the first torus 111 and three first rods 112 in the first torus converging to the center of the torus, the converging center is fixed with the center of the vibration board 2. The center of the vibration board 2 is an indentation 120, which matches the converging center and the first rods. The vibration board 2 contains a second torus 121, which has a smaller radius than the vibration conductive plate 1, as well as three second rods 122, which is thicker and wider than the first rods 112. The first rods 112 and the second rods 122 are staggered, present but not limited to an angle of 60 degrees, as shown in FIG. 2. A better solution is, both the first and second rods are all straight rods.

Obviously the number of the first and second rods can be more than two, for example, if there are two rods, they can be set in a symmetrical position; however, the most economic design is working with three rods. Not limited to this rods setting mode, the setting of rods in the present disclosure can also be a spoke structure with four, five or more rods.

The vibration conductive plate 1 is very thin and can be more elastic, which is stuck at the center of the indentation 120 of the vibration board 2. Below the second torus 121 spliced in vibration board 2 is a voice coil 8. The compound vibration device in the present disclosure also comprises a bottom plate 12, where an annular magnet 10 is set, and an inner magnet 11 is set in the annular magnet 10 concentrically. An inner magnet conduction plate 9 is set on the top of the inner magnet 11, while annular magnet conduction plate 7 is set on the annular magnet 10, a grommet 6 is fixed above the annular magnet conduction plate 7, the first torus 111 of the vibration conductive plate 1 is fixed with the grommet 6. The whole compound vibration device is connected to the outside through a panel 13, the panel 13 is fixed with the vibration conductive plate 1 on its converging center, stuck and fixed at the center of both vibration conductive plate 1 and vibration board 2.

It should be noted that, both the vibration conductive plate and the vibration board can be set more than one, fixed with each other through either the center or staggered with both center and edge, forming a multilayer vibration structure, corresponding to different frequency resonance ranges, thus achieve a high tone quality earphone vibration unit with a gamut and full frequency range, despite of the higher cost.

The bone conduction speaker contains a magnet system, composed of the annular magnet conductive plate 7, annular magnet 10, bottom plate 12, inner magnet 11 and inner magnet conductive plate 9, because the changes of audio-frequency current in the voice coil 8 cause changes of magnet field, which makes the voice coil 8 vibrate. The compound vibration device is connected to the magnet system through grommet 6. The bone conduction speaker connects with the outside through the panel 13, being able to transfer vibrations to human bones.

Figure 6:
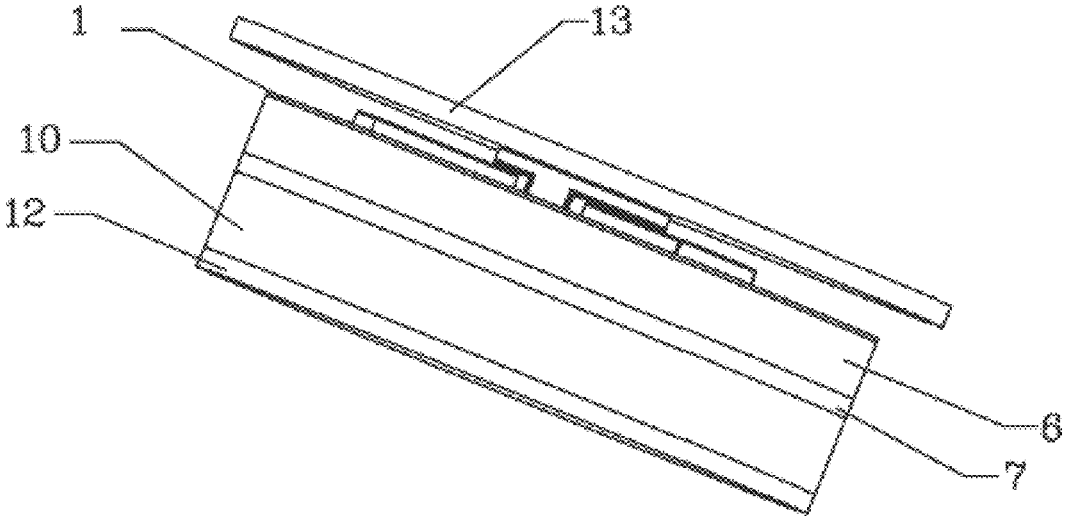
FIG. 6 illustrates a perspective view of the bone conduction speaker in the present disclosure.

In the better implement examples of the present bone conduction speaker and its compound vibration device, the magnet system, composed of the annular magnet conductive plate 7, annular magnet 10, inner magnet conduction plate 9, inner magnet 11 and bottom plate 12, interacts with the voice coil which generates changing magnet field intensity when its current is changing, and inductance changes accordingly, forces the voice coil 8 move longitudinally, then causes the vibration board 2 to vibrate, transfers the vibration to the vibration conductive plate 1, then, through the contact between panel 13 and the post ear, cheeks or forehead of the human beings, transfers the vibrations to human bones, thus generates sounds. A complete product unit is shown in FIG. 6.

Figure 5:
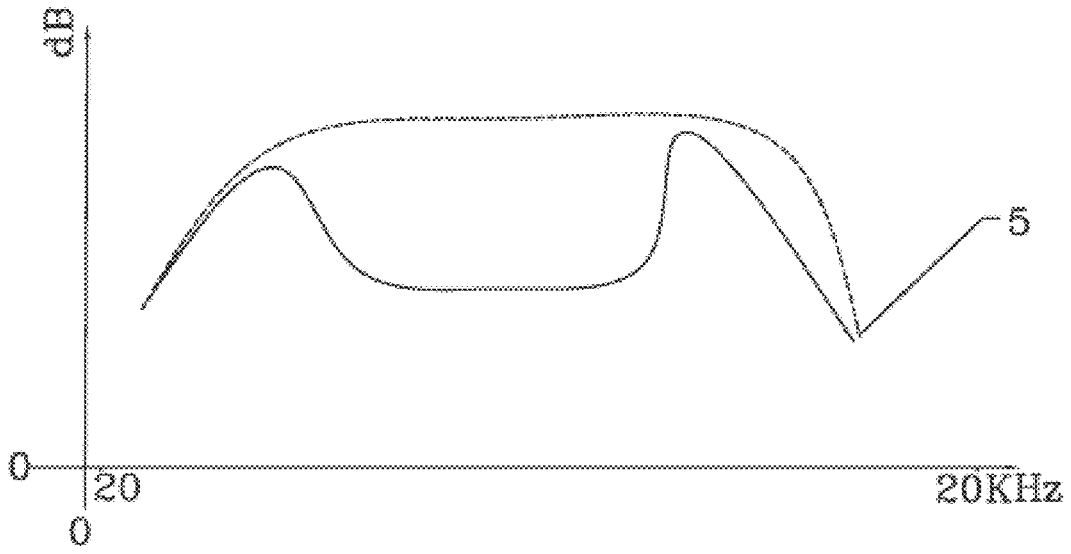
FIG. 5 illustrates a frequency response curves of the bone conduction speakers of the vibration device in the present disclosure.

Through the compound vibration device composed of the vibration board and the vibration conductive plate, a frequency response shown in FIG. 5 is achieved. The double compound vibration generates two resonance peaks, whose positions can be changed by adjusting the parameters including sizes and materials of the two vibration parts, making the resonance peak in low frequency area move to the lower frequency area and the peak in high frequency move higher, finally generates a frequency response curve as the dotted line shown in FIG. 5, which is a flat frequency response curve generated in an ideal condition, whose resonance peaks are among the frequencies catchable with human ears. Thus, the device widens the resonance oscillation ranges, and generates the ideal voices.

In some embodiments, the stiffness of the vibration board may be larger than that of the vibration conductive plate. In some embodiments, the resonance peaks of the frequency response curve may be set within a frequency range perceivable by human ears, or a frequency range that a person's ears may not hear. Preferably, the two resonance peaks may be beyond the frequency range that a person may hear. More preferably, one resonance peak may be within the frequency range perceivable by human ears, and another one may be beyond the frequency range that a person may hear. More preferably, the two resonance peaks may be within the frequency range perceivable by human ears. Further preferably, the two resonance peaks may be within the frequency range perceivable by human ears, and the peak frequency may be in a range of 80 Hz-18000 Hz. Further preferably, the two resonance peaks may be within the frequency range perceivable by human ears, and the peak frequency may be in a range of 200 Hz-15000 Hz. Further preferably, the two resonance peaks may be within the frequency range perceivable by human ears, and the peak frequency may be in a range of 500 Hz-12000 Hz. Further preferably, the two resonance peaks may be within the frequency range perceivable by human ears, and the peak frequency may be in a range of 800 Hz-11000 Hz. There may be a difference between the frequency values of the resonance peaks. For example, the difference between the frequency values of the two resonance peaks may be at least 500 Hz, preferably 1000 Hz, more preferably 2000 Hz, and more preferably 5000 Hz. To achieve a better effect, the two resonance peaks may be within the frequency range perceivable by human ears, and the difference between the frequency values of the two resonance peaks may be at least 500 Hz. Preferably, the two resonance peaks may be within the frequency range perceivable by human ears, and the difference between the frequency values of the two resonance peaks may be at least 1000 Hz. More preferably, the two resonance peaks may be within the frequency range perceivable by human ears, and the difference between the frequency values of the two resonance peaks may be at least 2000 Hz. More preferably, the two resonance peaks may be within the frequency range perceivable by human ears, and the difference between the frequency values of the two resonance peaks may be at least 3000 Hz. Moreover, more preferably, the two resonance peaks may be within the frequency range perceivable by human ears, and the difference between the frequency values of the two resonance peaks may be at least 4000 Hz. One resonance peak may be within the frequency range perceivable by human ears, another one may be beyond the frequency range that a person may hear, and the difference between the frequency values of the two resonance peaks may be at least 500 Hz. Preferably, one resonance peak may be within the frequency range perceivable by human ears, another one may be beyond the frequency range that a person may hear, and the difference between the frequency values of the two resonance peaks may be at least 1000 Hz. More preferably, one resonance peak may be within the frequency range perceivable by human ears, another one may be beyond the frequency range that a person may hear, and the difference between the frequency values of the two resonance peaks may be at least 2000 Hz. More preferably, one resonance peak may be within the frequency range perceivable by human ears, another one may be beyond the frequency range that a person may hear, and the difference between the frequency values of the two resonance peaks may be at least 3000 Hz. Moreover, more preferably, one resonance peak may be within the frequency range perceivable by human ears, another one may be beyond the frequency range that a person may hear, and the difference between the frequency values of the two resonance peaks may be at least 4000 Hz. Both resonance peaks may be within the frequency range of 5 Hz-30000 Hz, and the difference between the frequency values of the two resonance peaks may be at least 400 Hz. Preferably, both resonance peaks may be within the frequency range of 5 Hz-30000 Hz, and the difference between the frequency values of the two resonance peaks may be at least 1000 Hz. More preferably, both resonance peaks may be within the frequency range of 5 Hz-30000 Hz, and the difference between the frequency values of the two resonance peaks may be at least 2000 Hz. More preferably, both resonance peaks may be within the frequency range of 5 Hz-30000 Hz, and the difference between the frequency values of the two resonance peaks may be at least 3000 Hz. Moreover, further preferably, both resonance peaks may be within the frequency range of 5 Hz-30000 Hz, and the difference between the frequency values of the two resonance peaks may be at least 4000 Hz. Both resonance peaks may be within the frequency range of 20 Hz-20000 Hz, and the difference between the frequency values of the two resonance peaks may be at least 400 Hz. Preferably, both resonance peaks may be within the frequency range of 20 Hz-20000 Hz, and the difference between the frequency values of the two resonance peaks may be at least 1000 Hz. More preferably, both resonance peaks may be within the frequency range of 20 Hz-20000 Hz, and the difference between the frequency values of the two resonance peaks may be at least 2000 Hz. More preferably, both resonance peaks may be within the frequency range of 20 Hz-20000 Hz, and the difference between the frequency values of the two resonance peaks may be at least 3000 Hz. And further preferably, both resonance peaks may be within the frequency range of 20 Hz-20000 Hz, and the difference between the frequency values of the two resonance peaks may be at least 4000 Hz. Both the two resonance peaks may be within the frequency range of 100 Hz-18000 Hz, and the difference between the frequency values of the two resonance peaks may be at least 400 Hz. Preferably, both resonance peaks may be within the frequency range of 100 Hz-18000 Hz, and the difference between the frequency values of the two resonance peaks may be at least 1000 Hz. More preferably, both resonance peaks may be within the frequency range of 100 Hz-18000 Hz, and the difference between the frequency values of the two resonance peaks may be at least 2000 Hz. More preferably, both resonance peaks may be within the frequency range of 100 Hz-18000 Hz, and the difference between the frequency values of the two resonance peaks may be at least 3000 Hz. And further preferably, both resonance peaks may be within the frequency range of 100 Hz-18000 Hz, and the difference between the frequency values of the two resonance peaks may be at least 4000 Hz. Both the two resonance peaks may be within the frequency range of 200 Hz-12000 Hz, and the difference between the frequency values of the two resonance peaks may be at least 400 Hz. Preferably, both resonance peaks may be within the frequency range of 200 Hz-12000 Hz, and the difference between the frequency values of the two resonance peaks may be at least 1000 Hz. More preferably, both resonance peaks may be within the frequency range of 200 Hz-12000 Hz, and the difference between the frequency values of the two resonance peaks may be at least 2000 Hz. More preferably, both resonance peaks may be within the frequency range of 200 Hz-12000 Hz, and the difference between the frequency values of the two resonance peaks may be at least 3000 Hz. And further preferably, both resonance peaks may be within the frequency range of 200 Hz-12000 Hz, and the difference between the frequency values of the two resonance peaks may be at least 4000 Hz. Both the two resonance peaks may be within the frequency range of 500 Hz-10000 Hz, and the difference between the frequency values of the two resonance peaks may be at least 400 Hz. Preferably, both resonance peaks may be within the frequency range of 500 Hz-10000 Hz, and the difference between the frequency values of the two resonance peaks may be at least 1000 Hz. More preferably, both resonance peaks may be within the frequency range of 500 Hz-10000 Hz, and the difference between the frequency values of the two resonance peaks may be at least 2000 Hz. More preferably, both resonance peaks may be within the frequency range of 500 Hz-10000 Hz, and the difference between the frequency values of the two resonance peaks may be at least 3000 Hz. And further preferably, both resonance peaks may be within the frequency range of 500 Hz-10000 Hz, and the difference between the frequency values of the two resonance peaks may be at least 4000 Hz. This may broaden the range of the resonance response of the speaker, thus obtaining a more ideal sound quality. It should be noted that in actual applications, there may be multiple vibration conductive plates and vibration boards to form multi-layer vibration structures corresponding to different ranges of frequency response, thus obtaining diatonic, full-ranged and high-quality vibrations of the speaker, or may make the frequency response curve meet requirements in a specific frequency range. For example, to satisfy the requirement of normal hearing, a bone conduction hearing aid may be configured to have a transducer including one or more vibration boards and vibration conductive plates with a resonance frequency in a range of 100 Hz-10000 Hz.

In the better implement examples, but, not limited to these examples, it is adopted that, the vibration conductive plate can be made by stainless steels, with a thickness of 0.1-0.2 mm, and when the middle three rods of the first rods group in the vibration conductive plate have a width of 0.5-1.0 mm, the low frequency resonance oscillation peak of the bone conduction speaker is located between 300 and 900 Hz. And, when the three straight rods in the second rods group have a width between 1.6 and 2.6 mm, and a thickness between 0.8 and 1.2 mm, the high frequency resonance oscillation peak of the bone conduction speaker is between 7500 and 9500 Hz. Also, the structures of the vibration conductive plate and the vibration board is not limited to three straight rods, as long as their structures can make a suitable flexibility to both vibration conductive plate and vibration board, cross-shaped rods and other rod structures are also suitable. Of course, with more compound vibration parts, more resonance oscillation peaks will be achieved, and the fitting curve will be flatter and the sound wider. Thus, in the better implement examples, more than two vibration parts, including the vibration conductive plate and vibration board as well as similar parts, overlapping each other, is also applicable, just needs more costs.

Figure 7:
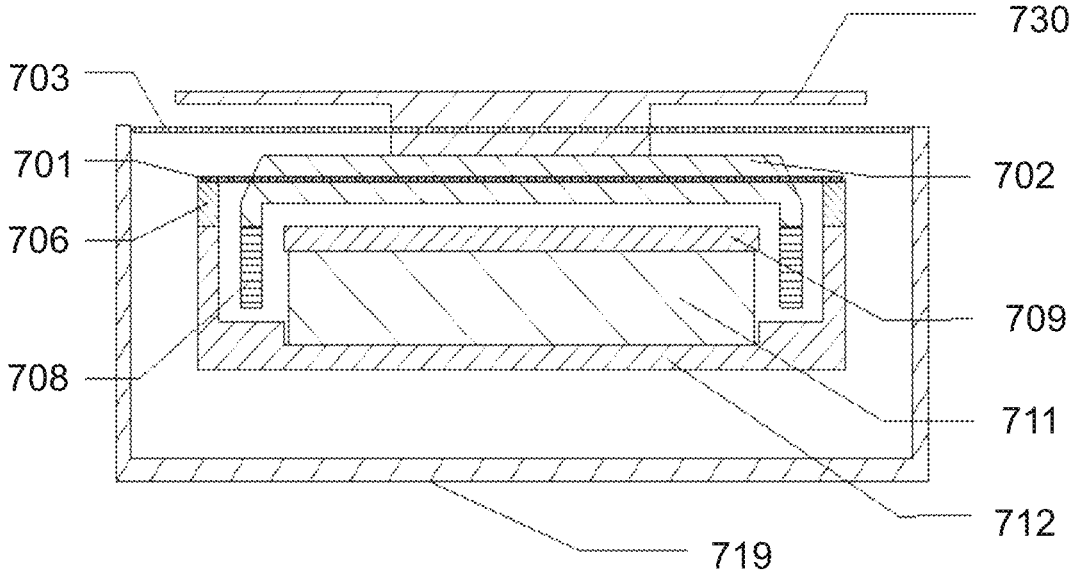
FIG. 7 illustrates a structure of the bone conduction speaker and the compound vibration device according to some embodiments of the present disclosure.

As shown in FIG. 7, in another embodiment, the compound vibration device (also referred to as "compound vibration system") may include a vibration board 702, a first vibration conductive plate 703, and a second vibration conductive plate 701. The first vibration conductive plate 703 may fix the vibration board 702 and the second vibration conductive plate 701 onto a housing 719. The compound vibration system including the vibration board 702, the first vibration conductive plate 703, and the second vibration conductive plate 701 may lead to no less than two resonance peaks and a smoother frequency response curve in the range of the auditory system, thus improving the sound quality of the bone conduction speaker. The equivalent model of the compound vibration system may be shown in FIG. 8-A:

For illustration purposes, 801 represents a housing, 802 represents a panel, 803 represents a voice coil, 804 represents a magnetic circuit system, 805 represents a first vibration conductive plate, 806 represents a second vibration conductive plate, and 807 represents a vibration board. The first vibration conductive plate, the second vibration conductive plate, and the vibration board may be abstracted as components with elasticity and damping; the housing, the panel, the voice coil and the magnetic circuit system may be abstracted as equivalent mass blocks. The vibration equation of the system may be expressed as:

$$m_6x_6''+R_6(x_6-x_5)'+k_6(x_6-x_5)=F, \tag{1}$$

$$x_7''+R_7(x_7-x_5)'+k_7(x_7-x_5)=-F, \tag{2}$$

$$m_5x_5''-R_6(x_6-x_5)'-R_7(x_7-x_5)'+R_8x_5+k_8x_5-k_6(x_6-x_5)-k_7(x_7-x_5)=0, \tag{3}$$

wherein, F is a driving force, $k_6$ is an equivalent stiffness coefficient of the second vibration conductive plate, $k_7$ is an equivalent stiffness coefficient of the vibration board, $k_8$ is an equivalent stiffness coefficient of the first vibration conductive plate, $R_6$ is an equivalent damping of the second vibration conductive plate, $R_7$ is an equivalent damping of the vibration board, $R_8$ is an equivalent damp of the first vibration conductive plate, $m_5$ is a mass of the panel, $m_6$ is a mass of the magnetic circuit system, $m_7$ is a mass of the voice coil, $x_5$ is a displacement of the panel, $x_6$ is a displacement of the magnetic circuit system, $x_7$ is ta displacement of the voice coil, and the amplitude of the panel 802 may be:

$$A_5=\frac{(-m_6\omega^2(jR_7\omega-k_7)+m_7\omega^2(jR_6\omega-k_6))}{\left(\begin{array}{c}(-m_5\omega^2-jR_8\omega+k_8)\\(-m_6\omega^2-jR_6\omega+k_6)(-m_7\omega^2-jR_7\omega+k_7)-\\m_6\omega^2(-jR_6\omega+k_6)(-m_7\omega^2-jR_7\omega+k_7)-\\m_7\omega^2(-jR_7\omega+k_7)(-m_6\omega^2-jR_6\omega+k_6)\end{array}\right)}f_0, \tag{4}$$

wherein ω is an angular frequency of the vibration, and $f_0$ is a unit driving force.

The vibration system of the bone conduction speaker may transfer vibrations to a user via a panel (e.g., the panel 730 shown in FIG. 7). According to the equation (4), the vibration efficiency may relate to the stiffness coefficients of the vibration board, the first vibration conductive plate, and the second vibration conductive plate, and the vibration damping. Preferably, the stiffness coefficient of the vibration board $k_7$ may be greater than the second vibration coefficient $k_6$, and the stiffness coefficient of the vibration board $k_7$ may be greater than the first vibration factor $k_8$. The number of resonance peaks generated by the compound vibration system with the first vibration conductive plate may be more than the compound vibration system without the first vibration conductive plate, preferably at least three resonance peaks. More preferably, at least one resonance peak may be beyond the range perceivable by human ears. More preferably, the resonance peaks may be within the range perceivable by human ears. More further preferably, the resonance peaks may be within the range perceivable by human ears, and the frequency peak value may be no more than 18000 Hz. More preferably, the resonance peaks may be within the range perceivable by human ears, and the frequency peak value may be within the frequency range of 100 Hz-15000 Hz. More preferably, the resonance peaks may be within the range perceivable by human ears, and the frequency peak value may be within the frequency range of 200 Hz-12000 Hz. More preferably, the resonance peaks may be within the range perceivable by human ears, and the frequency peak value may be within the frequency range of 500 Hz-11000 Hz. There may be differences between the frequency values of the resonance peaks. For example, there may be at least two resonance peaks with a difference of the frequency values between the two resonance peaks no less than 200 Hz. Preferably, there may be at least two resonance peaks with a difference of the frequency values between the two resonance peaks no less than 500 Hz. More preferably, there may be at least two resonance peaks with a difference of the frequency values between the two resonance peaks no less than 1000 Hz. More preferably, there may be at least two resonance peaks with a difference of the frequency values between the two resonance peaks no less than 2000 Hz. More preferably, there may be at least two resonance peaks with a difference of the frequency values between the two resonance peaks no less than 5000 Hz. To achieve a better effect, all of the resonance peaks may be within the range perceivable by human ears, and there may be at least two resonance peaks with a difference of the frequency values between the two resonance peaks no less than 500 Hz. Preferably, all of the resonance peaks may be within the range perceivable by human ears, and there may be at least two resonance peaks with a difference of the frequency values between the two resonance peaks no less than 1000 Hz. More preferably, all of the resonance peaks may be within the range perceivable by human ears, and there may be at least two resonance peaks with a difference of the frequency values between the two resonance peaks no less than 2000 Hz. More preferably, all of the resonance peaks may be within the range perceivable by human ears, and there may be at least two resonance peaks with a difference of the frequency values between the two resonance peaks no less than 3000 Hz. More preferably, all of the resonance peaks may be within the range perceivable by human ears, and there may be at least two resonance peaks with a difference of the frequency values between the two resonance peaks no less than 4000 Hz. Two of the three resonance peaks may be within the frequency range perceivable by human ears, and another one may be beyond the frequency range that a person may hear, and there may be at least two resonance peaks with a difference of the frequency values between the two resonance peaks no less than 500 Hz. Preferably, two of the three resonance peaks may be within the frequency range perceivable by human ears, and another one may be beyond the frequency range that a person may hear, and there may be at least two resonance peaks with a difference of the frequency values between the two resonance peaks no less than 1000 Hz. More preferably, two of the three resonance peaks may be within the frequency range perceivable by human ears, and another one may be beyond the frequency range that a person may hear, and there may be at least two resonance peaks with a difference of the frequency values between the two resonance peaks no less than 2000 Hz. More preferably, two of the three resonance peaks may be within the frequency range perceivable by human ears, and another one may be beyond the frequency range that a person may hear, and there may be at least two resonance peaks with a difference of the frequency values between the two resonance peaks no less than 3000 Hz. More preferably, two of the three resonance peaks may be within the frequency range perceivable by human ears, and another one may be beyond the frequency range that a person may hear, and there may be at least two resonance peaks with a difference of the frequency values between the two resonance peaks no less than 4000 Hz. One of the three resonance peaks may be within the frequency range perceivable by human ears, and the other two may be beyond the frequency range that a person may hear, and there may be at least two resonance peaks with a difference of the frequency values between the two resonance peaks no less than 500 Hz. Preferably, one of the three resonance peaks may be within the frequency range perceivable by human ears, and the other two may be beyond the frequency range that a person may hear, and there may be at least two resonance peaks with a difference of the frequency values between the two resonance peaks no less than 1000 Hz. More preferably, one of the three resonance peaks may be within the frequency range perceivable by human ears, and the other two may be beyond the frequency range that a person may hear, and there may be at least two resonance peaks with a difference of the frequency values between the two resonance peaks no less than 2000 Hz. More preferably, one of the three resonance peaks may be within the frequency range perceivable by human ears, and the other two may be beyond the frequency range that a person may hear, and there may be at least two resonance peaks with a difference of the frequency values between the two resonance peaks no less than 3000 Hz. More preferably, one of the three resonance peaks may be within the frequency range perceivable by human ears, and the other two may be beyond the frequency range that a person may hear, and there may be at least two resonance peaks with a difference of the frequency values between the two resonance peaks no less than 4000 Hz. All the resonance peaks may be within the frequency range of 5 Hz-30000 Hz, and there may be at least two resonance peaks with a difference of the frequency values between the two resonance peaks of at least 400 Hz. Preferably, all the resonance peaks may be within the frequency range of 5 Hz-30000 Hz, and there may be at least two resonance peaks with a difference of the frequency values between the two resonance peaks of at least 1000 Hz. More preferably, all the resonance peaks may be within the frequency range of 5 Hz-30000 Hz, and there may be at least two resonance peaks with a difference of the frequency values between the two resonance peaks of at least 2000 Hz. More preferably, all the resonance peaks may be within the frequency range of 5 Hz-30000 Hz, and there may be at least two resonance peaks with a difference of the frequency values between the two resonance peaks of at least 3000 Hz. And further preferably, all the resonance peaks may be within the frequency range of 5 Hz-30000 Hz, and there may be at least two resonance peaks with a difference of the frequency values between the two resonance peaks of at least 4000 Hz. All the resonance peaks may be within the frequency range of 20 Hz-20000 Hz, and there may be at least two resonance peaks with a difference of the frequency values between the two resonance peaks of at least 400 Hz. Preferably, all the resonance peaks may be within the frequency range of 20 Hz-20000 Hz, and there may be at least two resonance peaks with a difference of the frequency values between the two resonance peaks of at least 1000 Hz. More preferably, all the resonance peaks may be within the frequency range of 20 Hz-20000 Hz, and there may be at least two resonance peaks with a difference of the frequency values between the two resonance peaks of at least 2000 Hz. More preferably, all the resonance peaks may be within the frequency range of 20 Hz-20000 Hz, and there may be at least two resonance peaks with a difference of the frequency values between the two resonance peaks of at least 3000 Hz. And further preferably, all the resonance peaks may be within the frequency range of 20 Hz-20000 Hz, and there may be at least two resonance peaks with a difference of the frequency values between the two resonance peaks of at least 4000 Hz. All the resonance peaks may be within the frequency range of 100 Hz-18000 Hz, and there may be at least two resonance peaks with a difference of the frequency values between the two resonance peaks of at least 400 Hz. Preferably, all the resonance peaks may be within the frequency range of 100 Hz-18000 Hz, and there may be at least two resonance peaks with a difference of the frequency values between the two resonance peaks of at least 1000 Hz. More preferably, all the resonance peaks may be within the frequency range of 100 Hz-18000 Hz, and there may be at least two resonance peaks with a difference of the frequency values between the two resonance peaks of at least 2000 Hz. More preferably, all the resonance peaks may be within the frequency range of 100 Hz-18000 Hz, and there may be at least two resonance peaks with a difference of the frequency values between the two resonance peaks of at least 3000 Hz. And further preferably, all the resonance peaks may be within the frequency range of 100 Hz-18000 Hz, and there may be at least two resonance peaks with a difference of the frequency values between the two resonance peaks of at least 4000 Hz. All the resonance peaks may be within the frequency range of 200 Hz-12000 Hz, and there may be at least two resonance peaks with a difference of the frequency values between the two resonance peaks of at least 400 Hz. Preferably, all the resonance peaks may be within the frequency range of 200 Hz-12000 Hz, and there may be at least two resonance peaks with a difference of the frequency values between the two resonance peaks of at least 1000 Hz. More preferably, all the resonance peaks may be within the frequency range of 200 Hz-12000 Hz, and there may be at least two resonance peaks with a difference of the frequency values between the two resonance peaks of at least 2000 Hz. More preferably, all the resonance peaks may be within the frequency range of 200 Hz-12000 Hz, and there may be at least two resonance peaks with a difference of the frequency values between the two resonance peaks of at least 3000 Hz. And further preferably, all the resonance peaks may be within the frequency range of 200 Hz-12000 Hz, and there may be at least two resonance peaks with a difference of the frequency values between the two resonance peaks of at least 4000 Hz. All the resonance peaks may be within the frequency range of 500 Hz-10000 Hz, and there may be at least two resonance peaks with a difference of the frequency values between the two resonance peaks of at least 400 Hz. Preferably, all the resonance peaks may be within the frequency range of 500 Hz-10000 Hz, and there may be at least two resonance peaks with a difference of the frequency values between the two resonance peaks of at least 1000 Hz. More preferably, all the resonance peaks may be within the frequency range of 500 Hz-10000 Hz, and there may be at least two resonance peaks with a difference of the frequency values between the two resonance peaks of at least 2000 Hz. More preferably, all the resonance peaks may be within the frequency range of 500 Hz-10000 Hz, and there may be at least two resonance peaks with a difference of the frequency values between the two resonance peaks of at least 3000 Hz. Moreover, further preferably, all the resonance peaks may be within the frequency range of 500 Hz-10000 Hz, and there may be at least two resonance peaks with a difference of the frequency values between the two resonance peaks of at least 4000 Hz. In one embodiment, the compound vibration system including the vibration board, the first vibration conductive plate, and the second vibration conductive plate may generate a frequency response as shown in FIG. 8-B. The compound vibration system with the first vibration conductive plate may generate three obvious resonance peaks, which may improve the sensitivity of the frequency response in the low-frequency range (about 600 Hz), obtain a smoother frequency response, and improve the sound quality.

The resonance peak may be shifted by changing a parameter of the first vibration conductive plate, such as the size and material, so as to obtain an ideal frequency response eventually. For example, the stiffness coefficient of the first vibration conductive plate may be reduced to a designed value, causing the resonance peak to move to a designed low frequency, thus enhancing the sensitivity of the bone conduction speaker in the low frequency, and improving the quality of the sound. As shown in FIG. 8-C, as the stiffness coefficient of the first vibration conductive plate decreases (i.e., the first vibration conductive plate becomes softer), the resonance peak moves to the low frequency region, and the sensitivity of the frequency response of the bone conduction speaker in the low frequency region gets improved. Preferably, the first vibration conductive plate may be an elastic plate, and the elasticity may be determined based on the material, thickness, structure, or the like. The material of the first vibration conductive plate may include but not limited to steel (for example but not limited to, stainless steel, carbon steel, etc.), light alloy (for example but not limited to, aluminum, beryllium copper, magnesium alloy, titanium alloy, etc.), plastic (for example but not limited to, polyethylene, nylon blow molding, plastic, etc.). It may be a single material or a composite material that achieve the same performance. The composite material may include but not limited to reinforced material, such as glass fiber, carbon fiber, boron fiber, graphite fiber, graphene fiber, silicon carbide fiber, aramid fiber, or the like. The composite material may also be other organic and/or inorganic composite materials, such as various types of glass fiber reinforced by unsaturated polyester and epoxy, fiberglass comprising phenolic resin matrix. The thickness of the first vibration conductive plate may be not less than 0.005 mm. Preferably, the thickness may be 0.005 mm-3 mm. More preferably, the thickness may be 0.01 mm-2 mm. More preferably, the thickness may be 0.01 mm-1 mm. Moreover, further preferably, the thickness may be 0.02 mm-0.5 mm. The first vibration conductive plate may have an annular structure, preferably including at least one annular ring, preferably, including at least two annular rings. The annular ring may be a concentric ring or a non-concentric ring and may be connected to each other via at least two rods converging from the outer ring to the center of the inner ring. More preferably, there may be at least one oval ring. More preferably, there may be at least two oval rings. Different oval rings may have different curvatures radiuses, and the oval rings may be connected to each other via rods. Further preferably, there may be at least one square ring. The first vibration conductive plate may also have the shape of a plate. Preferably, a hollow pattern may be configured on the plate. Moreover, more preferably, the area of the hollow pattern may be not less than the area of the non-hollow portion. It should be noted that the above-described material, structure, or thickness may be combined in any manner to obtain different vibration conductive plates. For example, the annular vibration conductive plate may have a different thickness distribution. Preferably, the thickness of the ring may be equal to the thickness of the rod. Further preferably, the thickness of the rod may be larger than the thickness of the ring. Moreover, still, further preferably, the thickness of the inner ring may be larger than the thickness of the outer ring.

When the compound vibration device is applied to the bone conduction speaker, the major applicable area is bone conduction earphones. Thus the bone conduction speaker adopting the structure will be fallen into the protection of the present disclosure.

The bone conduction speaker and its compound vibration device stated in the present disclosure, make the technique simpler with a lower cost. Because the two parts in the compound vibration device can adjust the low frequency as well as the high frequency ranges, as shown in FIG. 5, which makes the achieved frequency response flatter, and voice more broader, avoiding the problem of abrupt frequency response and feeble voices caused by single vibration device, thus broaden the application prospection of bone conduction speaker.

Figure 4:
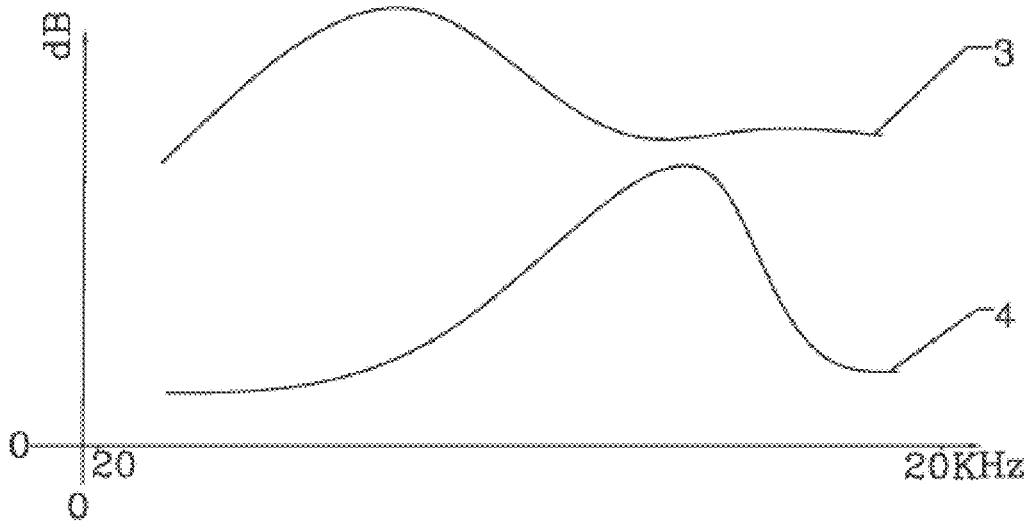
FIG. 4 illustrates a frequency response curves of the bone conduction speakers of vibration device in the prior art.

In the prior art, the vibration parts did not take full account of the effects of every part to the frequency response, thus, although they could have the similar outlooks with the products described in the present disclosure, they will generate an abrupt frequency response, or feeble sound. And due to the improper matching between different parts, the resonance peak could have exceeded the human hearable range, which is between 20 Hz and 20 KHz. Thus, only one sharp resonance peak as shown in FIG. 4 appears, which means a pretty poor tone quality.

It should be made clear that, the above detailed description of the better implement examples should not be considered as the limitations to the present disclosure protections. The extent of the patent protection of the present disclosure should be determined by the terms of claims.

EXAMPLES

Example 1

A bone conduction speaker may include a U-shaped headset bracket/headset lanyard, two vibration units, a transducer connected to each vibration unit. The vibration unit may include a contact surface and a housing. The contact surface may be an outer surface of a silicone rubber transfer layer and may be configured to have a gradient structure including a convex portion. A clamping force between the contact surface and skin due to the headset bracket/headset lanyard may be unevenly distributed on the contact surface. The sound transfer efficiency of the portion of the gradient structure may be different from the portion without the gradient structure.

Example 2

This example may be different from Example 1 in the following aspects. The headset bracket/headset lanyard as described may include a memory alloy. The headset bracket/headset lanyard may match the curves of different users' heads and have a good elasticity and a better wearing comfort. The headset bracket/headset lanyard may recover to its original shape from a deformed status last for a certain period. As used herein, the certain period may refer to ten minutes, thirty minutes, one hour, two hours, five hours, or may also refer to one day, two days, ten days, one month, one year, or a longer period. The clamping force that the headset bracket/headset lanyard provides may keep stable, and may not decline gradually over time. The force intensity between the bone conduction speaker and the body surface of a user may be within an appropriate range, so as to avoid pain or clear vibration sense caused by undue force when the user wears the bone conduction speaker. Moreover, the clamping force of bone conduction speaker may be within a range of 0.2N~1.5N when the bone conduction speaker is used.

Example 3

The difference between this example and the two examples mentioned above may include the following aspects. The elastic coefficient of the headset bracket/headset lanyard may be kept in a specific range, which results in the value of the frequency response curve in low frequency (e.g., under 500 Hz) being higher than the value of the frequency response curve in high frequency (e.g., above 4000 Hz).

Example 4

The difference between Example 4 and Example 1 may include the following aspects. The bone conduction speaker may be mounted on an eyeglass frame, or in a helmet or mask with a special function.

Example 5

The difference between this example and Example 1 may include the following aspects. The vibration unit may include two or more panels, and the different panels or the vibration transfer layers connected to the different panels may have different gradient structures on a contact surface being in contact with a user. For example, one contact surface may have a convex portion, the other one may have a concave structure, or the gradient structures on both the two contact surfaces may be convex portions or concave structures, but there may be at least one difference between the shape or the number of the convex portions.

Example 6

A portable bone conduction hearing aid may include multiple frequency response curves. A user or a tester may choose a proper response curve for hearing compensation according to an actual response curve of the auditory system of a person. In addition, according to an actual requirement, a vibration unit in the bone conduction hearing aid may enable the bone conduction hearing aid to generate an ideal frequency response in a specific frequency range, such as 500 Hz-4000 Hz.

Example 7

A vibration generation portion of a bone conduction speaker may be shown in FIG. 9-A. A transducer of the bone conduction speaker may include a magnetic circuit system including a magnetic flux conduction plate 910, a magnet 911 and a magnetizer 912, a vibration board 914, a coil 915, a first vibration conductive plate 916, and a second vibration conductive plate 917. The panel 913 may protrude out of the housing 919 and may be connected to the vibration board 914 by glue. The transducer may be fixed to the housing 919 via the first vibration conductive plate 916 forming a suspended structure.

A compound vibration system including the vibration board 914, the first vibration conductive plate 916, and the second vibration conductive plate 917 may generate a smoother frequency response curve, so as to improve the sound quality of the bone conduction speaker. The transducer may be fixed to the housing 919 via the first vibration conductive plate 916 to reduce the vibration that the transducer is transferring to the housing, thus effectively decreasing sound leakage caused by the vibration of the housing, and reducing the effect of the vibration of the housing on the sound quality. FIG. 9-B shows frequency response curves of the vibration intensities of the housing of the vibration generation portion and the panel. The bold line refers to the frequency response of the vibration generation portion including the first vibration conductive plate 916, and the thin line refers to the frequency response of the vibration generation portion without the first vibration conductive plate 916. As shown in FIG. 9-B, the vibration intensity of the housing of the bone conduction speaker without the first vibration conductive plate may be larger than that of the bone conduction speaker with the first vibration conductive plate when the frequency is higher than 500 Hz. FIG. 9-C shows a comparison of the sound leakage between a bone conduction speaker includes the first vibration conductive plate 916 and another bone conduction speaker does not include the first vibration conductive plate 916. The sound leakage when the bone conduction speaker includes the first vibration conductive plate may be smaller than the sound leakage when the bone conduction speaker does not include the first vibration conductive plate in the intermediate frequency range (for example, about 1000 Hz). It can be concluded that the use of the first vibration conductive plate between the panel and the housing may effectively reduce the vibration of the housing, thereby reducing the sound leakage.

The first vibration conductive plate may be made of the material, for example but not limited to stainless steel, copper, plastic, polycarbonate, or the like, and the thickness may be in a range of 0.01 mm-1 mm.

Example 8

Figure 10:
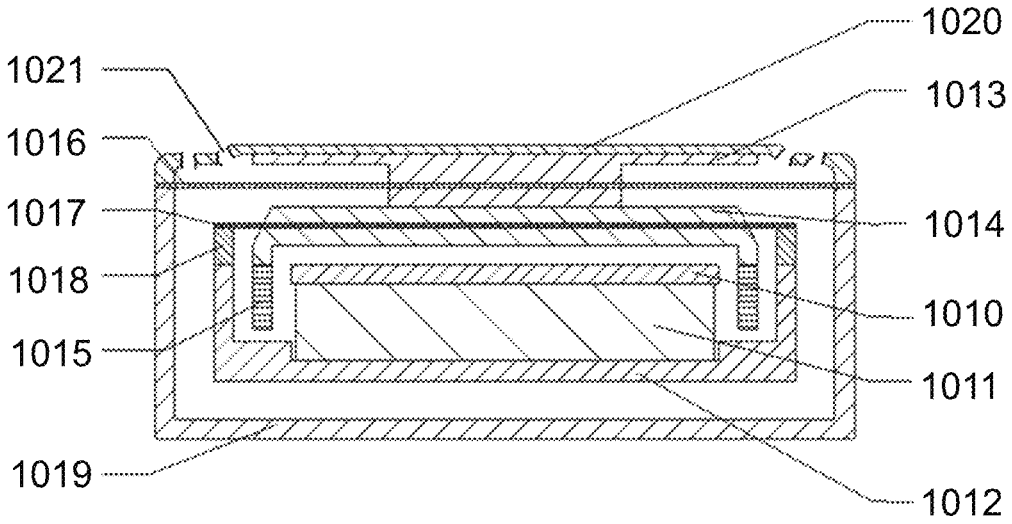
FIG. 10 illustrates a structure of the vibration generation portion of the bone conduction speaker according to one specific embodiment of the present disclosure.

This example may be different with Example 7 in the following aspects. As shown in FIG. 10, the panel 1013 may be configured to have a vibration transfer layer 1020 (for example but not limited to, silicone rubber) to produce a certain deformation to match a user's skin. A contact portion being in contact with the panel 1013 on the vibration transfer layer 1020 may be higher than a portion not being in contact with the panel 1013 on the vibration transfer layer 1020 to form a step structure. The portion not being in contact with the panel 1013 on the vibration transfer layer 1020 may be configured to have one or more holes 1021. The holes on the vibration transfer layer may reduce the sound leakage: the connection between the panel 1013 and the housing 1019 via the vibration transfer layer 1020 may be weakened, and vibration transferred from panel 1013 to the housing 1019 via the vibration transfer layer 1020 may be reduced, thereby reducing the sound leakage caused by the vibration of the housing; the area of the vibration transfer layer 1020 configured to have holes on the portion without protrusion may be reduced, thereby reducing air and sound leakage caused by the vibration of the air; the vibration of air in the housing may be guided out, interfering with the vibration of air caused by the housing 1019, thereby reducing the sound leakage.

Example 9

The difference between this example and Example 7 may include the following aspects. As the panel may protrude out of the housing, meanwhile, the panel may be connected to the housing via the first vibration conductive plate, the degree of coupling between the panel and the housing may be dramatically reduced, and the panel may be in contact with a user with a higher freedom to adapt complex contact surfaces (as shown in the right figure of FIG. 11-A) as the first vibration conductive plate provides a certain amount of deformation. The first vibration conductive plate may incline the panel relative to the housing with a certain angle. Preferably, the slope angle may not exceed 5 degrees.

The vibration efficiency may differ with contacting statuses. A better contacting status may lead to a higher vibration transfer efficiency. As shown in FIG. 11-B, the bold line shows the vibration transfer efficiency with a better contacting status, and the thin line shows a worse contacting status. It may be concluded that the better contacting status may correspond to a higher vibration transfer efficiency.

Example 10

Figure 12:
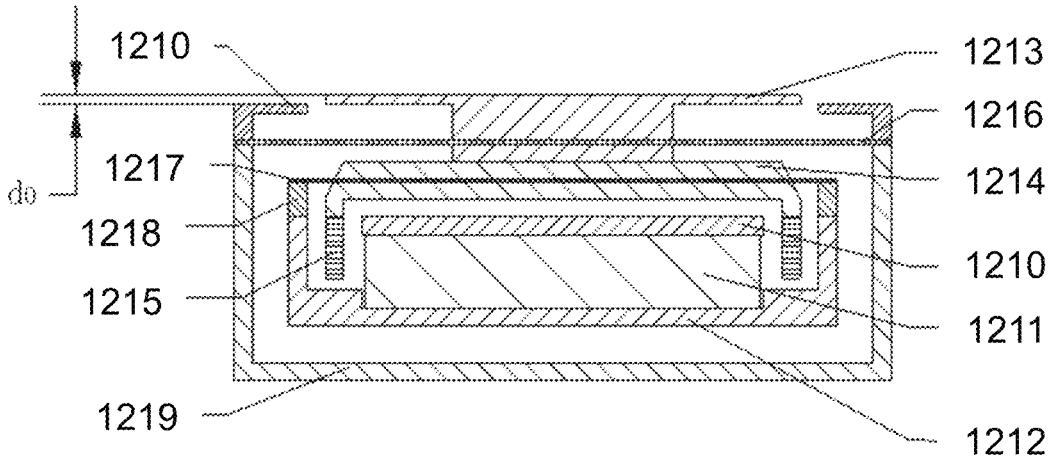
FIG. 12 illustrates a structure of the vibration generation portion of the bone conduction speaker according to one specific embodiment of the present disclosure.

The difference between this example and Example 7 may include the following aspects. A boarder may be added to surround the housing. When the housing contact with a user's skin, the surrounding boarder may facilitate an even distribution of an applied force, and improve the user's wearing comfort. As shown in FIG. 12, there may be a height difference do between the surrounding border 1210 and the panel 1213. The force from the skin to the panel 1213 may decrease the distance d between the panel 1213 and the surrounding border 1210. When the force between the bone conduction speaker and the user is larger than the force applied to the first vibration conductive plate with a deformation of do, the extra force may be transferred to the user's skin via the surrounding border 1210, without influencing the clamping force of the vibration portion, with the consistency of the clamping force improved, thereby ensuring the sound quality.

Example 11

Figure 13:
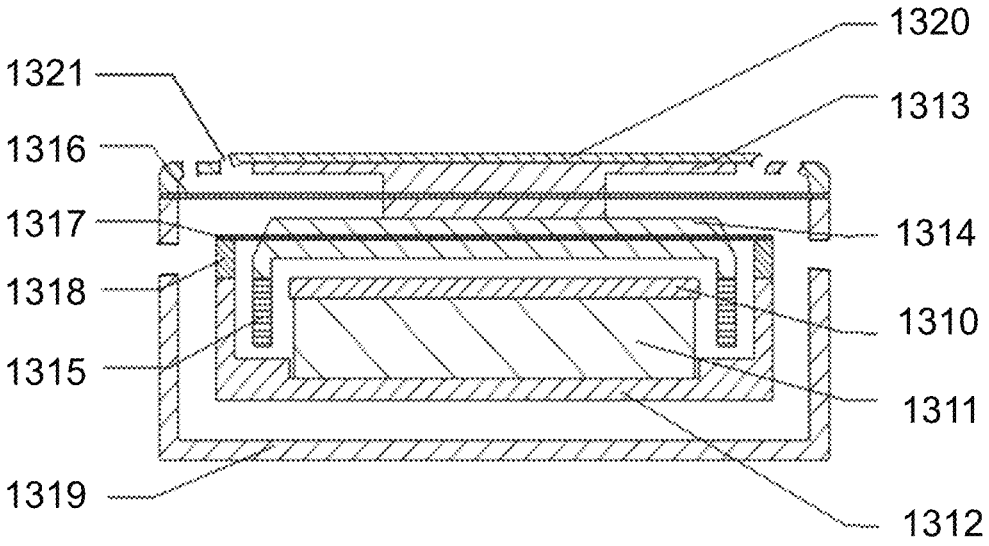
FIG. 13 illustrates a structure of the vibration generation portion of the bone conduction speaker according to one specific embodiment of the present disclosure.

The difference between this example and Example 8 may include the following aspects. As shown in FIG. 13, sound guiding holes are located at the vibration transfer layer 1320 and the housing 1319, respectively. The acoustic wave formed by the vibration of the air in the housing is guided to the outside of the housing, and interferes with the leaked acoustic wave due to the vibration of the air out of the housing, thus reducing the sound leakage.

In some embodiments, a speaker (e.g., a bone conduction speaker or an air conduction speaker) as described elsewhere in the present disclosure may have a communication function through which the user may communicate with others. For example, the speaker may include a microphone configured to collect sound signals (e.g., the user's voice). The user may make a call using the speaker and communicate with others via the microphone. In some embodiments, noises (vibrations of a housing of the speaker, noises in the surrounding environment, etc.) may be collected by the microphones, which may cause echoes or other interferences during the communication. In some embodiments, the speaker may include a noise removal component (e.g., a dual-microphone component) configured to remove the noises.

Figure 14:
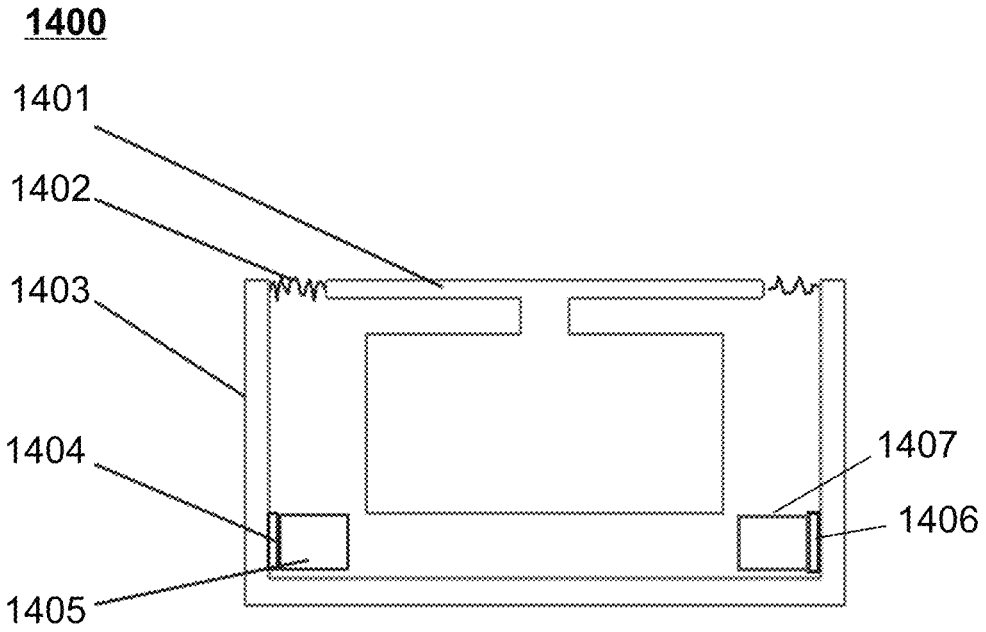
FIG. 14 is a schematic diagram illustrating a structure of a dual-microphone speaker according to some embodiments of the present disclosure.

FIG. 14 is a schematic diagram illustrating a structure of a speaker 1400 according to some embodiments of the present disclosure. The speaker 1400 may include a vibration device 1401 (e.g., the compound vibration device described elsewhere in the present disclosure), an elastic structure 1402 (e.g., the vibration conductive plate as described elsewhere in the present disclosure), a housing 1403, a first connecting structure 1404, a microphone 1405, a second connecting structure 1406, and a vibration sensor 1407.

The vibration device 1401 may convert electrical signals into sound signals. The sound signals may be transmitted to a user through air conduction or bone conduction. For example, the speaker 1400 may contact the user's head directly or through a specific medium (e.g., one or more panels (e.g., the panel 13 illustrated in FIG. 1)), and transmit the sound signal to the user's auditory nerve in the form of skull vibration.

The housing 1403 may be used to support and protect one or more components in the speaker 1400 (e.g., the vibration device 1401). The elastic structure 1402 may connect the vibration device 1401 and the housing 1403. In some embodiments, the elastic structure 1402 may fix the vibration device 1401 in the housing 1403 in a form of a metal sheet, and reduce vibration transmitted from the vibration device 1401 to the housing 1403 in a vibration damping manner.

The microphone 1405 may collect sound signals in the environment (e.g., the user's voice), and convert the sound signals into electrical signals. In some embodiments, the microphone 1405 may acquire sound transmitted through the air (also referred to as "air conduction microphone").

The vibration sensor 1407 may collect mechanical vibration signals (e.g., signals generated by vibration of the housing 1403), and convert the mechanical vibration signals into electrical signals. In some embodiments, the vibration sensor 1407 may be an apparatus that is sensitive to mechanical vibration and insensitive to air-conducted sound (that is, the responsiveness of the vibration sensor 1407 to mechanical vibration exceeds the responsiveness of the vibration sensor 1407 to air-conducted sound). The mechanical vibration signal used herein mainly refers to vibration propagated through solids. In some embodiments, the vibration sensor 1407 may be a bone conduction microphone. In some embodiments, the vibration sensor 1407 may be obtained by changing a configuration of the air conduction microphone. Details regarding changing the air conduction microphone to obtain the vibration sensor may be found in other parts, of the present disclosure, for example, FIGS. 22-B and 22-C, and the descriptions thereof.

The microphone 1405 may be connected to the housing 1403 through the first connection structure 1404. The vibration sensor 1407 may be connected to the housing 1403 through the second connection structure 1406. The first connection structure 1404 and/or the second connection structure 1406 may connect the microphone 1405 and the vibration sensor 1407 to the inner side of the housing 1403 in the same or different manner. Details regarding the first connection structure 1404 and/or the second connection structure 1406 may be found in other parts of the present disclosure, for example, FIG. 18 and/or FIG. 20, and the descriptions thereof.

Due to the influence of other components in the speaker 1400, the microphone 1405 may generate noises during operation. For illustration purposes only, a noise generation process of the microphone 1405 may be described as follows. The vibration device 1401 may vibrate when an electric signal is applied. The vibration device 1401 may transmit the vibration to the housing 1403 through the elastic structure 1402. Since the housing 1403 and the microphone 1405 are directly connected through the first connection structure 1404, the vibration of the housing 1403 may cause the vibration of a diaphragm in the microphone 1405. In such cases, noises (also referred to as "vibration noise" or "mechanical vibration noise") may be generated.

The vibration signal obtained by the vibration sensor 1407 may be used to eliminate the vibration noise generated in the microphone 1405. In some embodiments, a type of the microphone 1405 and/or the vibration sensor 1407, a position where the microphone 1405 and/or the vibration sensor 1407 is connected to the inner side of the housing 1403, a connection manner between the microphone 1405 and/or the vibration sensor 1407 and the housing 1403 may be selected such that an amplitude-frequency response and/or a phase-frequency response of the microphone 1405 to vibration may be consistent with that of the vibration sensor 1407, thereby eliminating the vibration noise generated in the microphone 1405 using the vibration signal collected by the vibration sensor 1407.

The above description of the structure of the speaker 1400 is only a specific example and should not be regarded as the only feasible implementation. Obviously, for those skilled in the art, after understanding the basic principles of speakers, it may be possible to make various modifications and changes in the form and details of the specific methods of implementing speakers without departing from the principles. However, these modifications and changes are still within the scope described above. For example, the speaker 1400 may include more microphones or vibration sensors to eliminate vibration noises generated by the microphone 1405.

FIG. 15-A is a schematic diagram illustrating a signal processing method for removing vibration noises according to some embodiments of the present disclosure. In some embodiments, the signal processing method may include causing the vibration noise signal received by the microphone to be offset with the vibration signal received by the vibration sensor using a digital signal processing method. In some embodiments, the signal processing method may include directly causing the vibration noise signal received by the microphone and the vibration signal received by the vibration sensor to offset each other using an analog signal generated by an analog circuit. In some embodiments, the signal processing method may be implemented by a signal processing unit in the speaker.

As shown in FIG. 15-A, in the signal processing circuit 1510, $A_1$ is a vibration sensor (e.g., the vibration sensor 1407), $B_1$ is a microphone (e.g., the microphone 1405). The vibration sensor $A_1$ may receive a vibration signal, the microphone $B_1$ may receive an air-conducted sound signal and a vibration noise signal. The vibration signal received by the vibration sensor $A_1$ and the vibration noise signal received by the microphone $B_1$ may originate from a same vibration source (e.g., the vibration device 1401). The vibration signal received by the vibration sensor $A_1$, after passing through an adaptive filter C, may be superimposed with the vibration noise signal received by the microphone $B_1$. The adaptive filter C may adjust the vibration signal received by the vibration sensor $A_1$ according to the superposition result (e.g., adjust amplitude and/or phase of the vibration signal) so as to cause the vibration signal received by the vibration sensor $A_1$ to offset the vibration noise signal received by the microphone $B_1$, thereby removing noises.

In some embodiments, parameters of the adaptive filter C may be fixed. For example, since a connection position and a connection manner between the vibration sensor A1 and the housing of the speaker, and between the microphone B1 and the housing of the speaker are fixed, an amplitude-frequency response and/or a phase-frequency response of the vibration sensor $A_1$ and the microphone $B_1$ to vibration may remain unchanged. Therefore, the parameters of the adaptive filter C may be stored in a signal processing chip after being determined, and may be directly used in the signal processing circuit 1510. In some embodiments, the parameters of the adaptive filter C may be variable. In a noise removal process, the parameters of the adaptive filter C may be adjusted according to the signals received by the vibration sensor $A_1$ and/or the microphone $B_1$ to remove noises.

FIG. 15-B is a schematic diagram illustrating a signal processing method for removing vibration noises according to some embodiments of the present disclosure. A difference between FIG. 15-A and FIG. 5-B is that, instead of the adaptive filter C, a signal amplitude modulation component D and a signal phase modulation component E are used in the signal processing circuit 1520 of FIG. 15-B. After amplitude and phase modulation, the vibration signal received by the vibration sensor $A_2$ may offset the vibration noise signal received by the microphone $B_2$, thereby removing noises. In some embodiments, the signal processing method may be implemented by a signal processing unit in the speaker. In some embodiments, the signal amplitude modulation element D or the signal phase modulation element E may be unnecessary.

FIG. 15-C is a schematic diagram illustrating a signal processing method for removing vibration noises according to some embodiments of the present disclosure. Different from the signal processing circuit in FIGS. 15-A and 15-B, in FIG. 15-C, due to a reasonable structural design, the vibration noise signal S2 obtained by the microphone $B_3$ may be directly subtracted with the vibration signal S1 received by the vibration sensor $A_3$, thereby removing noises. In some embodiments, the signal processing method may be implemented by a signal processing unit in the speaker.

It should be noted that in the process of processing the two signals in FIG. 15-A, 15-B, or 15-C, a superposition process of the signal received by the vibration sensor and the signal received by the microphone may be understood as a process in which a part related to the vibration noise in the signal received by the microphone may be removed based on the signal received by the vibration sensor, thereby removing the vibration noise.

The above description of noise removal is only a specific example and should not be regarded as the only feasible implementation. Obviously, for those skilled in the art, after understanding the basic principles of speakers, it may be possible to make various modifications and changes in the form and details of the specific methods of implementing noise removal without departing from this principle. However, these modifications and changes are still within the scope described above. For example, for those skilled in the art, the adaptive filter C, the signal amplitude modulation component D, and the signal phase modulation component E may be replaced by other components or circuits that may be used for signal conditioning, as long as the replacement components or circuits can achieve the purpose of adjusting the vibration signal of the vibration sensor to remove the vibration noise signal in the microphone.

Figure 16:
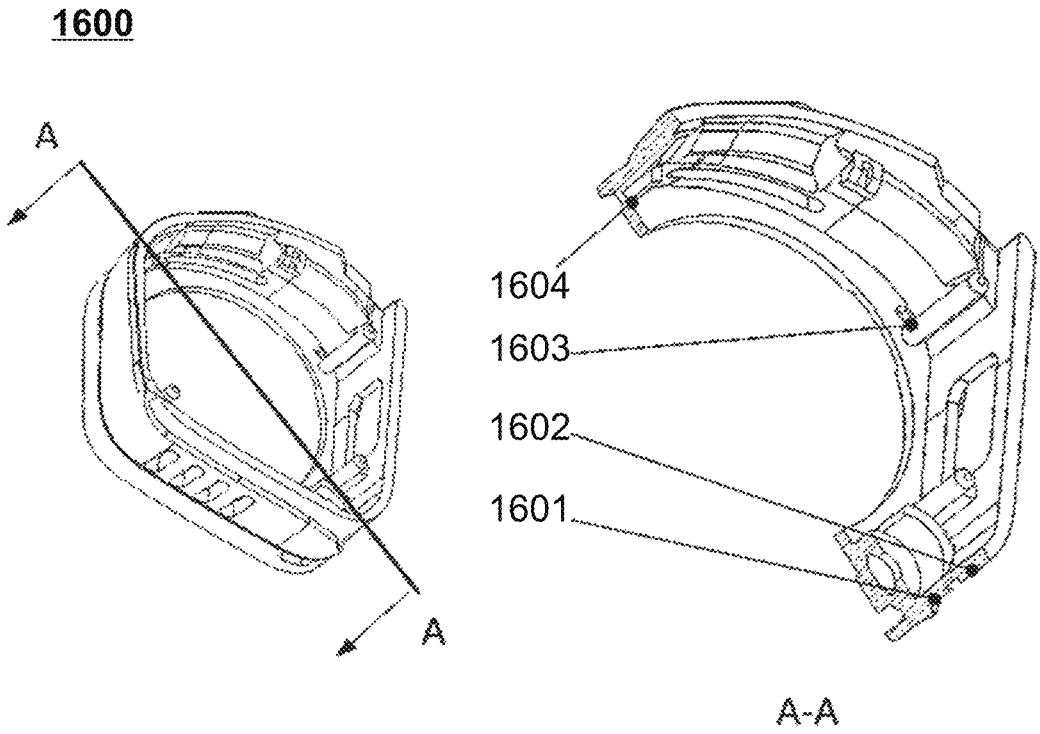
FIG. 16 is a schematic diagram illustrating a structure of a housing of a speaker according to some embodiments of the present disclosure.

As mentioned above, the amplitude-frequency response and/or phase-frequency response of the vibration sensor and/or the microphone to vibration may be related to a position on which it is located on the housing of the speaker. By adjusting the position of the vibration sensor and/or the microphone connected to the housing, the amplitude-frequency response and/or phase-frequency response of the microphone to vibration may be basically consistent with that of the vibration sensor, such that the vibration signal collected by the vibration sensor may be used to offset the vibration noise generated by the microphone. FIG. 16 is a schematic diagram illustrating a structure of a housing of a speaker according to some embodiments of the present disclosure. As shown in FIG. 16, the housing 1600 may be annular. The housing 1600 may support and protect the vibration device (e.g., the vibration device 1401) in the speaker. Position 1601, position 1602, position 1603, and position 1604 are four optional positions in the housing 1600 where a microphone or a vibration sensor may be placed. When the microphone and the vibration sensor are connected to different positions in the housing 1600, the amplitude-frequency response and/or phase-frequency response of the microphone and the vibration sensor to vibration may also be different. Among the positions, position 1601 and position 1602 are adjacent. Position 1603 and position 1601 are located at adjacent corners of the housing 1600. Position 1604 is the farthest from position 1601 and is located at a diagonal position of the housing 1600.

FIG. 17-A is a schematic diagram illustrating amplitude-frequency response curves of a microphone disposed at different positions of a housing of a speaker according to some embodiments of the present disclosure. FIG. 17-B is a schematic diagram illustrating phase-frequency response curves of a microphone disposed at different positions of a housing of a speaker according to some embodiments of the present disclosure. As shown in FIG. 17-A, the horizontal axis denotes the vibration frequency, and the vertical axis denotes the amplitude-frequency response of the microphone to vibration. The vibration may be generated by the vibration device in the speaker and may be transmitted to the microphone through the housing, a connection structure, or the like. The curves P1, P2, P3, and P4 may denote the amplitude-frequency response curves when the microphone is disposed at position 1601, position 1602, position 1603, and position 1604 in the housing 1600, respectively. As shown in FIG. 17-B, the horizontal axis is the vibration frequency, and the vertical axis is the phase-frequency response of the microphone to vibration. The curves P1, P2, P3, and P4 may denote the phase-frequency response curves when the microphone is located at position 1601, position 1602, position 1603, and position 1604 in the housing, respectively.

Taking position 1601 as a reference, it may be seen that the amplitude-frequency response curve and phase-frequency response curve when the microphone is at position 1602 may be most similar to the amplitude-frequency response curve and phase-frequency response curve when the microphone is at position 1601. Secondly, the amplitude-frequency response curve and phase-frequency response curve when the microphone is located at the position 1604 may be relatively similar to the amplitude-frequency response curve and the phase-frequency response curve when the microphone is located at the position 1601. In some embodiments, without considering other factors such as a structure and a connection of the microphone and the vibration sensor, the microphone and the vibration sensor may be connected at close positions (e.g., adjacent positions) inside the housing, or at symmetrical positions (e.g., when the vibration device is located in the center of the housing, the microphone and the vibration sensor may be located at diagonal positions of the housing, respectively) relative to the vibration device inside the housing. In such cases, a difference between the amplitude-frequency response and/or phase-frequency response of the microphone and that of the vibration sensor may be minimized, thereby more effectively removing the vibration noise in the microphone.

Figure 18:
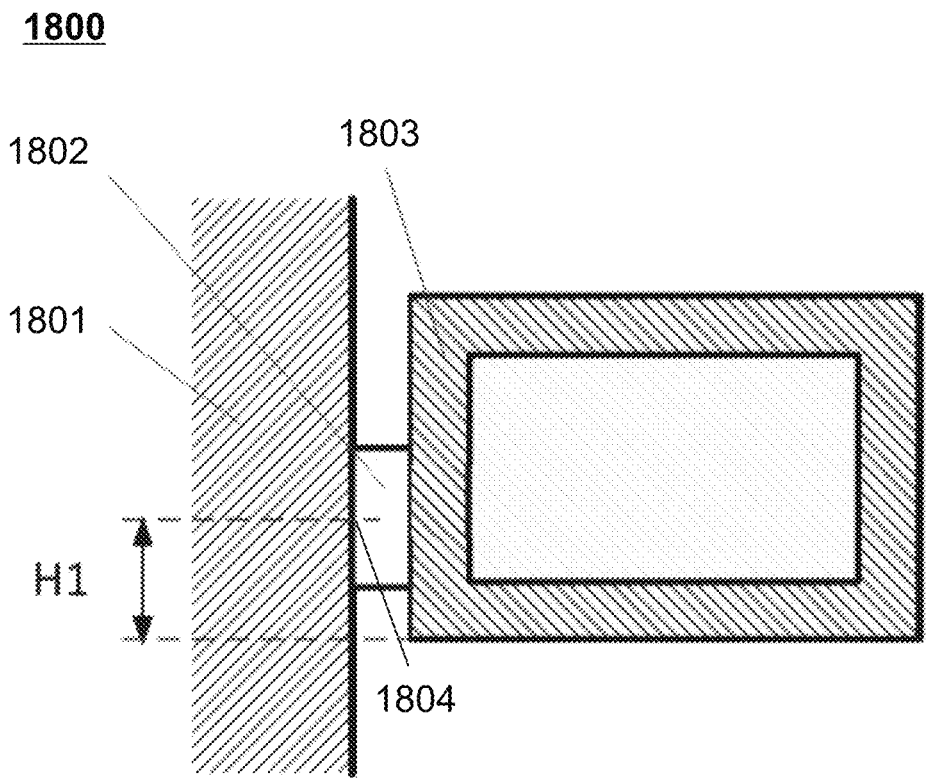
FIG. 18 is a schematic diagram illustrating a microphone or a vibration sensor connected to a housing according to some embodiments of the present disclosure.

FIG. 18 is a schematic diagram illustrating a microphone or a vibration sensor connected to a housing according to some embodiments of the present disclosure. For the purpose of illustration, the connection between the microphone and the housing may be described below as an example.

As shown in FIG. 18, a side wall of the microphone 1803 may be connected to a side wall 1801 of the housing through a connection structure 3102 and form a cantilever connection. The connection structure 3102 may fix the microphone 1803 and the side wall 1801 of the housing in an interference manner with a silicone sleeve, or directly connect the microphone 1803 and the side wall 1801 of the housing with glue (hard glue or soft glue). As shown in the figure, a contact point 1804 between a central axis of the connection structure 3102 and the side wall 1801 of the housing may be defined as a dispensing position. A distance between the dispensing position 1804 and a bottom of the microphone 1803 may be H1. The amplitude-frequency response and/or phase-frequency response of the microphone 1803 to vibration may vary with the change of the dispensing position.

FIG. 19-A is a schematic diagram illustrating amplitude-frequency response curves of a microphone connected to different positions on a housing according to some embodiments of the present disclosure. As shown in FIG. 19-A, the horizontal axis denotes the vibration frequency, and the vertical axis denotes the amplitude-frequency response of the microphone to vibrations of different frequencies. The vibration may be generated by the vibration device in the speaker and may be transmitted to the microphone through the housing, the connection structure, or the like. As shown in the figure, when the distance H1 between the dispensing position and the bottom of the microphone is 0.1 mm, a peak value of the amplitude-frequency response of the microphone is the highest. When H1 is 0.3 mm, the peak value of the amplitude-frequency response may be lower than the peak value when H1 is 0.1 mm, and may move to high frequencies. When H1 is 0.5 mm, the peak value of the amplitude-frequency response may further drop and move to high frequencies. When H1 is 0.7 mm, the peak value of the amplitude-frequency response may further drop and move to the high frequencies. At this time, the peak value may almost drop to zero. It may be seen that the amplitude-frequency response of the microphone to vibration may change with the change of the dispensing position. In practical applications, the dispensing position may be flexibly selected according to actual requirements so as to obtain a microphone with a required amplitude-frequency response to vibration.

FIG. 19-B is a schematic diagram illustrating phase-frequency response curves of a microphone connected to different positions on a housing according to some embodiments of the present disclosure. As shown in FIG. 19-B, the horizontal axis denotes the vibration frequency, and the vertical axis denotes the phase-frequency response of the microphone to vibrations of different frequencies. It may be seen from FIG. 19-B that as the distance between the dispensing position and the bottom of the microphone increases, a vibration phase of the diaphragm of the microphone may change accordingly, and the position of the phase mutation may move to high frequencies. It may be seen that the phase-frequency response of the microphone to vibration may change with the change of the dispensing position. In practical applications, the dispensing position may be flexibly selected according to actual requirements to obtain a microphone with a required phase-frequency response to vibration.

Obviously, for those skilled in the art, in addition to the manner that the microphone is connected to the side wall of the housing, the microphone may also be connected to the housing in other manners or other positions. For example, the bottom of the microphone may be connected to the bottom of the inside of the housing (also referred to as "substrate connection").

Figure 20:
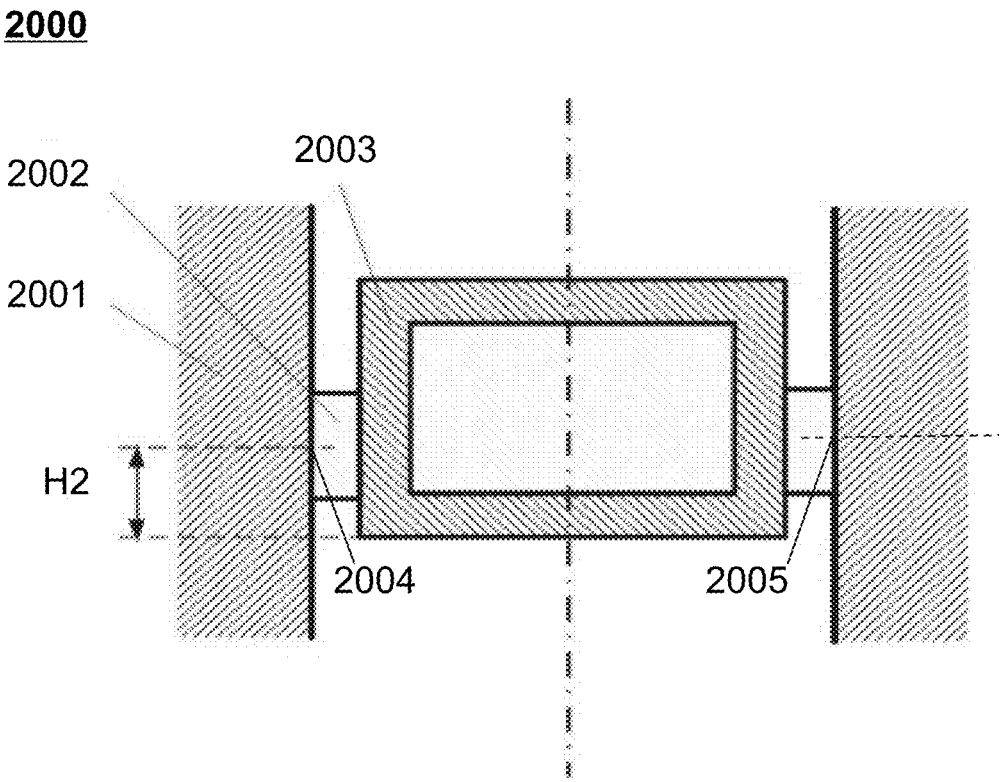
FIG. 20 is a schematic diagram illustrating a microphone or a vibration sensor connected to a housing according to some embodiments of the present disclosure.

In addition, the microphone may also be connected to the housing through a peripheral connection. For example, FIG. 20 is a schematic diagram illustrating a microphone connected to a housing through a peripheral connection according to some embodiments of the present disclosure. As shown in FIG. 20, at least two side walls of a microphone 2003 may be respectively connected to a housing 2001 through a connection structure 2002 and form a peripheral connection. The connection structure 2002 may be similar to the connection structure 3102, which is not repeated here. As shown in the figure, contact points 2004 and 2005 between a central axis of the connection structure 2002 and the housing may be dispensing positions, and a distance between the dispensing position and the bottom of the microphone 2003 may be H2. An amplitude-frequency response and/or phase-frequency response of the microphone 2003 to vibration may vary with the change of the dispensing position H2.

FIG. 21-A is a schematic diagram illustrating amplitude-frequency response curves of a microphone connected to different positions on a housing through a peripheral connection according to some embodiments of the present disclosure. As shown in FIG. 21-A, the horizontal axis denotes the vibration frequency, and the vertical axis denotes the amplitude-frequency response of the microphone to vibrations of different frequencies. It may be seen from FIG. 21-A that as the distance between the dispensing position and the bottom of the microphone increases, the peak value of the amplitude-frequency response of the microphone may gradually increase. It may be seen that when the microphone is connected to the housing through a peripheral connection, the amplitude-frequency response of the microphone to vibration may change with the change of the dispensing position. In practical applications, the dispensing position may be flexibly selected according to actual requirements to obtain a microphone with a required amplitude-frequency response to vibration.

FIG. 21-B is a schematic diagram illustrating phase-frequency response curves of a microphone connected to different positions on a housing through a peripheral connection according to some embodiments of the present disclosure. As shown in FIG. 21-B, the horizontal axis denotes the vibration frequency, and the vertical axis denotes the phase-frequency response of the microphone to vibrations of different frequencies. It may be seen from FIG. 21-B that as the distance between the dispensing position and the bottom of the microphone increases, the vibration phase of the diaphragm of the microphone may also change, and the position of the phase mutation may move to high frequencies. It may be seen that when the microphone is connected to the housing through a peripheral connection, the phase-frequency response of the microphone to vibration may vary with the change of the dispensing position. In practical applications, the dispensing position may be flexibly selected according to actual requirements to obtain a microphone with a required phase-frequency response to vibration.

In some embodiments, in order to make the amplitude-frequency response/phase-frequency response of the vibration sensor to the vibration as consistent as possible with that of the microphone, the vibration sensor and the microphone may be connected in the housing in the same manner (e.g., one of a cantilever connection, a peripheral connection, or a substrate connection), and the respective dispensing positions of the vibration sensor and the microphone may be the same or as close as possible.

As described above, the amplitude-frequency response and/or phase-frequency response of the vibration sensor and/or the microphone to vibration may be related to the type of the microphone and/or the vibration sensor. By selecting an appropriate type of microphone and/or vibration sensor, the amplitude-frequency response and/or phase-frequency response of the microphone and the vibration sensor to vibration may be basically the same, such that the vibration signal obtained by the vibration sensor may be used to remove the vibration noise picked by the microphone.

FIG. 22-A is a schematic diagram illustrating a structure of an air conduction microphone 2210 according to some embodiments of the present disclosure. In some embodiments, the air conduction microphone 2210 may be a micro-electromechanical system (MEMS) microphone. MEMS microphones may have the characteristics of small size, low power consumption, high stability, and well consistency of amplitude-frequency and phase-frequency response. As shown in FIG. 9-A, the air conduction microphone 2210 may include an opening 2211, a housing 2212, an integrated circuit (ASIC) 2213, a printed circuit board (PCB) 2214, a front cavity 2215, a diaphragm 2216, and a back cavity 2217. The opening 2211 may be located on one side of the housing 2212 (an upper side in FIG. 22-A, that is, the top). The integrated circuit 2213 may be mounted on the PCB 2214. The front cavity 2215 and the back cavity 2217 may be separated and formed by the diaphragm 2216. As shown in the figure, the front cavity 2215 may include a space above the diaphragm 2216 and may be formed by the diaphragm 2216 and the housing 2212. The back cavity 2217 may include a space below the diaphragm 2216 and may be formed by the diaphragm 2216 and the PCB 2214. In some embodiments, when the air conduction microphone 2210 is placed in the speaker, air conduction sound in the environment (e.g., the user's voice) may enter the front cavity 2215 through the opening 2211 and cause vibration of the diaphragm 2216. At the same time, the vibration signal generated by the vibration device may cause a vibration of the housing 2212 of the air conduction microphone 2210 through the housing, a connection structure, etc. of the speaker, thereby driving the diaphragm 2216 to vibrate, thereby generating a vibration noise signal.

In some embodiments, the air conduction microphone 2210 may be replaced by a manner in which the back cavity 2217 has an opening, and the front cavity 2215 is isolated from the outside air.

FIG. 22-B is a schematic diagram illustrating a structure of a vibration sensor 2220 according to some embodiments of the present disclosure. As shown in FIG. 22-B, the vibration sensor 2220 may include a housing 2222, an integrated circuit (ASIC) 2223, a printed circuit board (PCB) 2224, a front cavity 2225, a diaphragm 2226, and a back cavity 2227. In some embodiments, the vibration sensor 2220 may be obtained by closing the opening 2211 of the air conduction microphone in FIG. 22-A (in the present disclosure, the vibration sensor 2220 may also be referred to as a closed microphone 2220). In some embodiments, when the closed microphone 2220 is placed in the speaker, air conduction sound in the environment (e.g., the user's voice) may not enter the closed microphone 2220 to cause the diaphragm 2226 to vibrate. The vibration generated by the vibration device may cause the housing 2222 of the enclosed microphone 2220 to vibrate through the housing, a connection structure, etc. of the speaker, and may further drive the diaphragm 2226 to vibrate to generate a vibration signal.

FIG. 22-C is a schematic diagram illustrating a structure of a vibration sensor 2230 according to some embodiments of the present disclosure. As shown in FIG. 22-C, the vibration sensor 2230 may include an opening 2231, a housing 2232, an integrated circuit (ASIC) 2233, a printed circuit board (PCB) 2234, a front cavity 2235, a diaphragm 2236, a back cavity 2237, and an opening 2238. In some embodiments, the vibration sensor 2230 may be obtained by punching a hole at a bottom of the back cavity 2237 of the air conduction microphone in FIG. 22-A, such that the back cavity 2237 may communicate with the outside (in the present disclosure, the vibration sensor 2230 may also be referred to as a dual-link microphone 2230). In some embodiments, when the dual-link microphone 2230 is placed in the speaker, the air conduction sound in the environment (e.g., the user's voice) may enter the dual-link microphone 2230 through the opening 2231 and the opening 2238, such that air-conducted sound signals received on both sides of the diaphragm 2236 may offset each other. Therefore, the air-conducted sound signals may not cause obvious vibration of the diaphragm 2236. The vibration generated by the vibration device may cause the housing 2232 of the dual-link microphone 2230 to vibrate through the housing, a connection structure, etc. of the speaker, and may further drive the diaphragm 2236 to vibrate to generate a vibration signal.

The above descriptions of the air conduction microphone and the vibration sensor are only specific examples, and should not be regarded as the only feasible implementation. Obviously, for those skilled in the art, after understanding the basic principle of the microphone, it may be possible to make various modifications and changes to the specific structure of the microphone and/or the vibration sensor without departing from the principles. However, these modifications and changes are still within the scope described above. For example, for those skilled in the art, the opening 2211 or 2231 in the air conduction microphone 2210 or the vibration sensor 2230 may be arranged on a left or right side of the housing 2212 or the housing 2232, as long as the opening may facilitate communication between the front cavity 2215 or 2235 with the outside. Further, a count of openings may be not limited to one, and the air conduction microphone 2210 or the vibration sensor 2230 may include a plurality of openings similar to the openings 2211 or 2231.

In some embodiments, the vibration signal generated by the diaphragm 2226 or 2236 of the closed microphone 2220 or the dual-link microphone 2230 may be used to offset the vibration noise signal generated by the diaphragm 2216 of the air conduction microphone 2210. In some embodiments, in order to obtain a better effect of removing vibration and noise, it may be necessary to make the closed microphone 2220 or the dual-link microphone 2230 and the air conduction microphone 2210 have a same amplitude-frequency response or a same phase-frequency response to mechanical vibration of the housing of the speaker.

For illustration purposes only, the air conduction microphones and vibration devices mentioned in FIG. 22-A, FIG. 22-B and FIG. 22-C may be described as examples. A front cavity volume, a back cavity volume, and/or a cavity volume of the air conduction microphone or vibration sensor (e.g., the closed microphone 2220 or the dual-link microphone 2230) may be changed to make the air conduction microphone and the vibration sensor have the same or almost the same amplitude-frequency response and/or phase-frequency response to vibration, thereby removing vibration and noises. The cavity volume herein refers to a sum of the front cavity volume and the back cavity volume of the microphone or the closed microphone. In some embodiments, when the amplitude-frequency response and/or phase-frequency response of the vibration sensor to vibration of the housing of the speaker is consistent with that of the air conduction microphone, the cavity volume of the vibration sensor may be regarded as the "equivalent volume" of the cavity volume of the air conduction microphone 2210. In some embodiments, a closed microphone with a cavity volume that is the equivalent volume of the air conduction microphone cavity volume may be selected to facilitate the removal of the vibration noise signal of the air conduction microphone.

FIG. 23-A is a schematic diagram illustrating amplitude-frequency response curves of a vibration sensor with different cavity volumes according to some embodiments of the present disclosure. In some embodiments, the amplitude-frequency response curves of the vibration sensors with different cavity volumes to vibration may be obtained through finite element calculation methods or actual measurements. For example, the vibration sensor may be a closed microphone, and a bottom of the vibration sensor may be installed inside the housing. As shown in FIG. 23-A, the horizontal axis denotes the vibration frequency, and the vertical axis denotes the amplitude-frequency response of the closed microphone to vibrations of different frequencies. The vibration may be generated by the vibration device in the speaker, and may be transmitted to the air conduction microphone or the vibration sensor through the housing and a connection structure. The solid line denotes the amplitude-frequency response curve of the air conduction microphone to vibration. The dotted lines denote the amplitude-frequency response curves of the closed microphone to vibration when a volume ratio of the closed microphone to the air conduction microphone cavity is 1:1, 3:1, 6.5:1, and 9.3:1. When the volume ratio is 1:1, the overall amplitude-frequency response curve of the closed microphone may be lower than that of the air conduction microphone. When the volume ratio is 3:1, the amplitude-frequency response curve of the closed microphone may increase, but the overall amplitude-frequency response curve may be still slightly lower than that of the air conduction microphone. When the volume ratio is 6.5:1, the overall amplitude-frequency response curve of the closed microphone may be slightly higher than that of the air conduction microphone. When the cavity volume ratio is 9.3:1, the overall amplitude-frequency response curve of the closed microphone may be higher than that of the air conduction microphone. It may be seen that when the cavity volume ratio is between 3:1 and 6.5:1, the amplitude-frequency response curves of the closed microphone and the air conduction microphone may be basically the same. Therefore, it may be considered that a ratio of the equivalent volume (i.e., the cavity volume of the closed microphone) to the cavity volume of the air conduction microphone may be between 3:1 and 6.5:1. In some embodiments, when the vibration sensor (e.g., the closed microphone 2220) and the air conduction microphone (e.g., the air conduction microphone 2210) receive vibration signals from a same vibration source, and a ratio of the cavity volume of the vibration sensor to the cavity volume of the air conduction microphone is between 3:1 and 6.5:1, the vibration sensor may help remove the vibration signal received by the air conduction microphone.

Similarly, FIG. 23-B is a schematic diagram illustrating phase-frequency response curves of a vibration sensor with different cavity heights according to some embodiments of the present disclosure. As shown in FIG. 23-B, the horizontal axis denotes the vibration frequency, and the vertical axis denotes the phase-frequency response of the closed microphone to vibration of different frequencies. As shown in FIG. 23-B, the solid line denotes the phase-frequency response curve of the air conduction microphone to vibration. The dotted lines denote the phase-frequency response curves of the closed microphone to vibration when a volume ratio of the closed microphone to the air conduction microphone cavity is 1:1, 3:1, 6.5:1, and 9.3:1. In some embodiments, when the closed microphone (e.g., the closed microphone 2220) and the air conduction microphone (e.g., the air conduction microphone 2210) receive vibration signals from the same vibration source, and a ratio of the cavity volume of the closed microphone to the cavity volume of the air conduction microphone is greater than 3:1, the closed microphone may help remove the vibration signal received by the air conduction microphone.

The above description of the equivalent volume of the air conduction microphone cavity volume is only a specific example, and should not be regarded as the only feasible implementation. Obviously, for those skilled in the art, after understanding the basic principles of air conduction microphones, it may be possible to make various modifications and changes to the specific structure of the microphone and/or vibration sensor without departing from the principles. However, these modifications and changes are still within the scope described above. For example, the equivalent volume of the cavity volume of the air conduction microphone may be changed through the modification of the structure of the air conduction microphone or the vibration sensor, as long as a closed microphone with a suitable cavity volume is selected to achieve the purpose of removing vibration and noises.

As described above, when the air conduction microphone has different structures, the equivalent volume of the cavity volume thereof may also be different. In some embodiments, factors affecting the equivalent volume of the cavity volume of the air conduction microphone may include the front cavity volume, the back cavity volume, the position of the opening, and/or the sound source transmission path of the air conduction microphone. Alternatively, in some embodiments, the equivalent volume of the front cavity volume of the air conduction microphone may be used to characterize the front cavity volume of the vibration sensor. The equivalent volume of the front cavity volume of the microphone herein may be described as when the back cavity volume of the vibration sensor is the same as the back cavity volume of the air conduction microphone, and the amplitude-frequency response and/or phase-frequency response of the vibration sensor to vibration of the housing of the speaker is consistent with that of the air conduction microphone, the front cavity volume of the vibration sensor may be the "equivalent volume" of the front cavity volume of the air conduction microphone. In some embodiments, a closed microphone with a back cavity volume equal to the back cavity volume of the air conduction microphone, and a front cavity volume being the equivalent volume of the front cavity volume of the air conduction microphone may be selected so as to help remove the vibration noise signal of the air conduction microphone.

When the air conduction microphone has different structures, the equivalent volume of the front cavity volume may also be different. In some embodiments, factors affecting the equivalent volume of the front cavity volume of the air conduction microphone may include the front cavity volume, the back cavity volume, the position of the opening, and/or the sound source transmission path of the air conduction microphone.

FIG. 24-A is a schematic diagram illustrating amplitude-frequency response curves of an air conduction microphone when a front cavity volume changes according to some embodiments of the present disclosure. In some embodiments, the amplitude-frequency response curves of the air conduction microphones with different front cavity volumes to vibration may be obtained through finite element calculation methods or actual measurements. As shown in FIG. 24-A, the horizontal axis denotes the vibration frequency, and the vertical axis denotes the amplitude-frequency response of the air conduction microphone to vibrations of different frequencies. $V_0$ denotes the front cavity volume of the air conduction microphone. As shown in FIG. 24-A, the solid line denotes the amplitude-frequency response curve of the air conduction microphone when the front cavity volume is $V_0$, and the dotted lines denote the amplitude-frequency response curves of the air conduction microphone when the front cavity volume is $2V_0$, $3V_0$, $4V_0$, $5V_0$, and $6V_0$, respectively. It may be seen from the figure that as the front cavity volume of the air conduction microphone increases, the amplitude of the diaphragm of the air conduction microphone may increase, and the diaphragm may be more likely to vibrate.

For air conduction microphones with different front cavity volumes, the equivalent volume of the front cavity volume of each air conduction microphone may be determined according to the corresponding amplitude-frequency response curve. In some embodiments, the equivalent volume of the front cavity volume may be determined according to a method similar to FIG. 23-A. For example, according to the corresponding amplitude-frequency response curves in FIG. 24-A, an equivalent volume of the front cavity volume of an air conduction microphone with a front cavity volume of $2V_0$ may be determined as $6.7V_0$ using the method of FIG. 23-A. That is, when the back cavity volume of the vibration sensor is equal to the back cavity volume of the air conduction microphone, the front cavity volume of the vibration sensor is $6.7V_0$, and the front cavity volume of the air conduction microphone is $2V_0$, the amplitude-frequency response of the vibration sensor to vibration may be the same as that of the air conduction microphone. As shown in Table 1, as the front cavity volume increases, the equivalent volume of the front cavity volume of the air conduction microphone may also increase.

TABLE 1

Equivalent volumes corresponding to different front cavity volumes

| Front Cavity Volume | $1V_0$ | $2V_0$ | $3V_0$ | $4V_0$ | $5V_0$ |
|---|---|---|---|---|---|
| Equivalent Volume | $4V_0$ | $6.7V_0$ | $8V_0$ | $9.3V_0$ | $12V_0$ |

Similarly, FIG. 24-B is a schematic diagram illustrating amplitude-frequency response curves of an air conduction microphone when a back cavity volume changes according to some embodiments of the present disclosure. In some embodiments, the amplitude-frequency response curves of the air conduction microphones with different back cavity volumes to vibration may be obtained through finite element calculation methods or actual measurements. As shown in FIG. 24-B, the horizontal axis denotes the vibration frequency, and the vertical axis denotes the amplitude-frequency response of the air conduction microphone to vibrations of different frequencies. $V_1$ denotes the back cavity volume of the air conduction microphone. As shown in FIG. 24-B, the solid line denotes the amplitude-frequency response curve of the air conduction microphone when the back cavity volume is $0.5V_1$, and the dotted lines denote the amplitude-frequency response curves of the air conduction microphone when the back cavity volume is $1V_1$, $1.5V_1$, $2V_1$, $2.5V_1$, and $3V_1$, respectively. It may be seen from the figure that as the volume of the back cavity of the air conduction microphone increases, the amplitude of the diaphragm of the air conduction microphone may increase, and the diaphragm may be more likely to vibrate. For air conduction microphones with different back cavity volumes, the equivalent volume of the front cavity volume of each air conduction microphone may be determined according to the corresponding amplitude-frequency response curve. In some embodiments, the equivalent volume of the front cavity volume may be determined according to a method similar to FIG. 23-A. For example, according to the solid line shown in FIG. 24-B, an equivalent volume of a front cavity volume of an air conduction microphone with a back cavity volume of $0.5V_1$ may be determined as $3.5V_0$ using the method of FIG. 23-A. That is, when the back cavity volumes of the air conduction microphone and the vibration sensor are both $0.5V_1$, the front cavity volume of the vibration sensor is $3.5V_0$, and the front cavity volume of the air conduction microphone is $1V_0$, the amplitude-frequency response of the vibration sensor to vibration may be the same as that of the air conduction microphone. As another example, when the back cavity volumes of the air conduction microphone and the vibration sensor are both $3.0V_1$, the front cavity volume of the vibration sensor is $7V_0$, and the front cavity volume of the air conduction microphone is $1V_0$, the amplitude-frequency—frequency response of the vibration sensor to vibration may be the same as that of the air conduction microphone. When the front cavity volume of the air conduction microphone remains unchanged at $1V_0$ and the back cavity volume increases from $0.5V_1$ to $3.0V_1$, the equivalent volume of the front cavity volume of the air conduction microphone may increase from $3.5V_0$ to $7V_0$.

Figure 25:
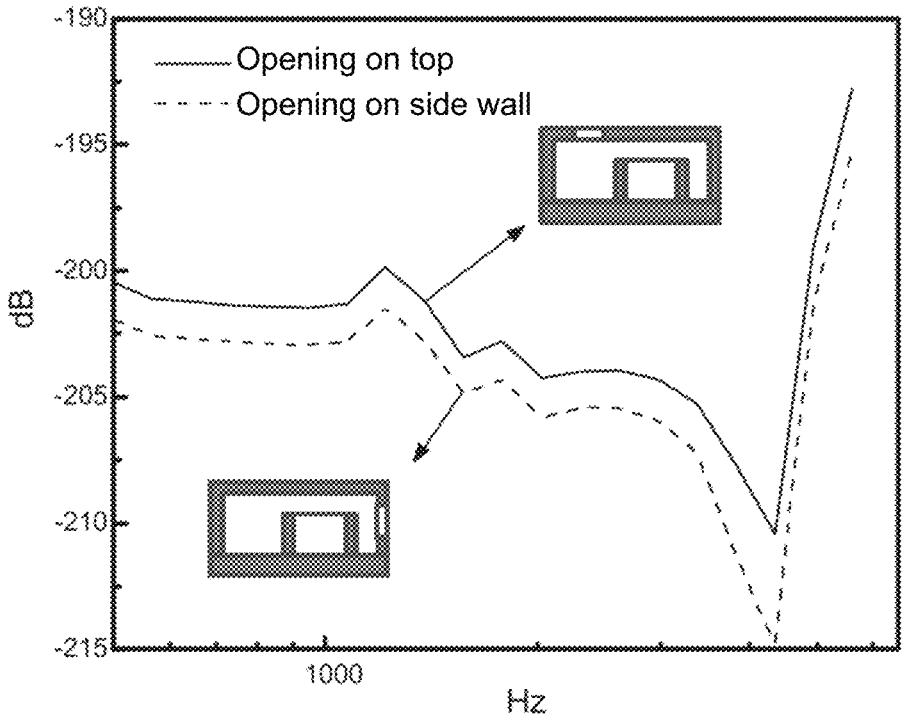
FIG. 25 is a schematic diagram illustrating amplitude-frequency response curves of a microphone with different opening positions according to some embodiments of the present disclosure.

In some embodiments, a position of the opening on the housing of the air conduction microphone may also affect the equivalent volume of the front cavity volume of the air conduction microphone. FIG. 25 is a schematic diagram illustrating amplitude-frequency response curves of a diaphragm corresponding to different opening positions according to some embodiments of the present disclosure. In some embodiments, the amplitude-frequency response curves of the air conduction microphone with different opening positions may be obtained through a finite element calculation method or actual measurement. As shown in the figure, the horizontal axis denotes the vibration frequency, and the vertical axis denotes the amplitude-frequency response of air conduction microphones with different opening positions to vibration. As shown in FIG. 25, the solid line denotes the amplitude-frequency response curve of the air conduction microphone with the opening on the top of the housing, and the dotted line denotes the amplitude-frequency response curve of the air conduction microphone with the opening on the side wall of the housing. It may be seen that the overall amplitude-frequency response of the air conduction microphone when the opening is on the top is higher than that of the air conduction microphone when the opening is on the side wall. In some embodiments, for air conduction microphones with different opening positions, the equivalent volume of a corresponding front cavity volume may be determined according to the corresponding amplitude-frequency response curve. The method for determining the equivalent volume of the front cavity volume may be same as the method in FIG. 23-A.

In some embodiments, the equivalent volume of the front cavity volume of the air conduction microphone with the opening at the top of the housing is greater than the equivalent volume of the front cavity volume of the air conduction microphone with the opening at the side wall. For example, the front cavity volume of the air conduction microphone with the top opening may be $1V_0$, the equivalent volume of the front cavity volume may be $4V_0$, and the equivalent volume of the front cavity volume of the air conduction microphone in a same size with an opening on the side wall may be about $1.5V_0$. The same size means that the front cavity volume and the back cavity volume of the air conduction microphone with an opening on the side wall may be respectively equal to the front cavity volume and the back cavity volume of the air conduction microphone with an opening on the top.

In some embodiments, transmission paths of the vibration source may be different, and the equivalent volumes of the front cavity volume of the air conduction microphone may also be different. In some embodiments, the transmission path of the vibration source may be related to the connection manner between the microphone and the housing of the speaker, and different connection manners between the microphone and the housing of the speaker may correspond to different amplitude-frequency responses. For example, when the microphone is connected in the housing through a peripheral connection, the amplitude-frequency response to vibration may be different from that of a side wall connection.

Figure 26:
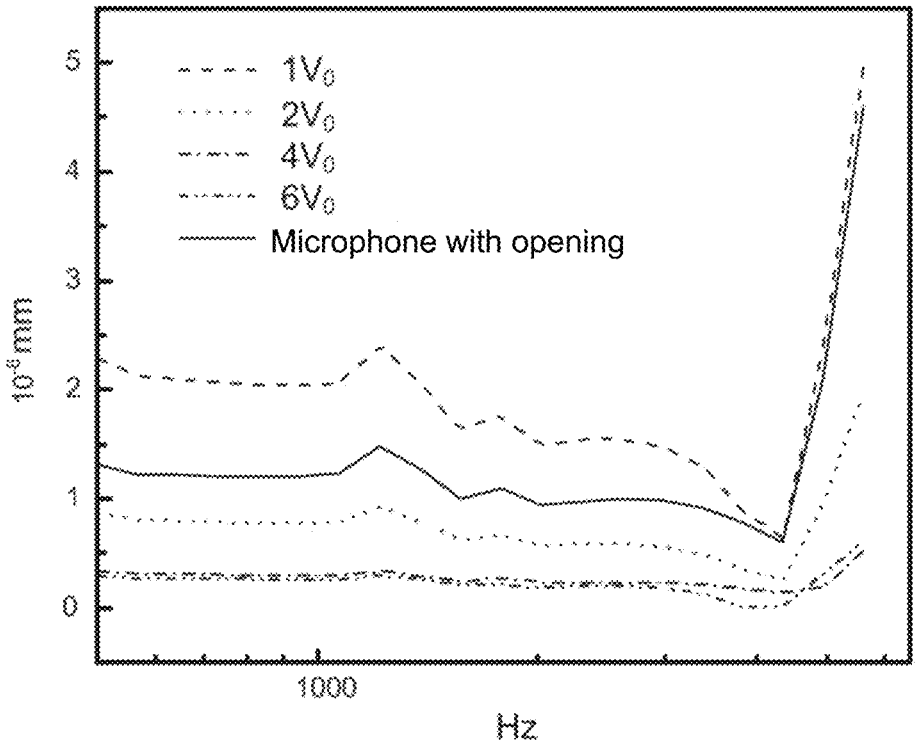
FIG. 26 is a schematic diagram illustrating amplitude-frequency response curves of an air conduction microphone and a fully enclosed microphone in a peripheral connection with a housing to vibration when a front cavity volume changes according to some embodiments of the present disclosure.

Different from the substrate connection to the housing in FIG. 23, FIG. 26 is a schematic diagram illustrating amplitude-frequency response curves of an air conduction microphone and a fully enclosed microphone in a peripheral connection with a housing to vibration when a front cavity volume changes according to some embodiments of the present disclosure. It should be noted that when discussing the front cavity volume of the air conduction microphone or the equivalent volume of the cavity volume, the connection manner of the air conduction microphone may be the same as the connection manner of the vibration sensor having a corresponding equivalent volume (an equivalent volume of the front cavity volume or an equivalent volume of the cavity volume). For example, in FIG. 20, FIG. 21 and FIG. 26, the air conduction microphone and the vibration sensor may be connected to the housing through a peripheral connection. As another example, the air conduction microphone and the vibration sensor in other embodiments of the present disclosure may be connected to the housing through a substrate connection, a peripheral connection, or other connection manners. In some embodiments, the amplitude-frequency response curve of the air conduction microphone and the fully enclosed microphone in a peripheral connection with a housing to vibration may be obtained through a finite element calculation method or actual measurement. As shown in FIG. 26, the solid line denotes the amplitude-frequency response curve of the air conduction microphone to vibration when the front cavity volume is $V_0$ and the air conduction microphone is connected to the housing through a peripheral connection. The dotted lines denote the amplitude-frequency response curves of the fully enclosed microphone to vibration when the fully enclosed microphone is connected to the housing through a peripheral connection and the front cavity volume is $1V_0$, $2V_0$, $4V_0$, $6V_0$, respectively. When the air conduction microphone with a front cavity volume of $1V_0$ is connected to the housing through a peripheral connection, the overall amplitude-frequency response curve may be lower than that of the fully enclosed microphone with a front cavity volume of $1V_0$ connected to the housing through a peripheral connection. When a fully enclosed microphone with a front cavity volume of $2V_0$ is connected to the housing through a peripheral connection, the overall amplitude-frequency response curve may be lower than that of the air conduction microphone with a front cavity volume of $1V_0$ connected to the housing through a peripheral connection. When the fully enclosed microphones with a front cavity volume of $4V_0$ and $6V_0$ are connected to the housing through a peripheral connection, the amplitude-frequency response curves may continue to decrease, which may be lower than the amplitude-frequency response curve of the air conduction microphone with a front cavity volume of $1V_0$ connected to the housing through a peripheral connection. It may be seen from the figure that when the front cavity volume of the fully closed microphone is between $1V_0$-$2V_0$, the amplitude-frequency response curve of the fully closed microphone connected to the housing through a peripheral connection may be closest to the amplitude-frequency response curve of the air conduction microphone connected to the housing through a side wall connection. It may be concluded that if the air conduction microphone and the closed microphone are both connected to the housing through peripheral connections, the equivalent volume of the front cavity volume of the air conduction microphone may be between $1V_0$-$2V_0$.

Figure 27:
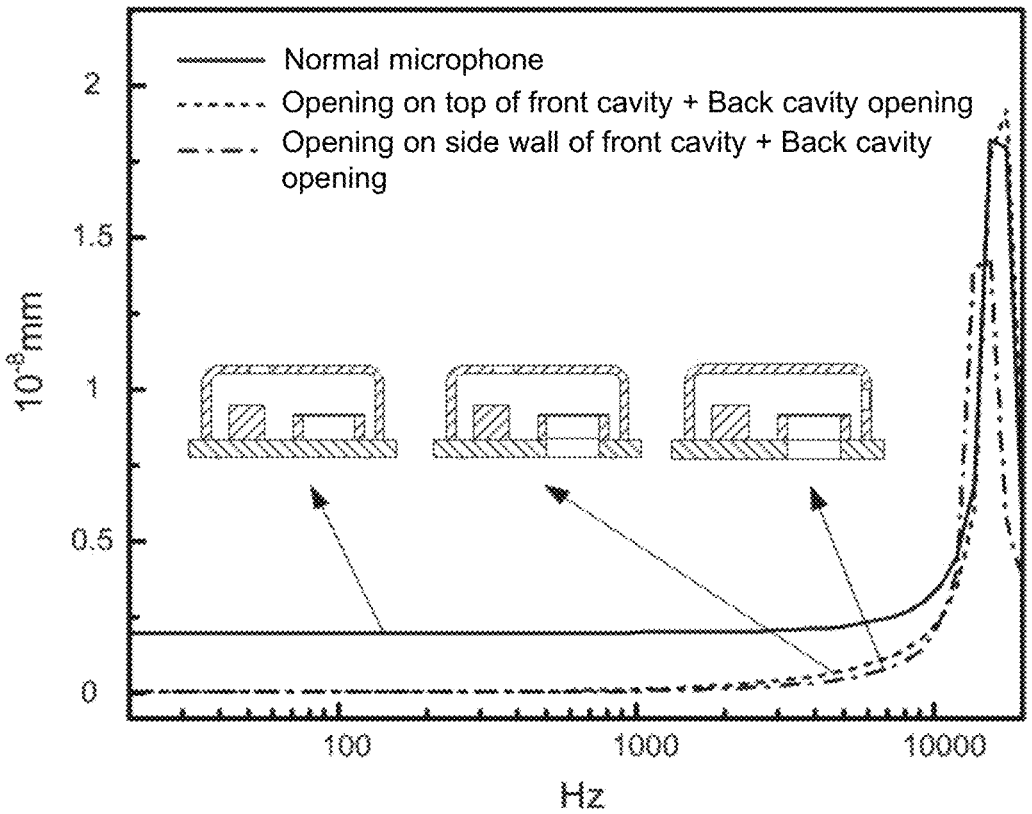
FIG. 27 is a schematic diagram illustrating amplitude-frequency response curves of an air conduction microphone and two dual-link microphones to an air-conducted sound signal according to some embodiments of the present disclosure.

FIG. 27 is a schematic diagram illustrating amplitude-frequency response curves of an air conduction microphone and two dual-link microphones to an air-conducted sound signal according to some embodiments of the present disclosure. Specifically, the solid line corresponds to the amplitude-frequency response curve of the air conduction microphone, and the dotted line corresponds to the amplitude-frequency response curve of the dual-link microphone with an opening on the top of the housing and the dual-link microphone with an opening on the side wall, respectively. As shown by the dotted line in the figure, when the frequency of the air-conducted sound signal is less than 5 kHz, the dual-link microphone may not respond to the air-conducted sound signal. When the frequency of the air-conducted sound signal exceeds 10 kHz, since a wavelength of the air-conducted sound signal gradually approaches a characteristic length of the dual-link microphone, and at the same time, a frequency of the air-conducted sound signal is close to or reaches a characteristic frequency of the diaphragm structure, the diaphragm may be caused to resonate to generate a relatively high amplitude, at this time the dual-link microphone may respond to the air-conducted sound signal. The characteristic length of the dual-link microphone herein may be a size of the dual-link microphone in one dimension. For example, when the dual-link microphone is a cuboid or approximately a cuboid, the characteristic length may be a length, a width or a height of the dual-link microphone. As another example, when the dual-link microphone is a cylinder or approximately a cylinder, the characteristic length may be a diameter or a height of the dual-link microphone. In some embodiments, the wavelength of the air-conducted sound signal is close to the characteristic length of a dual-link microphone, which may be understood as the wavelength of the air-conducted sound signal and the characteristic length of the dual-link microphone are on the same order of magnitude (e.g., on the order of mm). In some embodiments, a frequency band of voice communication may be in a range of 500 Hz-3400 Hz. The dual-link microphone may be insensitive to air-conducted sound in this range and may be used to measure vibration noise signals. Compared with closed microphones, the dual-link microphone may have better isolation effects on air-conducted sound signals in low frequency bands. In such cases, a dual-link microphone with a hole on the top of the housing or a side wall may be used as a vibration sensor to help remove the vibration noise signal in the air conduction microphone.

Figure 28:
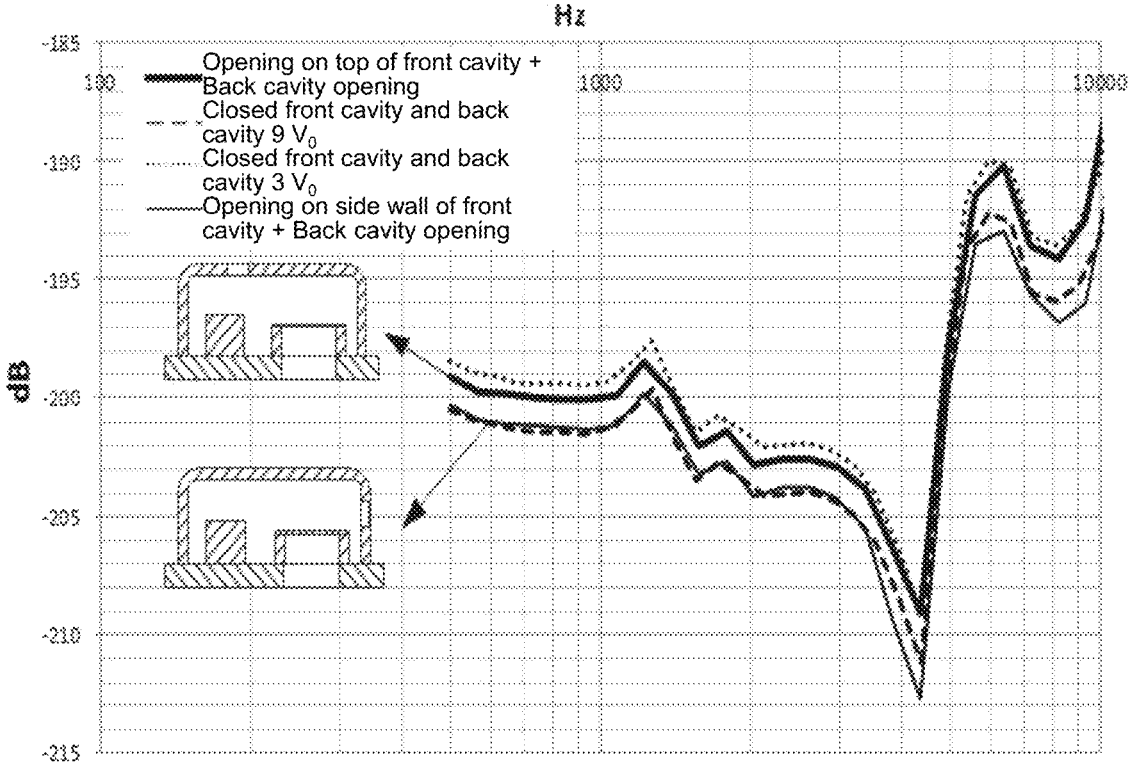
FIG. 28 is a schematic diagram illustrating amplitude-frequency response curves of a vibration sensor to vibration according to some embodiments of the present disclosure.

FIG. 28 is a schematic diagram illustrating amplitude-frequency response curves of a vibration sensor to vibration according to some embodiments of the present disclosure. The vibration sensor may include a closed microphone and a dual-link microphone. Specifically, FIG. 28 shows the amplitude-frequency response curves of two closed microphones and two dual-link microphones to vibration. As shown in FIG. 28, the thick solid line denotes the amplitude-frequency response curve of the dual-link microphone with a front cavity volume of $1V_0$ and an opening on the top to vibration, and the thin solid line denotes the amplitude-frequency response curve of the dual-link microphone with a front cavity volume of $1V_0$ and an opening on the side wall to vibration. The two dotted lines denote the amplitude-frequency response curves of closed microphones with front cavity volumes of $9V_0$ and $3V_0$ to vibration, respectively. It may be seen from the figure that the dual-link microphone with a front cavity volume of $1V_0$ and an opening on the side wall may be approximately "equivalent" to the closed microphone with a front cavity volume of $9V_0$. The dual-link microphone with a front cavity volume of $1V_0$ and an opening on the top may be approximately "equivalent" to the closed microphone with a front cavity volume of $3V_0$. Therefore, a dual-link microphone with a small volume may be used instead of a fully enclosed microphone with a large volume. In some embodiments, dual-link microphones and closed microphones that are "equivalent" or approximately "equivalent" to each other may be used interchangeably.

Example 12

Figure 29:
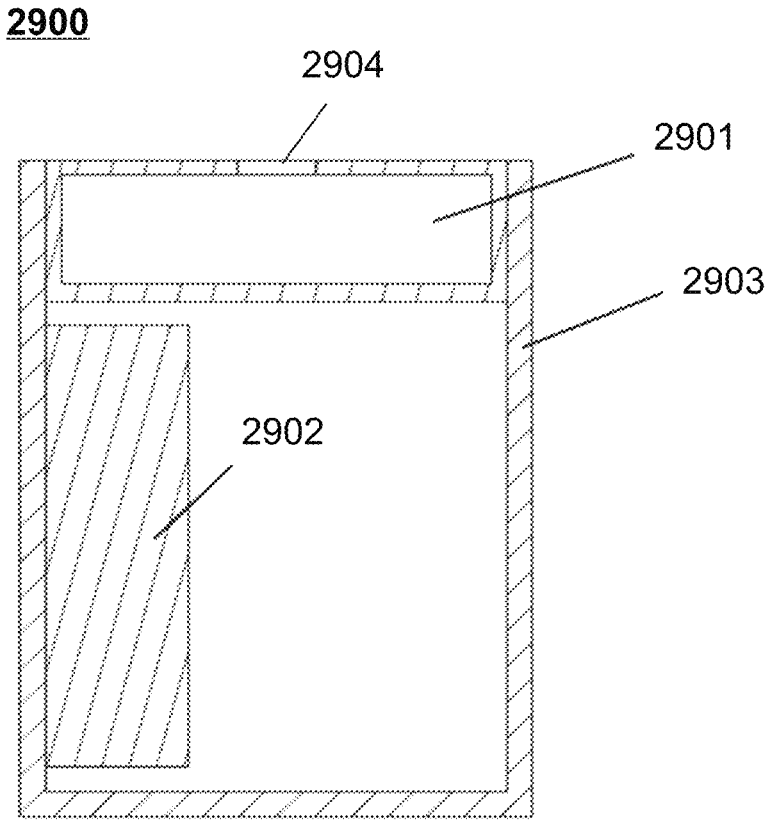
FIG. 29 is a schematic diagram illustrating a structure of a dual-microphone speaker according to some embodiments of the present disclosure.

As shown in FIG. 29, the speaker 2900 may include an air conduction microphone 2901, a bone conduction microphone 2902, and a housing 2903. As used herein, a sound hole 2904 of the air conduction microphone 2901 may communicate with the air outside the speaker 2900, and a side of the air conduction microphone 2901 may be connected to a side surface inside the housing 2903. The bone conduction microphone 2902 may be bonded to a side surface of the housing 2903. The air conduction microphone 2901 may obtain an air conduction sound signal through the sound hole 2904, and obtain a first vibration signal (i.e., a vibration noise signal) through a connection structure between the side and the housing 2903. The bone conduction microphone 2902 may obtain a second vibration signal (i.e., a mechanical vibration signal transmitted by the housing 2903). Both the first vibration signal and the second vibration signal may be generated by vibration of the housing 2903. In particular, because of the large differences between structures of the bone conduction microphone 2902 and the air conduction microphone 2901, the amplitude-frequency response and phase-frequency response of the two microphones may be different, the signal processing method shown in FIG. 15-A may be used to remove the vibration and noise signals.

Example 13

Figure 30:
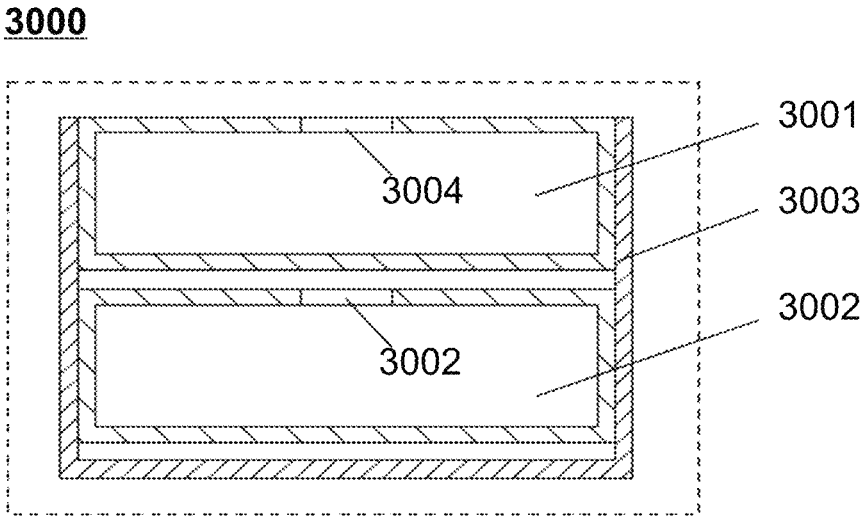
FIG. 30 is a schematic diagram illustrating a structure of a dual-microphone assembly according to some embodiments of the present disclosure.

As shown in FIG. 30, a dual-microphone assembly 3000 may include an air conduction microphone 3001, a closed microphone 3002, and a housing 3003. In some embodiments, a speaker (assembly) having two microphones may also be referred to as a dual-microphone speaker (assembly). As used herein, the air conduction microphone 3001 and the closed microphone 3002 may be an integral component, and outer walls of the two microphones may be bonded to an inner side of the housing 3003, respectively. The sound hole 3004 of the air conduction microphone 3001 may communicate with the air outside the dual-microphone assembly 3000, and a sound hole 3002 of the closed microphone 3002 may be located at the bottom of the air conduction microphone 3001 and isolated from the outside air (equivalent to the closed microphone in FIG. 22-B). In particular, the closed microphone 3002 may use an air conduction microphone that is exactly the same as the air conduction microphone 3001, and from a closed structure in which the closed microphone 3002 does not communicate with the outside air through a structural design. The integrated structure may make the air conduction microphone 3001 and the enclosed microphone 3002 have the same vibration transmission path relative to a vibration source (e.g., the vibration device 1401 in FIG. 14), such that the air conduction microphone 3001 and the enclosed microphone 3002 may receive the same vibration signal. The air conduction microphone 3001 may obtain an air conduction sound signal through the sound hole 3004, and obtain a first vibration signal (i.e., a vibration noise signal) through the housing 3003. The closed microphone 3002 may only obtain the second vibration signal (i.e., the mechanical vibration signal transmitted by the housing 3003). Both the first vibration signal and the second vibration signal may be generated by vibration of the housing 2903. In particular, a front cavity volume, a back cavity volume, and/or a cavity volume of the enclosed microphone 3002 may be determined accordingly to an equivalent volume of a corresponding volume (a front cavity volume, a back cavity volume, and/or a cavity volume) of the air conduction microphone 3001 such that the air conduction microphone 3001 and the closed microphone 3002 may have the same or approximately the same frequency response. The dual-microphone assembly 3000 may have the advantage of small volume, and may be individually debugged and obtained through a simple production process. In some embodiments, the dual-microphone assembly 3000 may remove vibration and noises in all communication frequency bands received by the air conduction microphone 3001.

Figure 31:
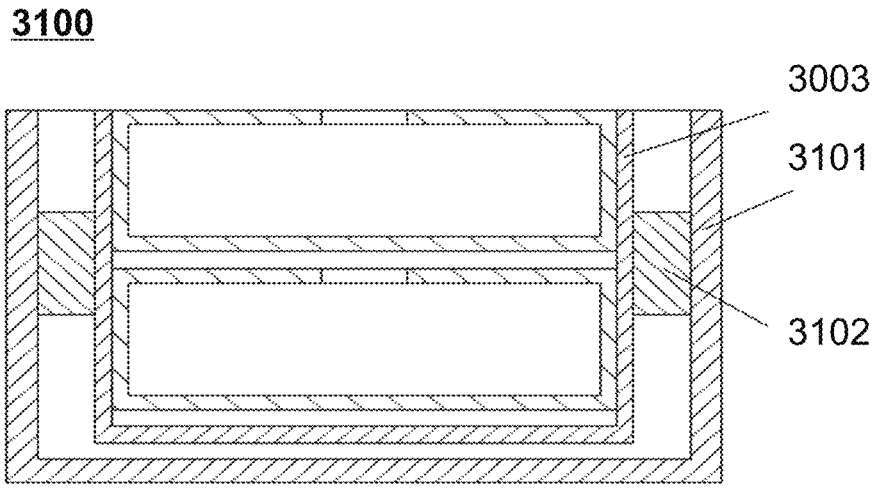
FIG. 31 is a schematic diagram illustrating a structure of a dual-microphone speaker according to some embodiments of the present disclosure.

FIG. 31 is a schematic diagram illustrating a structure of a speaker that contains the dual-microphone component in FIG. 30. As shown in FIG. 31, the speaker 3100 may include the dual-microphone assembly 3000, a housing 3101, and a connection structure 3102. The housing 3003 of components of the dual-microphone assembly 3000 may be connected to the housing 3101 through a peripheral connection. The peripheral connection may keep the two microphones in the dual-microphone assembly 3000 symmetrical with respect to the connection position on the housing 3101, thereby further ensuring that vibration transmission paths from the vibration source to the two microphones are the same. In some embodiments, the speaker structure in FIG. 31 may effectively eliminate influences of different transmission paths of vibration noises, different types of two microphones, etc. on removing the vibration noises.

Example 14

Figure 32:
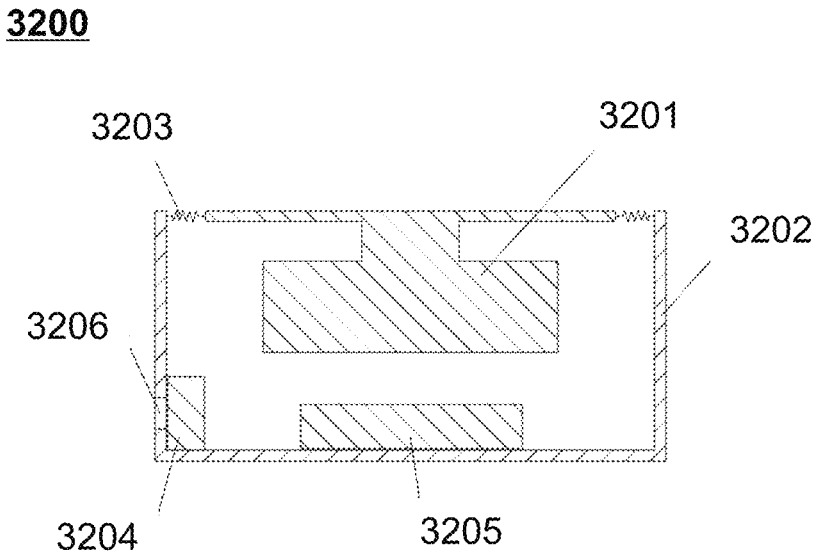
FIG. 32 is a schematic diagram illustrating a structure of a dual-microphone speaker according to some embodiments of the present disclosure.

FIG. 32 is a schematic diagram illustrating a structure of a dual-microphone speaker according to some embodiments of the present disclosure. As shown in FIG. 32, the speaker 3200 may include a vibration device 3201, a housing 3202, an elastic element 3203, an air conduction microphone 3204, a bone conduction microphone 3205, and an opening 3206. As used herein, the vibration device 3201 may be fixed on the housing 3202 through an elastic element 3203. The air conduction microphone 3204 and the bone conduction microphone 3205 may be respectively connected to different positions inside the housing 3202. The air conduction microphone 3204 may communicate with the outside air through the opening 3206 to receive air-conducted sound signals. When the vibration device 3201 vibrates and produces sound, the housing 3202 may be driven to vibrate, and the housing 3202 may transmit the vibration to the air conduction microphone 3204 and the bone conduction microphone 3205. In some embodiments, a signal processing method in FIG. 15-B may be used to remove the vibration noise signal received by the air conduction microphone 3204 using the vibration signal obtained by the bone conduction microphone 3205. In some embodiments, the bone conduction microphone 3205 may be used to remove vibration noises of all communication frequency bands received by the air conduction microphone 3204.

Example 15

Figure 33:
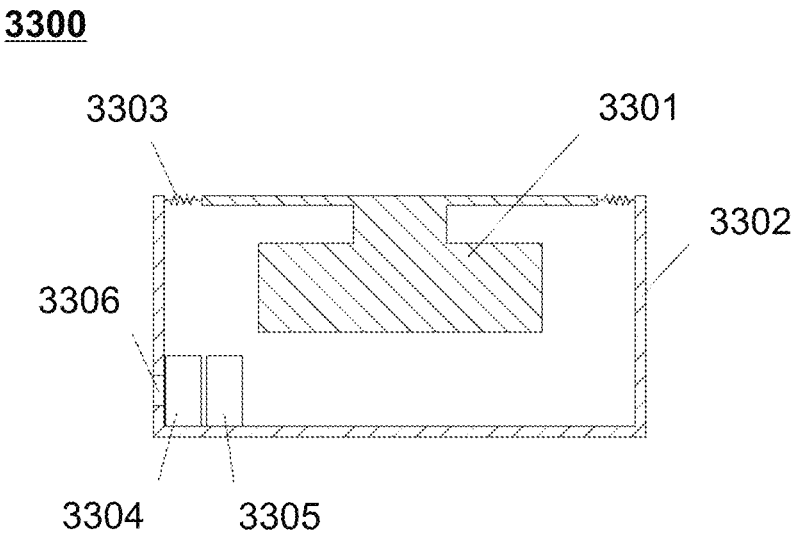
FIG. 33 is a schematic diagram illustrating a structure of a dual-microphone speaker according to some embodiments of the present disclosure.

FIG. 33 is a schematic diagram illustrating a structure of a dual-microphone speaker according to some embodiments of the present disclosure. As shown in FIG. 33, the speaker 3300 may include a vibration device 3301, a housing 3302, an elastic element 3303, an air conduction microphone 3304, a vibration sensor 3305, and an opening 3306. The vibration sensor 3305 may be a closed microphone, a dual-connected microphone, or a bone conduction microphone as shown in some embodiments of the present disclosure, or may be other sensor devices with a vibration signal collection function. The vibration device 3301 may be fixed to the housing 3302 through the elastic element 3303. The air conduction microphone 3304 and the vibration sensor 3305 may be two microphones with the same amplitude-frequency response and/or phase-frequency response after selection or adjustment. A top and a side of the air conduction microphone 3304 may be respectively connected to the inside of the housing 3302, and a side of the vibration sensor 3305 may be connected to the inside of the housing 3302. The air conduction microphone 3304 may communicate with the outside air through the opening 3306. When the vibration device 3301 vibrates, it may drive the housing 3302 to vibrate, and the vibration of the housing 3302 may be transmitted to the air conduction microphone 3304 and the vibration sensor 3305. Since a position where the air conduction microphone 3304 is connected to the housing 3302 is very close to a position where the vibration sensor 3305 is connected to the housing 3302 (e.g., the two microphones may be located at positions 1601 and 1602 in FIG. 16, respectively), the vibration transmitted to the two microphones by the housing 3302 may be the same. In some embodiments, the vibration noise signal received by the air conduction microphone 3304 may be removed using a signal processing method as shown in FIG. 15-C based on the signals received by the air conduction microphone 3304 and the vibration sensor 3305. In some embodiments, the vibration sensor 3305 may be used to remove vibration noises in all communication frequency bands received by the air conduction microphone 3304.

Example 16

Figure 34:
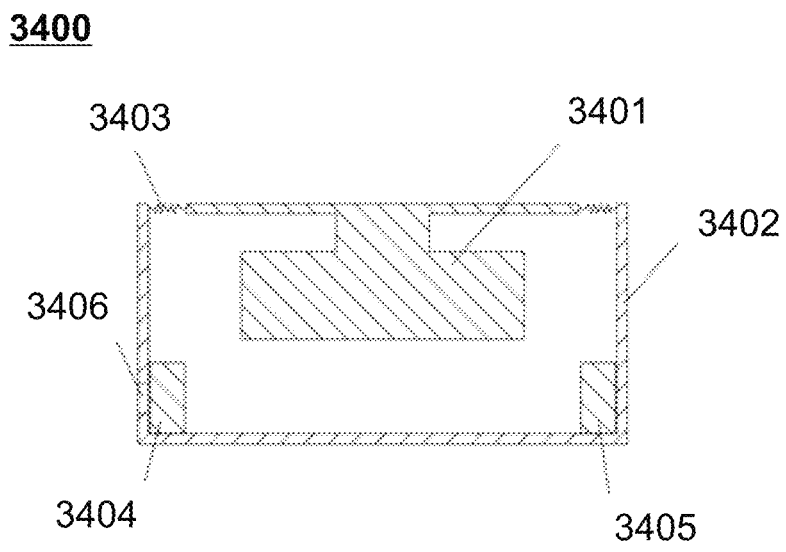
FIG. 34 is a schematic diagram illustrating a structure of a dual-microphone speaker according to some embodiments of the present disclosure.

FIG. 34 is a schematic diagram illustrating a structure of a dual-microphone speaker according to some embodiments of the present disclosure. The dual-microphone speaker 3400 may be another variant of the speaker 3300 in FIG. 33. The speaker 3400 may include a vibration device 3401, a housing 3402, an elastic element 3403, an air conduction microphone 3404, a vibration sensor 3405, and an opening 3406. The vibration sensor 3405 may be a closed microphone, a dual-link microphone, or a bone conduction microphone. The air conduction microphone 3404 and the vibration sensor 3405 may be respectively connected to the inner side of the housing 3402 through a peripheral connection, and may be symmetrically distributed with respect to the vibration device 3401 (e.g., the two microphones may be respectively located at positions 1601 and 1604 in FIG. 16). The air conduction microphone 3404 and the vibration sensor 3405 may be two microphones with the same amplitude-frequency response and/or phase-frequency response after selection or adjustment. In some embodiments, the vibration noise signal received by the air conduction microphone 3404 may be removed using the signal processing method shown in FIG. 15-C based on the signals received by the air conduction microphone 3404 and the vibration sensor 3405. In some embodiments, the vibration sensor 3405 may be used to remove vibration noises in all communication frequency bands received by the air conduction microphone 3404.

The embodiments described above are merely implements of the present disclosure, and the descriptions may be specific and detailed, but these descriptions may not limit the present disclosure. It should be noted that those skilled in the art, without deviating from concepts of the bone conduction speaker, may make various modifications and changes to, for example, the sound transfer approaches described in the specification, but these combinations and modifications are still within the scope of the present disclosure.

What is claimed is:

1. A bone conduction speaker, comprising:

a vibration device comprising a vibration conductive plate and a vibration board, wherein the vibration conductive plate is physically connected with the vibration board, vibrations generated by the vibration conductive plate and the vibration board have at least two resonance peaks, frequencies of the at least two resonance peaks being catchable with human ears, and sounds are generated by the vibrations transferred through a human bone;

a microphone configured to receive a first signal including a voice signal and a first vibration signal; and a vibration sensor configured to receive a second vibration signal, wherein the microphone and the vibration sensor are configured such that the first vibration signal can be offset with the second vibration signal.

2. The bone conduction speaker according to claim 1, further comprising a housing, wherein the bone conduction speaker, the microphone, and the vibration sensor are located in the housing.

3. The bone conduction speaker according to claim 1, wherein an amplitude-frequency response of the vibration sensor to the second vibration signal is same as an amplitude-frequency response of the microphone to the first vibration signal; or a phase-frequency response of the vibration sensor to the second vibration signal is same as a phase-frequency response of the microphone to the first vibration signal.

4. The bone conduction speaker according to claim 1, wherein a cavity volume of the vibration sensor is greater than a cavity volume of the microphone such that the microphone and the vibration sensor have an approximately same frequency response to the vibration of the vibration source.

5. The bone conduction speaker according to claim 1, further comprising a signal processing unit configured to make the first vibration signal offset with the second vibration signal and output the voice signal.

6. The bone conduction speaker according to claim 1, wherein the microphone includes a front cavity or a back cavity.

7. The bone conduction speaker according to claim 6, wherein the front cavity includes at least one opening on a top or a side wall of the front cavity.

8. The bone conduction speaker according to claim 1, wherein the vibration sensor includes a closed microphone, or a dual-link microphone.

9. The bone conduction speaker according to claim 8, wherein the closed microphone includes a closed front cavity and a closed back cavity.

10. The bone conduction speaker according to claim 8, wherein the dual-link microphone includes an open front cavity and an open back cavity.

11. The bone conduction speaker according to claim 1, wherein the microphone is an air conduction microphone and the vibration sensor is a bone conduction microphone.

12. The bone conduction speaker according to claim 1, wherein the microphone and the vibration sensor are both micro-electromechanical system microphones.

13. The bone conduction speaker according to claim 1, wherein the microphone and the vibration sensor are independently connected to a same housing.

14. The bone conduction speaker according to claim 13, wherein the microphone and the vibration sensor are located at adjacent positions on the housing or at symmetrical positions on the housing with respect to the bone conduction speaker.

15. The bone conduction speaker according to claim 13, wherein a connection between the microphone and the housing or a connection between the vibration sensor and the housing includes at least one of a cantilever connection, a peripheral connection, or a substrate connection.

16. The bone conduction speaker according to claim 1, wherein the vibration conductive plate includes a first torus and at least two first rods, the at least two first rods converging to a center of the first torus.

17. The bone conduction speaker according to claim 14, wherein the vibration board includes a second torus and at least two second rods, the at least two second rods converging to a center of the second torus.

18. The bone conduction speaker according to claim 15, wherein the first torus is fixed on a magnetic component.

19. The bone conduction speaker according to claim 1, wherein a lower resonance peak of the at least two resonance peaks is equal to or lower than 900 Hz.

20. The bone conduction speaker according to claim 19, wherein a higher resonance peak of the at least two resonance peaks is equal to or lower than 9500 Hz.

* * * * *